US012410026B2

(12) United States Patent
Shimosaka et al.

(10) Patent No.: US 12,410,026 B2
(45) Date of Patent: Sep. 9, 2025

(54) MEDIUM CONVEYANCE DEVICE, CONTROL METHOD, AND CONTROL PROGRAM

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 108 days.

(21) Appl. No.: 18/521,969

(22) Filed: Nov. 28, 2023

(65) Prior Publication Data

US 2024/0092604 A1 Mar. 21, 2024

Related U.S. Application Data

(63) Continuation-in-part of application No. PCT/JP2021/020730, filed on May 31, 2021.

(51) Int. Cl.

| | |
|---|---|
| ***B65H 7/18*** | (2006.01) |
| ***B65H 3/06*** | (2006.01) |
| ***B65H 3/52*** | (2006.01) |
| ***B65H 7/14*** | (2006.01) |

(52) U.S. Cl.

CPC ..... *B65H 7/18* (2013.01); *B65H 3/063* (2013.01); *B65H 3/0669* (2013.01); (Continued)

(58) Field of Classification Search

CPC .... B65H 3/063; B65H 3/0661; B65H 3/0669; B65H 3/5284; B65H 7/02; B65H 7/04; B65H 7/08; B65H 7/14; B65H 7/18

See application file for complete search history.

(56) References Cited

U.S. PATENT DOCUMENTS

2008/0006985 A1* 1/2008 Kuse ..... B65H 3/06 271/110
2009/0039588 A1* 2/2009 Suzuki ..... B65H 7/02 271/10.03

(Continued)

FOREIGN PATENT DOCUMENTS

JP H06-92490 A 4/1994
JP H08-25647 B 3/1996

(Continued)

OTHER PUBLICATIONS

International Search Report dated Aug. 17, 2021 for corresponding PCT Application No. PCT/JP2021/020730 (3 pages) with English Translation (2 pages).

(Continued)

*Primary Examiner* — Prasad V Gokhale

(74) *Attorney, Agent, or Firm* — WOMBLE BOND DICKINSON (US) LLP

(57) ABSTRACT

A medium conveying apparatus includes a loading tray to place media, a feed roller to separate and sequentially feed the media placed on the loading tray, a motor to drive the feed roller, a sensor located on a downstream side of the feed roller in a medium conveying direction to detect a medium, and a processor to control the motor. In a separation period from a start of medium feeding by the feed roller to detection of a front edge of the first medium by the sensor, when feeding a first medium of a plurality of media placed on the loading tray, the processor controls the motor to rotate the feed roller at a constant speed, and when feeding a second or subsequent medium, the processor controls the motor to rotate the feed roller at a first speed and then at a second speed higher than the first speed.

20 Claims, 36 Drawing Sheets

(52) U.S. Cl.
CPC ..... *B65H 3/5284* (2013.01); *B65H 7/14* (2013.01); *B65H 2511/11* (2013.01); *B65H 2511/51* (2013.01); *B65H 2513/10* (2013.01); *B65H 2513/50* (2013.01); *B65H 2513/512* (2013.01)

(56) References Cited

U.S. PATENT DOCUMENTS

| | | | | |
|---|---|---|---|---|
| 2012/0113488 | A1 | 5/2012 | Machida et al. | |
| 2016/0355361 | A1* | 12/2016 | Arai ..... | B65H 3/56 |
| 2017/0374214 | A1 | 12/2017 | Kanamitsu et al. | |
| 2018/0198943 | A1 | 7/2018 | Yoshikaie et al. | |
| 2019/0116284 | A1 | 4/2019 | Yoshikaie et al. | |
| 2020/0071100 | A1 | 3/2020 | Namiki et al. | |
| 2020/0324991 | A1 | 10/2020 | Nakamura et al. | |
| 2020/0382669 | A1 | 12/2020 | Arimori et al. | |

FOREIGN PATENT DOCUMENTS

| | | | |
|---|---|---|---|
| JP | 2001-213536 | A | 8/2001 |
| JP | 2007-230681 | A | 9/2007 |
| JP | 2008-110835 | A | 5/2008 |
| JP | 2012-111565 | A | 4/2012 |
| JP | 2012-224405 | A | 11/2012 |
| JP | 2013-23307 | A | 2/2013 |
| JP | 2014-58400 | A | 4/2014 |
| JP | 2018-6855 | A | 6/2016 |
| JP | 2016-199395 | A | 12/2016 |
| JP | 2018-108889 | A | 7/2018 |
| JP | 2019-75690 | A | 5/2019 |
| JP | 2020-37483 | A | 3/2020 |
| JP | 2020-195094 | A | 12/2020 |
| WO | WO 2019/130648 | A | 7/2019 |

OTHER PUBLICATIONS

Written Opinion dated Aug. 17, 2021 for corresponding PCT Application No. PCT/JP2021/020730 (4 pages) with English Translation (3 pages).

Preliminary Report on Patentability dated Nov. 21, 2023 for corresponding PCT Application No. PCT/JP2021/020730 (5 pages) with English Translation (4 pages).

* cited by examiner

MEDIUM CONVEYANCE DEVICE, CONTROL METHOD, AND CONTROL PROGRAM

CROSS-REFERENCE TO RELATED APPLICATIONS

This application is a continuation-in-part of International Application No. PCT/JP2021/020730, filed on May 31, 2021, the entire contents of which are incorporated herein by reference.

TECHNICAL FIELD

The present disclosure relates to a medium conveying apparatus, a control method, and a control program and particularly relates to a medium conveying apparatus, a control method, and a control program for separating and sequentially feeding media.

BACKGROUND

In a medium conveying apparatus such as a scanner that separates and sequentially feeds a plurality of media to image, it is required to further reduce the time required for medium feeding. On the other hand, it is required for the medium conveying apparatus to temporarily stop medium feeding, for example, when there is insufficient free space in a storage device to store images of the media or when the distance between successively fed media is short. In such a case, the medium conveying apparatus is required to suitably control stoppage and resumption of medium feeding.

A sheet feeding device to control a feed roller to a low speed, when feeding of a succeeding sheet by the feed roller is started after arrival of the rear edge of a preceding sheet is detected by a post-registration sensor, is disclosed (see International Application Publication No. WO 2019/130648). The sheet feeding device controls the feed roller to a high speed when the front edge of the succeeding sheet passes a nip position of the feed roller and a separation roller.

SUMMARY

According to some embodiments, a medium conveying apparatus includes a loading tray to place media, a feed roller to separate and sequentially feed the media placed on the loading tray, a motor to drive the feed roller, a sensor located on a downstream side of the feed roller in a medium conveying direction to detect a medium, and a processor to control the motor. In a separation period from a start of medium feeding by the feed roller to detection of a front edge of the first medium by the sensor, when feeding a first medium of a plurality of media placed on the loading tray, the control module controls the motor to rotate the feed roller at a constant speed, and when feeding a second or subsequent medium, the control module controls the motor to rotate the feed roller at a first speed and then at a second speed higher than the first speed.

According to some embodiments, a method for conveying a medium includes separating and sequentially feeding media placed on a loading tray by a feed roller, driving the feed roller by a motor, detecting a medium by a sensor located on a downstream side of the feed roller in a medium conveying direction, and controlling the motor. In a separation period from a start of medium feeding by the feed roller to detection of a front edge of the first medium by the sensor, when feeding a first medium of a plurality of media placed on the loading tray, controlling the motor to rotate the feed roller at a constant speed, and when feeding a second or subsequent medium, controlling the motor to rotate the feed roller at a first speed and then at a second speed higher than the first speed.

According to some embodiments, a computer-readable, non-transitory medium storing executable instructions for conveying a medium is provided. The executable instructions includes controlling a motor to drive a feed roller to separate and sequentially feed media placed on a loading tray. In a separation period from a start of medium feeding by the feed roller to detection of a front edge of the first medium by a sensor located on a downstream side of the feed roller in a medium conveying direction, when feeding a first medium of media placed on the loading tray, controlling the motor to rotate the feed roller at a constant speed, and when feeding a second or subsequent medium, controlling the motor to rotate the feed roller at a first speed and then at a second speed higher than the first speed.

DESCRIPTION OF EMBODIMENTS

The object and advantages of the invention will be realized and attained by means of the elements and combinations, in particular, described in the claims. It is to be understood that both the foregoing general description and the following detailed description are exemplary and explanatory, and are not restrictive of the invention as claimed.

Hereinafter, a medium conveying apparatus, a control method and a control program according to an embodiment, will be described with reference to the drawings. However, it should be noted that the technical scope of the invention is not limited to these embodiments, and extends to the inventions described in the claims and their equivalents.

Figure 1:
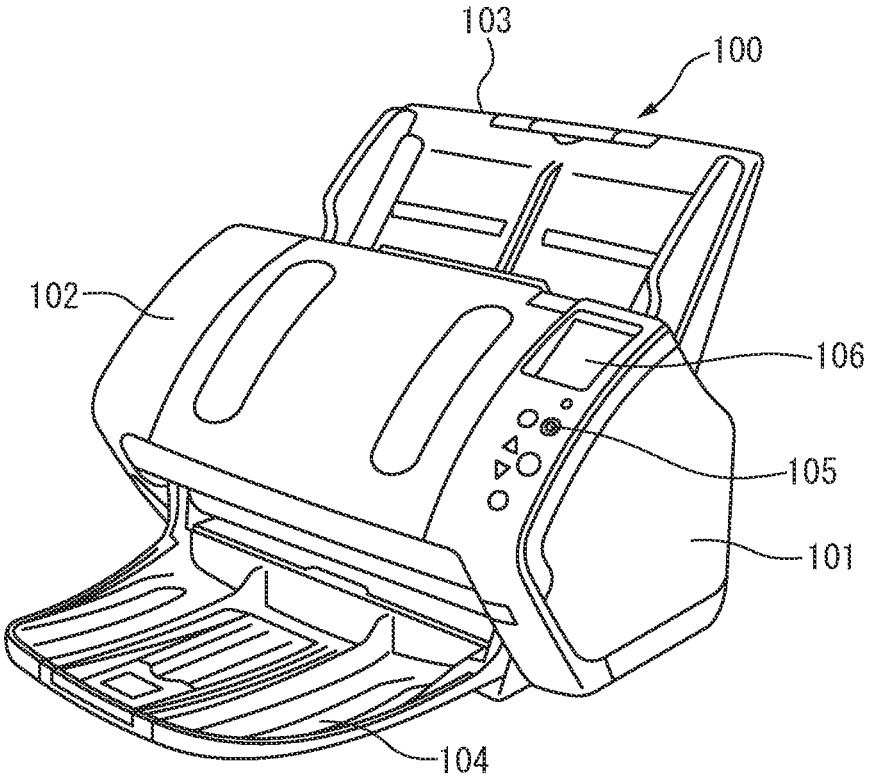
FIG. 1 is a perspective view illustrating an example of a medium conveying apparatus according to an embodiment.

FIG. 1 is a perspective view illustrating an example of a medium conveying apparatus configured as an image scanner. The medium conveying apparatus 100 conveys and images a medium being a document. Examples of a medium include paper, thick paper, a card, a booklet, and a passport. The medium conveying apparatus 100 may be a facsimile, a copying machine, a multifunctional peripheral (MFP), etc. A conveyed medium may be an object being printed on, etc., instead of a document, and the medium conveying apparatus 100 may be a printer, etc.

The medium conveying apparatus 100 includes a lower housing 101, an upper housing 102, a loading tray 103, an ejection tray 104, an operation device 105, a display device 106, etc.

The upper housing 102 is located at a position covering the top surface of the medium conveying apparatus 100 and is engaged with the lower housing 101 by a hinge to be openable when, for example, a medium is stuck or cleaning of the inside of the medium conveying apparatus 100 is performed.

The loading tray 103 is engaged with the lower housing 101 and places a medium to be fed and conveyed. The ejection tray 104 is engaged with the upper housing 102 and places an ejected medium. The ejection tray 104 may be engaged with the lower housing 101.

The operation device 105 includes an input device such as a button, and an interface circuit acquiring a signal from the input device, accepts an input operation by a user, and outputs an operation signal based on the input operation by the user. The display device 106 includes a display including a liquid crystal, an organic electro-luminescence (EL), etc., and an interface circuit outputting image data to the display, and displays the image data on the display.

Figure 2:
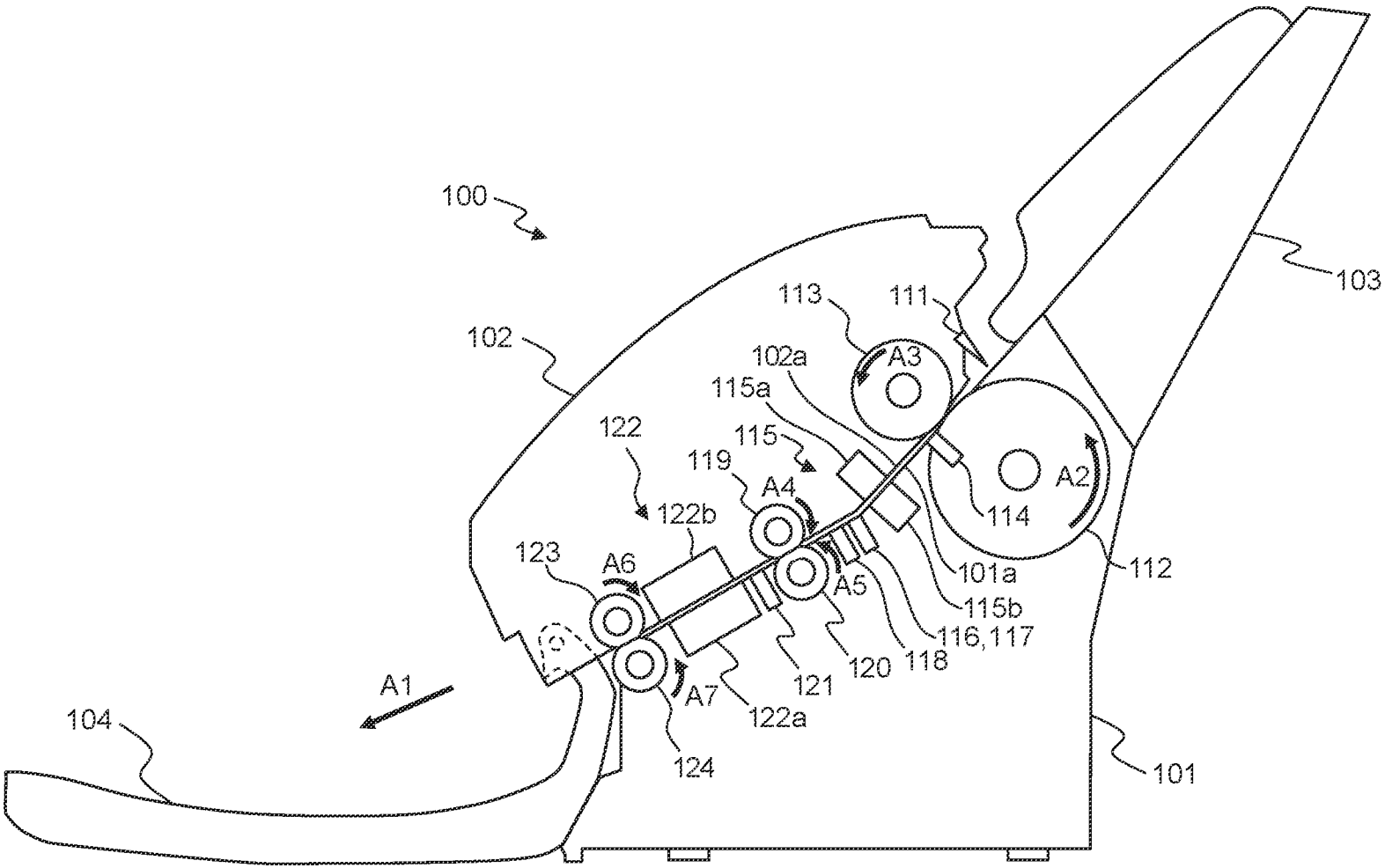
FIG. 2 is a diagram for illustrating an example of a conveyance path inside a medium conveying apparatus.

FIG. 2 is a diagram for illustrating a conveyance path inside the medium conveying apparatus 100.

The conveyance path inside the medium conveying apparatus 100 includes a first medium sensor 111, a feed roller 112, a brake roller 113, a second medium sensor 114, an ultrasonic sensor 115, a third medium sensor 116, a fourth medium sensor 117, a fifth medium sensor 118, a conveyance roller 119, a first facing roller 120, a sixth medium sensor 121, an imaging device 122, an ejection roller 123, a second facing roller 124, etc.

Each of the numbers of the feed roller 113, the brake roller 114, the conveyance roller 119, the first facing roller 120, the ejection roller 123, and/or the second facing roller 124 is not limited to one and may be more than one. In that case, a plurality of feed rollers 113, brake rollers 114, conveyance rollers 119, first facing rollers 120, ejection rollers 123, and/or second facing rollers 124 are respectively spaced in the width direction A2 perpendicular to the medium conveying direction A1.

The top surface of the lower housing 101 forms a lower guide 101*a* of the conveyance path of a medium, and the bottom surface of the upper housing 102 forms an upper guide 102*a* of the conveyance path of a medium. An arrow A1 in FIG. 2 indicates a medium conveying direction. Hereinafter, an upper stream refers to an upper stream in the medium conveying direction A1, and a lower stream refers to a lower stream in the medium conveying direction A1.

The first medium sensor 111 is located on the upstream side of the feed roller 112 and the brake roller 113. The first medium sensor 111 includes a contact detection sensor and detects whether a medium is placed on the loading tray 103. The first medium sensor 111 generates and outputs a first medium signal, the signal value of which varies between a state in which a medium is placed on the loading tray 103 and a state in which a medium is not placed. The first medium sensor 111 is not limited to a contact detection sensor and any other sensor that can detect existence of a medium, such as a light detection sensor, may be used as the first medium sensor 111.

The feed roller 112 is provided in the lower housing 101, separates and sequentially feeds media placed on the loading tray 103 from the lower side. The brake roller 113 is provided in the upper housing 102, to face the feed roller 112, and rotates in a direction opposite to a medium feeding direction. The feed roller 112 may be provided in the upper housing 102, the brake roller 113 may be provided in the lower housing 101, and the feed roller 112 may sequentially feed media placed on the loading tray 103 from the upper side.

The second medium sensor 114 is an example of a second sensor, is located on the downstream side of the feed roller 112 and on the upstream side of the conveyance roller 119, and detects a medium conveyed to the position of the sensor. In particular, the second medium sensor 114 is located between the feed roller 112 and the fifth medium sensor 118 in the medium conveying direction A1 and close to a nip region of the feed roller 112 and the brake roller 113. The second medium sensor 114 includes a light emitter and a light receiver that are provided on one side of the medium conveyance path and a light-guiding tube, provided at a position facing the light emitter and the light receiver with the medium conveyance path in between. The light emitter is a light emitting diode (LED), etc., and emits light toward the medium conveyance path. The light receiver is a photodiode, etc., and receives light emitted by the light emitter and guided by the light guide. When a medium is present at a position facing the second medium sensor 114, light emitted from the light emitter is blocked by the medium, and therefore the light receiver does not detect the light emitted from the light emitter. The second medium sensor 114 generates and outputs a second medium signal, the signal value of which varies between a state in which a medium is present at the position of the second medium sensor 114 and a state in which a medium is not present, based on the intensity of light received by the light receiver.

The ultrasonic sensor 115 is an example of a thickness detection sensor. The ultrasonic sensor 115 is located on the downstream side of the feed roller 112 and on the upstream side of the conveyance roller 119. The ultrasonic sensor 115 includes an ultrasonic transmitter 115*a* and an ultrasonic receiver 115*b*. The ultrasonic transmitter 115*a* and the ultrasonic receiver 115*b* are located close to the conveyance path of a medium to face each other with the conveyance path in between. The ultrasonic transmitter 115*a* transmits an ultrasonic wave. The ultrasonic receiver 115*b* receives an ultrasonic wave transmitted by the ultrasonic transmitter 115*a* and passing through a medium and generates and outputs an ultrasonic signal being an electric signal based on the received ultrasonic wave. When a plurality of media are conveyed in a stacked manner, an ultrasonic wave passing through the media is attenuated by an air layer between the media conveyed in a stacked manner. Accordingly, the medium ejection apparatus 100 can detect multi feed of media, based on the ultrasonic signal. Further, an ultrasonic wave passing through a medium is also attenuated by the medium itself, and an amount of attenuation increases as the thickness of the medium through which the ultrasonic wave passes increases. Accordingly, the medium ejection apparatus 100 can detect the thickness of the conveyed medium, based on the ultrasonic signal.

The fifth medium sensor 118 is an example of a sensor, is located on the downstream side of the feed roller 112 and on the upstream side of the conveyance roller 119, and detects a medium conveyed to the position of the sensor. In other words, the fifth medium sensor 118 is located between the feed roller 112 and the conveyance roller 119. The fifth medium sensor 118 includes a light emitter and a light receiver that are provided on one side of the medium conveyance path and a light-guiding tube, provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light-guiding tube. The fifth medium sensor 118 generates and outputs a fifth medium signal, the signal value of which varies between a state in which a medium is present at the position of the fifth medium sensor 118 and a state in which a medium is not present, based on the intensity of light received by the light receiver.

The conveyance roller 119 and the first facing roller 120 are located on the downstream side of the feed roller 112 to face each other and convey a medium fed by the feed roller 112 and the brake roller 113 to the imaging device 122. The conveyance roller 119 is provided in the upper housing 102, and the first facing roller 120 is provided on the lower side of the conveyance roller 119 in the lower housing 101.

The sixth medium sensor 121 is located on the downstream side of the conveyance roller 119 and on the upstream side of the imaging device 122 and detects a medium conveyed to the position of the sensor. The sixth medium sensor 121 includes a light emitter and a light receiver that are provided on one side of the medium conveyance path and a lightguide, provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light guide. The sixth medium sensor 121 generates and outputs a sixth medium signal, the signal value of which varies between a state in which a medium is present at the position of the sixth medium sensor 121 and a state in which a medium is not present, based on the intensity of light received by the light receiver.

The imaging device 122 is an example of an imaging module, is located on the downstream side of the conveyance roller 119, and images a medium conveyed by the conveyance roller 119. The imaging device 122 includes a first imaging device 122*a* and a second imaging device 122*b* that are located to face each other with the medium conveyance path in between. The first imaging device 122*a* includes a line sensor based on a unity-magnification optical system type contact image sensor (CIS) including complementary metal oxide semiconductor- (CMOS-)based imaging elements linearly arranged in a main scanning direction. The first imaging device 122*a* further includes lenses each forming an image on an imaging element, and an A/D converter amplifying and analog-digital (A/D) converting an electric signal output from the imaging element. The first imaging device 122*a* generates an input image by imaging the front side of a conveyed medium in accordance with control from a processing circuit described later and outputs the generated image.

The second imaging device 122*b* includes a line sensor based on a unity-magnification optical system type CIS including CMOS-based imaging elements linearly arranged in the main scanning direction. The second imaging device 122*b* further includes lenses each forming an image on an imaging element, and an A/D converter amplifying and analog-digital (A/D) converting an electric signal output from the imaging element. The second imaging device 122*b* generates an input image by imaging the back side of a conveyed medium in accordance with control from the processing circuit described later and outputs the generated image.

Only one of the first imaging device 122*a* and the second imaging device 122*b* may be located and only one side of a medium may be read in the medium conveying apparatus 100. Further, a line sensor based on a unity-magnification optical system type CIS including charge coupled device-(CCD-)based imaging elements may be used in place of the line sensor based on a unity-magnification optical system type CIS including CMOS-based imaging elements. Further, a reduction optical system type line sensor including CMOS-based or CCD-based imaging elements may be used.

The image sensors may be located to face each other, or may not be located to face each other.

The ejection roller 123 and the second facing roller 124 are located on the downstream side of the imaging device 122 to face each other and eject a medium conveyed by the conveyance roller 119 and the first facing roller 120 and imaged by the imaging device 122 into the ejection tray 104. The ejection roller 123 is provided in the upper housing 102, and the second facing roller 124 is provided on the lower side of the ejection roller 123 in the lower housing 101.

A medium placed on the loading tray 103 is conveyed between the lower guide 101*a* and the upper guide 102*a* toward the medium conveying direction A1 by the feed roller 112 rotating in a direction of an arrow A3 in FIG. 2, i.e., the medium ejecting direction. The brake roller 113 rotates in a direction of an arrow A3, i.e., a direction opposite to the medium feeding direction at the time of medium conveying. When a plurality of media are placed on the loading tray 103, only a medium in contact with the feed roller 112 of the medium placed on the loading tray 103 is separated by working of the feed roller 112 and the brake roller 113. Consequently, conveyance of a medium other than the separated medium is restricted (prevention of multi feed). The brake roller 113 may separate the medium by stopping. A separation pad may be used in place of the brake roller 113.

A medium is fed between the conveyance roller 119 and the first facing roller 120 while being guided by the lower guide 101*a* and the upper guide 102*a*. The medium is fed between the first imaging device 122*a* and the second imaging device 122*b* by the conveyance roller 119 and the first facing roller 120 rotating in directions of an arrow A4 and an arrow A5, respectively. The medium read by the imaging device 122 is ejected into the ejection tray 104 by the ejection roller 123 and the second facing roller 124 rotating in directions of an arrow A6 and an arrow A7, respectively.

Figure 3:
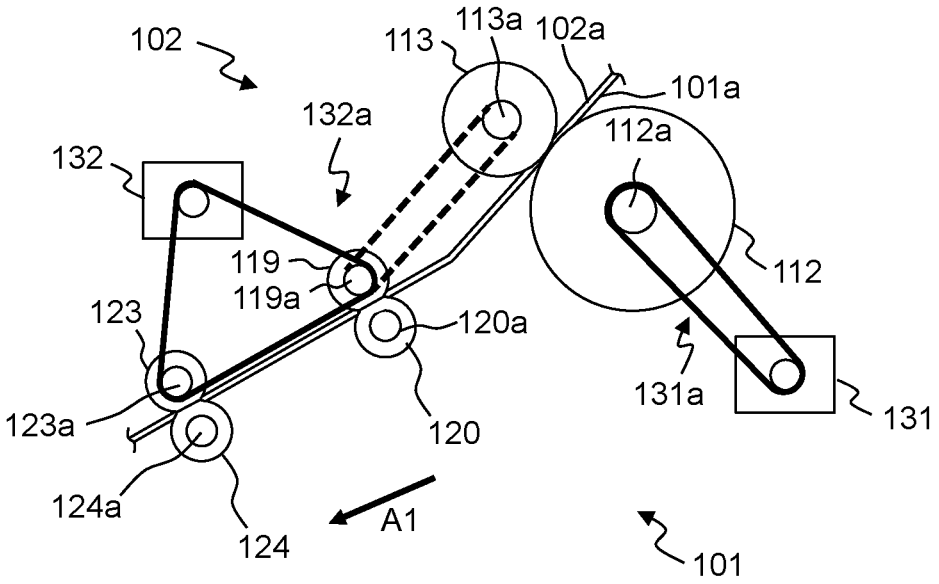
FIG. 3 is a schematic diagram for illustrating examples of driving sources.

FIG. 3 is a schematic diagram for illustrating driving sources of the feed roller 112, the brake roller 113, the conveyance roller 119, the first facing roller 120, the ejection roller 123, and/or the second facing roller 124.

As illustrated in FIG. 3, the medium conveying apparatus 100 includes a first motor 131 and a second motor 132 as driving sources of the rollers.

The first motor 131 is an example of a motor, is provided in the lower housing 101, is connected to the feed roller 112 through a first transmission mechanism 131*a*, and drives the feed roller 112. The first motor 131 generates a driving force for driving the feed roller 112 in accordance with a control signal from a processing circuit. The first transmission mechanism 131*a* includes one or a plurality of pulleys, belts, gears, etc., that are provided between the first motor 131 and a shaft 112*a* of the feed roller 112 and transmits the driving force generated by the first motor 131 to the feed roller 112. The first motor 131 feeds a medium by rotating the feed roller 112.

The second motor 132 is provided in the upper housing 102 separately from the first motor 131, is connected to the conveyance roller 119, the ejection roller 123, and the brake roller 113 through a second transmission mechanism 132*a*, and drives the conveyance roller 119, the ejection roller 123, and the brake roller 113. The second motor 132 generates a driving force for driving the conveyance roller 119, the ejection roller 123, and the brake roller 113 in accordance with a control signal from the processing circuit. The second transmission mechanism 132*a* includes one or a plurality of pulleys, belts, gears, etc., that are provided between the second motor 132, and a shaft 119*a* of the conveyance roller 119, a shaft 123*a* of the ejection roller 123, and a shaft 113*a* of the brake roller 113. In particular, one or a plurality of gears for changing the rotation direction and the rotation speed of each roller are provided between the shaft 119*a* of the conveyance roller 119 and/or the shaft 123*a* of the ejection roller 123, and the shaft 113*a* of the brake roller 113. The second transmission mechanism 132*a* transmits the driving force generated by the second motor 132 to the conveyance roller 119, the ejection roller 123, and the brake roller 113. The second motor 132 causes the conveyance roller 119, the ejection roller 123, and the brake roller 113 to feed, convey, and eject a medium by rotating the conveyance roller 119, the ejection roller 123, and the brake roller 113. The second motor 132 is an example of a driving source of the brake roller 113.

The first facing roller 120 is a driven roller driven to rotate by the conveyance roller 119, and the second facing roller 124 is a driven roller driven to rotate by the ejection roller 123. The first facing roller 120 and/or the second facing roller 124 may be provided to be driven by the driving force from the second motor 132. In that case, one or a plurality of gears are further provided between the shaft 119*a* of the conveyance roller 119 and the shaft 120*a* of the first facing roller 120 and/or between the shaft 123*a* of the ejection roller 123 and the shaft 124*a* of the second facing roller 124. The second transmission mechanism 132*a* further transmits the driving force generated by the second motor 132 to the first facing roller 120 and/or the second facing roller 124.

Figure 4:
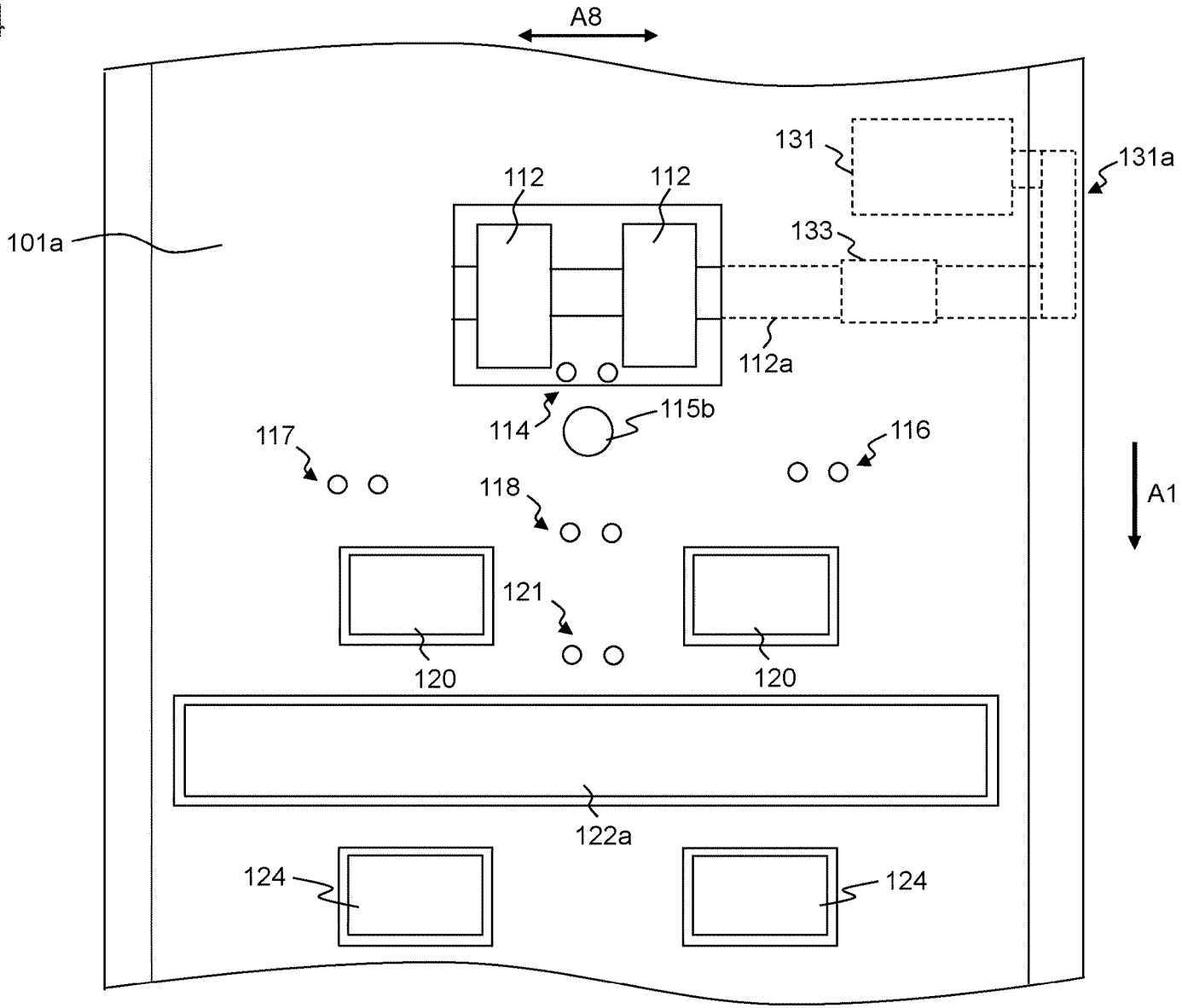
FIG. 4 is a schematic diagram for illustrating an example of third medium sensor, etc.
Figure 5:
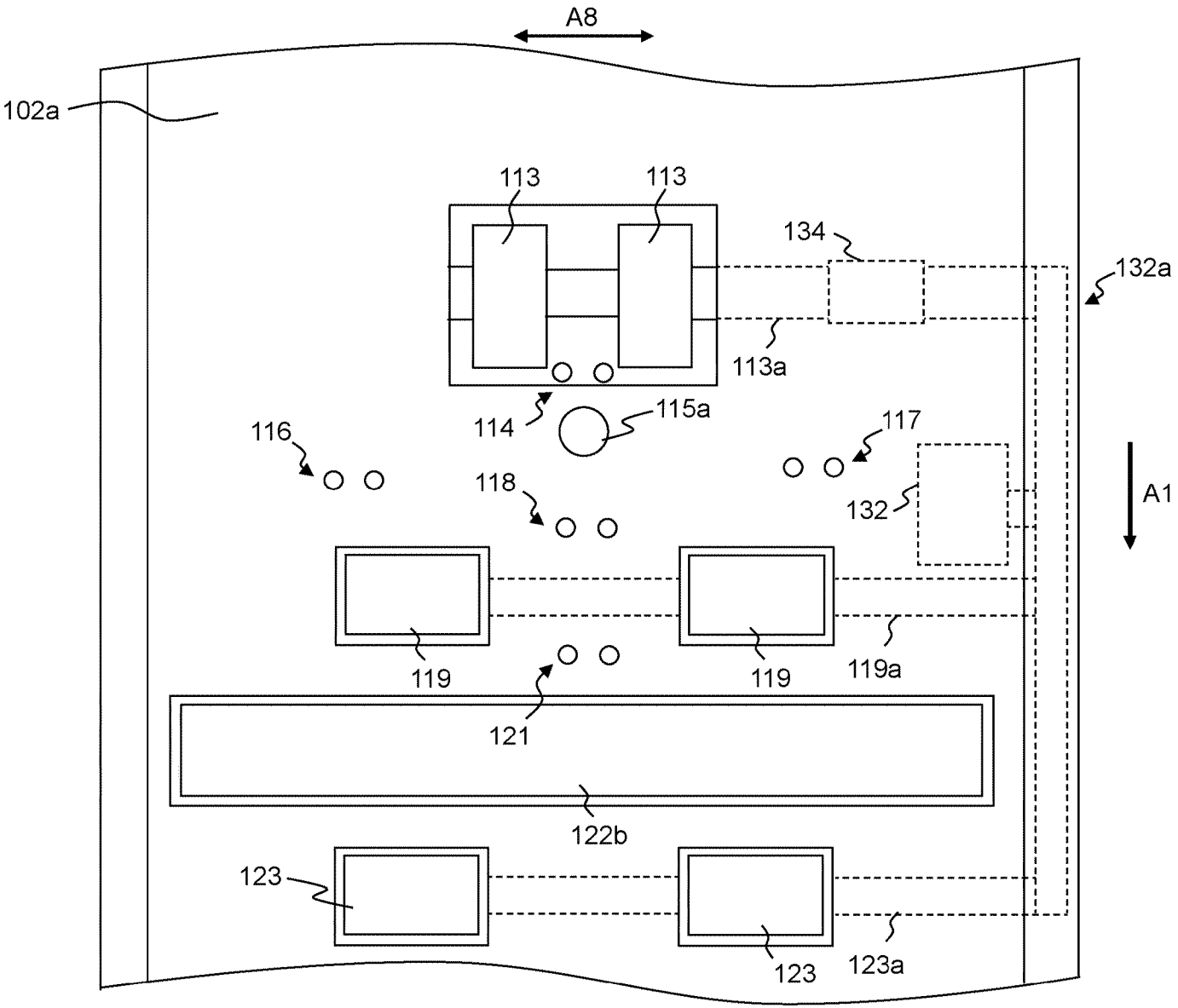
FIG. 5 is a schematic diagram for illustrating an example of a third medium sensor, etc.

FIG. 4 and FIG. 5 are schematic diagrams for illustrating the third medium sensor 116 and the fourth medium sensor 117. FIG. 4 is a schematic diagram of the lower guide 101*a* of the lower housing 101 viewed from above, and FIG. 5 is a schematic diagram of the upper guide 102*a* of the upper housing 102 viewed from below.

As illustrated in FIG. 4 and FIG. 5, the third medium sensor 116 and the fourth medium sensor 117 are located on the downstream side of the feed roller 112 and on the upstream side of the conveyance roller 119 and detect a medium conveyed to the positions of the sensors. In particular, the third medium sensor 116 and the fourth medium sensor 117 are located between the second medium sensor 114 and the fifth medium sensor 118 in the medium conveying direction A1. The third medium sensor 116 and the fourth medium sensor 117 may be located at positions almost identical to that of the fifth medium sensor 118 in the medium conveying direction A1. Further, the third medium sensor 116 and the fourth medium sensor 117 are spaced in a width direction A8 perpendicular to the medium conveying direction.

The third medium sensor 116 includes a light emitter and a light receiver that are provided on one side of the medium conveyance path and a light guide, provided at a position facing the light emitter and the light receiver with the medium conveyance path in between. The light emitter is an LED, etc., and emits light toward the medium conveyance path. The light receiver is a photodiode, etc., and receives light emitted by the light emitter and guided by the light guide. The third medium sensor 116 generates and outputs a third medium signal, the signal value of which varies between a state in which a medium is present at the position of the third medium sensor 116 and a state in which a medium is not present, based on the intensity of light received by the light receiver.

The fourth medium sensor 117 includes a light emitter and a light receiver that are provided on one side of the medium conveyance path and a light guide, provided at a position facing the light emitter and the light receiver with the medium conveyance path in between. The light emitter is an LED, etc., and emits light toward the medium conveyance path. the light receiver is a photodiode, etc., and receives light emitted by the light emitter and guided by the light guide. The fourth medium sensor 117 generates and outputs a fourth medium signal, the signal value of which varies between a state in which a medium is present at the position of the fourth medium sensor 117 and a state in which a medium is not present, based on the intensity of light received by the light receiver.

A reflection member such as a mirror may be used in place of the light guide in the second medium sensor 114, the third medium sensor 116, the fourth medium sensor 117, the fifth medium sensor 118, and/or the sixth medium sensor 121. Further, the light emitter and the light receiver may be provided to face each other with the medium conveyance path in between in the second medium sensor 114, the third medium sensor 116, the fourth medium sensor 117, the fifth medium sensor 118, and/or the sixth medium sensor 121. Further, each of the second medium sensor 114, the third medium sensor 116, the fourth medium sensor 117, the fifth medium sensor 118, and/or the sixth medium sensor 121 may detect existence of a medium by, for example, a contact detection sensor to pass predetermined current when a medium is in contact or when a medium is not in contact. Further, each of the second medium sensor 114, the third medium sensor 116, the fourth medium sensor 117, the fifth medium sensor 118, and/or the sixth medium sensor 121 may include an arm, a light emitter and a light receiver, to detect the medium. The arm is provided to be able to move by the medium being in contact with the arm. The light emitter and the light receiver may be provided to face each other with the arm in between. Each sensor generates and outputs a medium signal, the signal value of which varies between a state in which a medium is present at the position of each sensor and a state in which a medium is not present, based on the intensity of light received by the light receiver.

As illustrated in FIG. 4, the medium conveying apparatus 100 includes a first electromagnetic clutch 133. The first electromagnetic clutch 133 is an example of an interruption mechanism and is provided on the shaft 112*a* of the feed roller 112, i.e., on a driving force transmission path from the first motor 131 to the feed roller 112. The first electromagnetic clutch 133 is provided to be able to interrupt the driving force from the first motor 131 to the feed roller 112 in accordance with a control signal from the processing circuit.

As illustrated in FIG. 5, the medium conveying apparatus 100 includes a second electromagnetic clutch 134. The second electromagnetic clutch 134 is an example of an electromagnetic clutch and is provided on the shaft 113*a* of the brake roller 113, i.e., on a driving force transmission path from the second motor 132 being the driving source of the brake roller 113 to the brake roller 113. The second electromagnetic clutch 134 is provided to be able to change the magnitude of torque exerted on the brake roller 113 in accordance with a control signal from the processing circuit.

Figure 6:
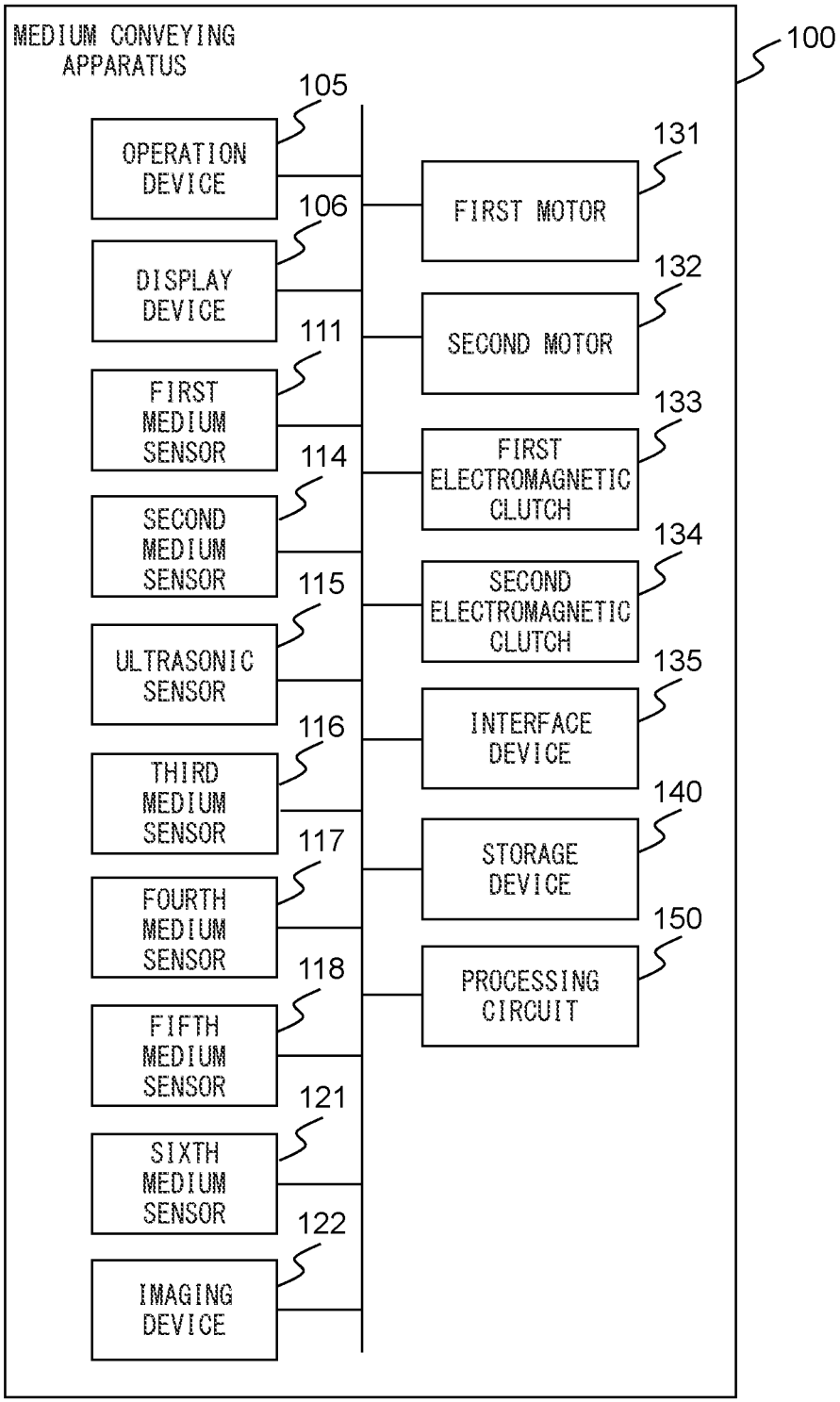
FIG. 6 is a block diagram illustrating a schematic configuration of an example of a medium conveying apparatus.

FIG. 6 is a block diagram illustrating a schematic configuration of an example of a medium conveying apparatus.

In addition to the configuration described above, the medium conveying apparatus 100 further includes an interface device 135, a storage device 140, a processing circuit 150, etc.

For example, the interface device 135 includes an interface circuit conforming to a serial bus such as USB and transmits and receives an input image and various types of information by being electrically connected to an unillustrated information processing apparatus (such as a personal computer or a mobile information terminal). A communication device including an antenna transmitting and receiving wireless signals and a wireless communication interface circuit for transmitting and receiving signals through a wireless communication line in accordance with a predetermined communication protocol may be used in place of the interface device 135. For example, the predetermined communication protocol is a wireless local area network (LAN). The communication device may include a wired communication interface circuit for transmitting and receiving signals through a wired communication line in accordance with a communication protocol such as a wired LAN.

The storage device 140 includes a memory device such as a random-access memory (RAM) or a read-only memory (ROM), a fixed disk device such as a hard disk, a portable storage device such as a flexible disk or an optical disk, etc. Further, a computer program, a database, a table, etc., that are used for various types of processing in the medium conveying apparatus 100 are stored in the storage device 140. The computer programs may be installed on the storage device 140 from a computer-readable, non-transitory portable storage medium by using a well-known set-up program, etc. The portable storage medium is, for example, a compact disc read-only memory (CD-ROM) or a digital versatile disc read-only memory (DVD-ROM).

The processing circuit 150 operates in accordance with a program previously stored in the storage device 140. For example, the processing circuit is a central processing unit (CPU). Examples of the processing circuit 150 that may also be used include a digital signal processor (DSP), a large scale integration (LSI), an application specific integrated circuit (ASIC), and a field-programmable gate array (FPGA).

The processing circuit 150 is connected to the operation device 105, the display device 106, the first medium sensor 111, the second medium sensor 114, the ultrasonic sensor 115, the third medium sensor 116, the fourth medium sensor 117, the fifth medium sensor 118, the sixth medium sensor 121, the imaging device 122, the first motor 131, the second motor 132, the first electromagnetic clutch 133, the second electromagnetic clutch 134, the interface device 135, the storage device 140, etc., and controls the components. The processing circuit 150 performs drive control of the first motor 131, imaging control of the imaging device 122, etc., based on each medium signal received from each sensor, acquires an input image from the imaging device 122, and transmits the acquired image to the information processing apparatus through the interface device 135.

Figure 7:
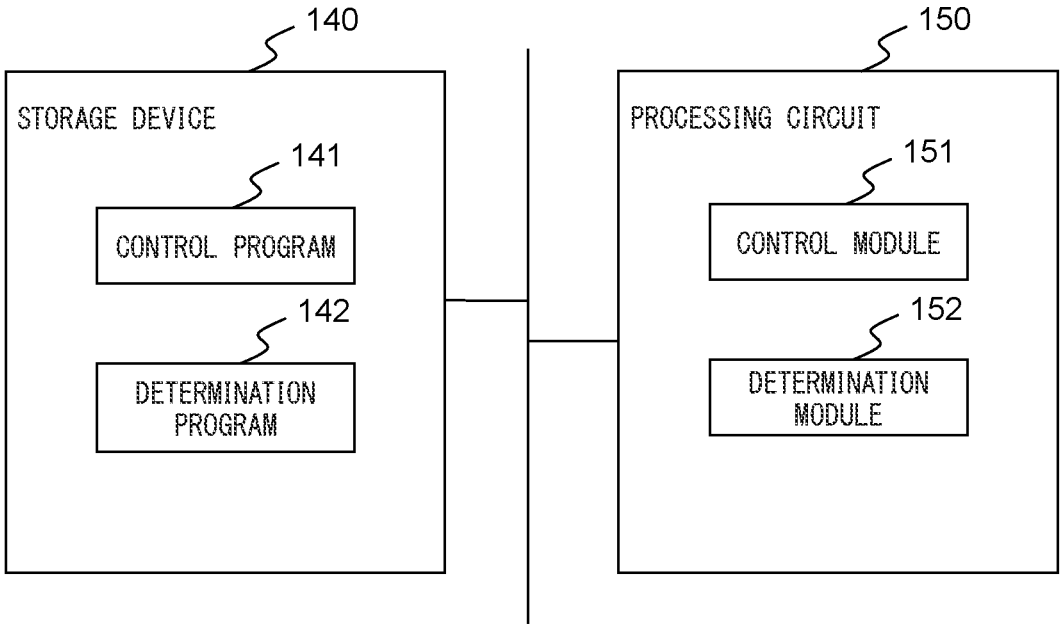
FIG. 7 is a diagram illustrating a schematic configuration of an example of a storage device and a processing circuit.

FIG. 7 is a diagram illustrating a schematic configuration of an example of a storage device and a processing circuit.

As illustrated in FIG. 7, a control program 141, a determination program 142, etc., are stored in the storage device 140. Each program is a functional module implemented by software operating on the processor. The processing circuit 150 reads each program stored in the storage device 140 and operates in accordance with the read program. Consequently, the processing circuit 150 functions as a control module 151, and a determination module.

Figure 8:
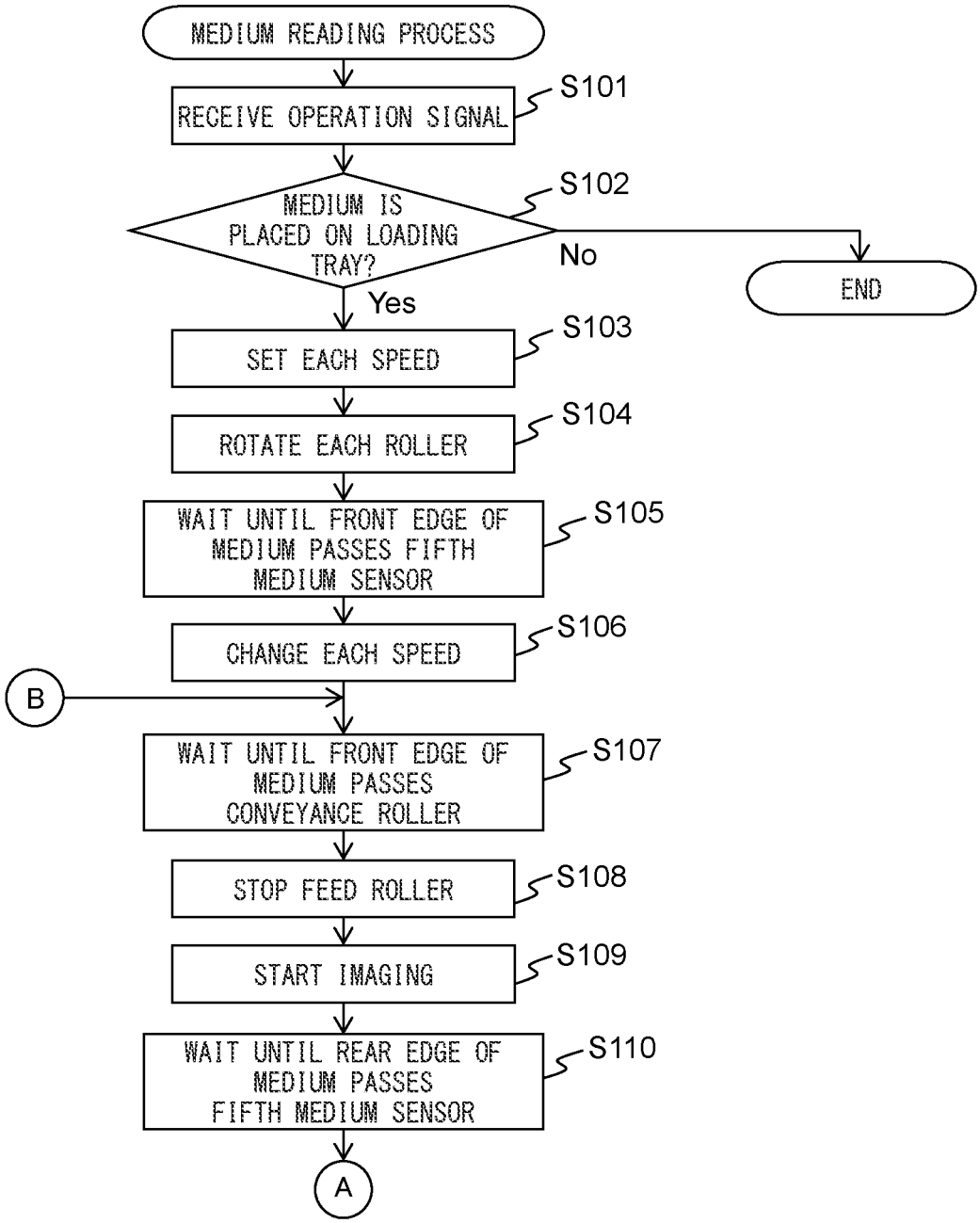
FIG. 8 is a flowchart illustrating an operation example of medium reading processing.
Figure 9:
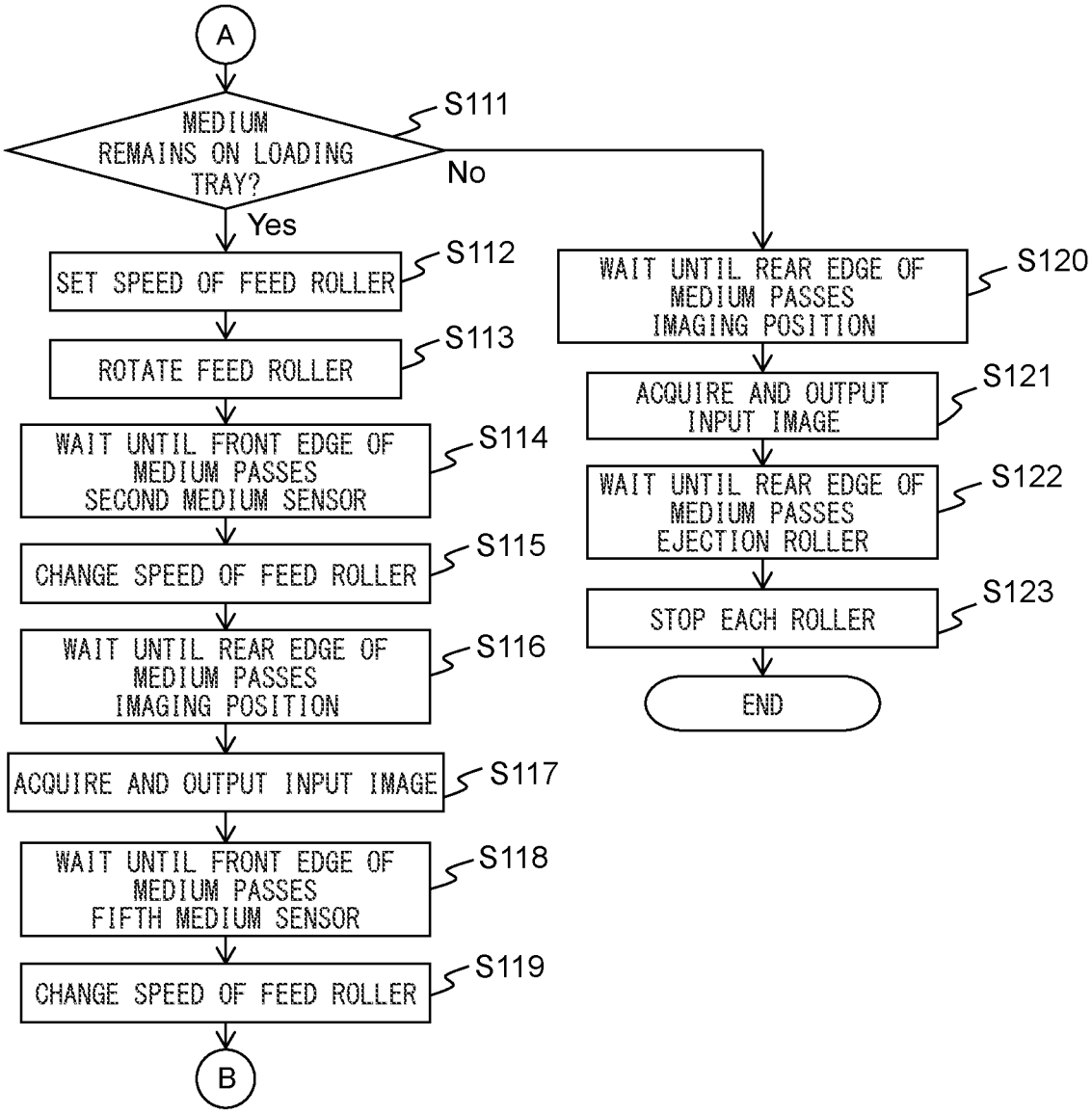
FIG. 9 is a flowchart illustrating an operation example of the medium reading processing.

FIG. 8 and FIG. 9 are flowcharts illustrating an operation example of medium reading processing in a medium conveying apparatus.

The operation example of the medium reading process in the medium conveying apparatus 100 will be described below referring to the flowchart illustrated in FIG. 8 and FIG. 9. The operation flow described below is executed mainly by the processing circuit 150 in accordance with a program previously stored in the storage device 140 in cooperation with the components in the medium conveying apparatus 100.

First, the control module 151 waits until an instruction to read a medium is input by a user by using the operation device 105 or the information processing apparatus and an operation signal providing an instruction to read a medium is received from the operation device 105 or the interface device 132 (step S101).

Next, the control module 151 acquires the first medium signal from the first medium sensor 111 and determines whether a medium is placed on the loading tray 103, based on the acquired first medium signal (step S102). When a medium is not placed on the loading tray 103, the control module 151 ends the series of steps.

When a medium is placed on the loading tray 103, the control module 151 sets surface moving speeds of the feed roller 112, the brake roller 113, the conveyance roller 119, the first facing roller 120, the ejection roller 123, and/or the second facing roller 124 (step S103). The surface moving speed is the speed at which a surface of each roller in contact with a medium moves. In other words, the surface moving speed of each of the feed roller 112, the conveyance roller 119, the first facing roller 120, the ejection roller 123, and/or the second facing roller 124 is the medium conveyance speed of each of the feed roller 112, the conveyance roller 119, and the ejection roller 123. The surface moving speed of the brake roller 113 is the speed at which a surface of the brake roller 113 in contact with a medium moves in a direction opposite to the medium feeding direction. The surface moving speed of each roller may be hereinafter simply referred to as speed.

The medium conveying apparatus 100 has a high-speed mode, a medium-speed mode, and a low-speed mode as conveyance modes of conveying a medium. The conveyance mode is set by a user by using the operation device 105 or the information processing apparatus, before medium reading process is executed.

Figure 10:
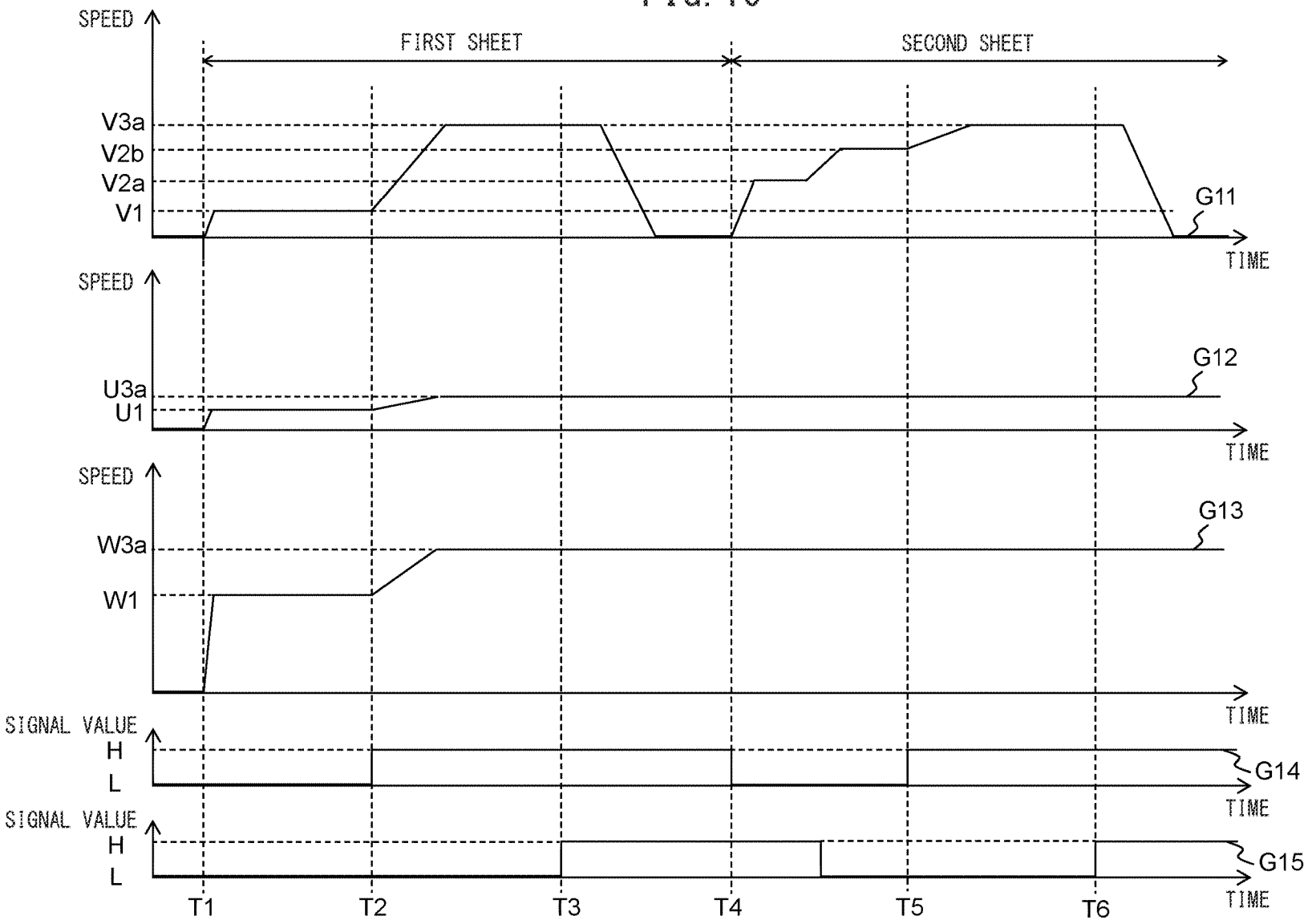
FIG. 10 is a graph for illustrating changes in the speeds of rollers.
Figure 11:
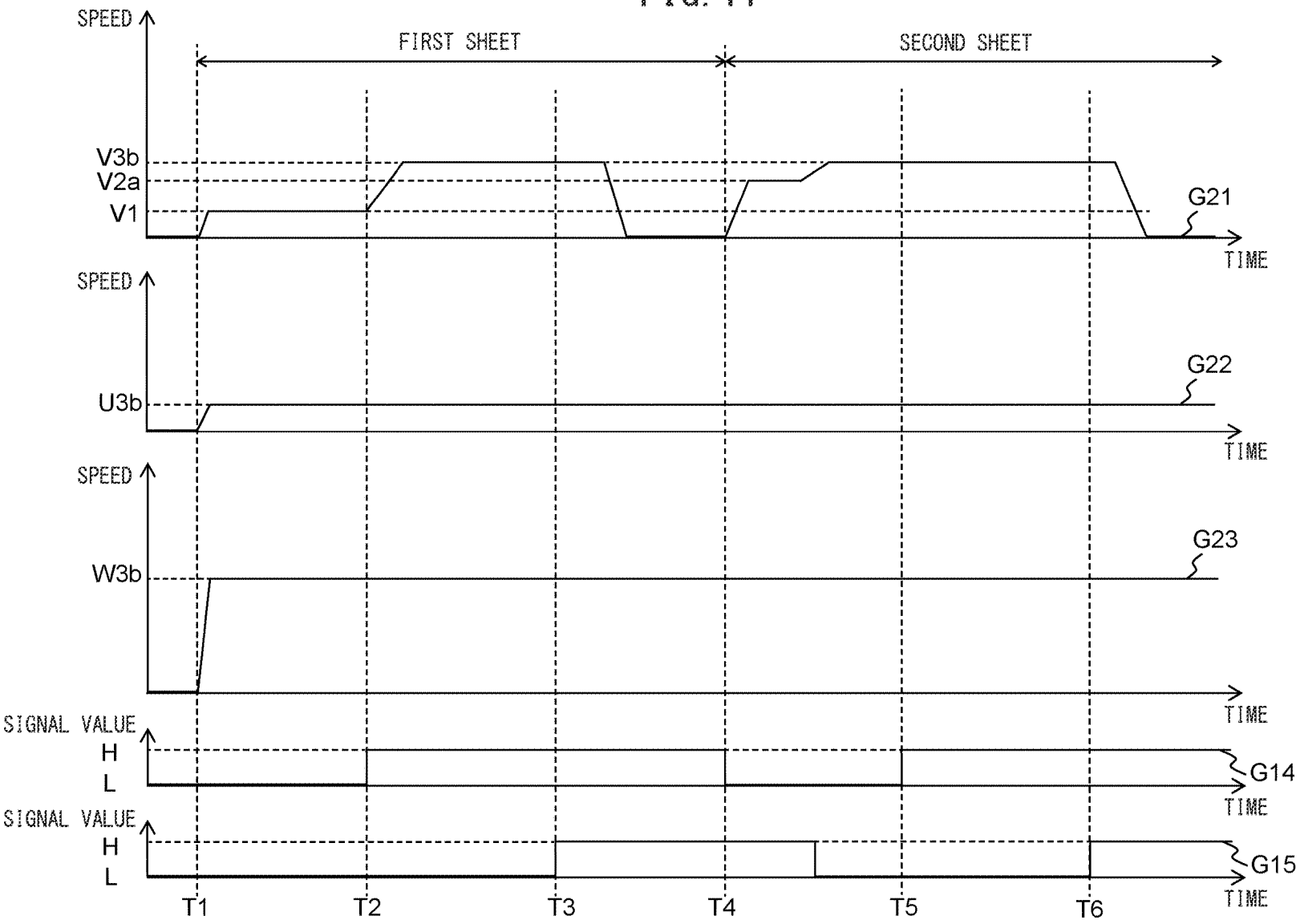
FIG. 11 is a graph for illustrating changes in the speeds of the rollers.
Figure 12:
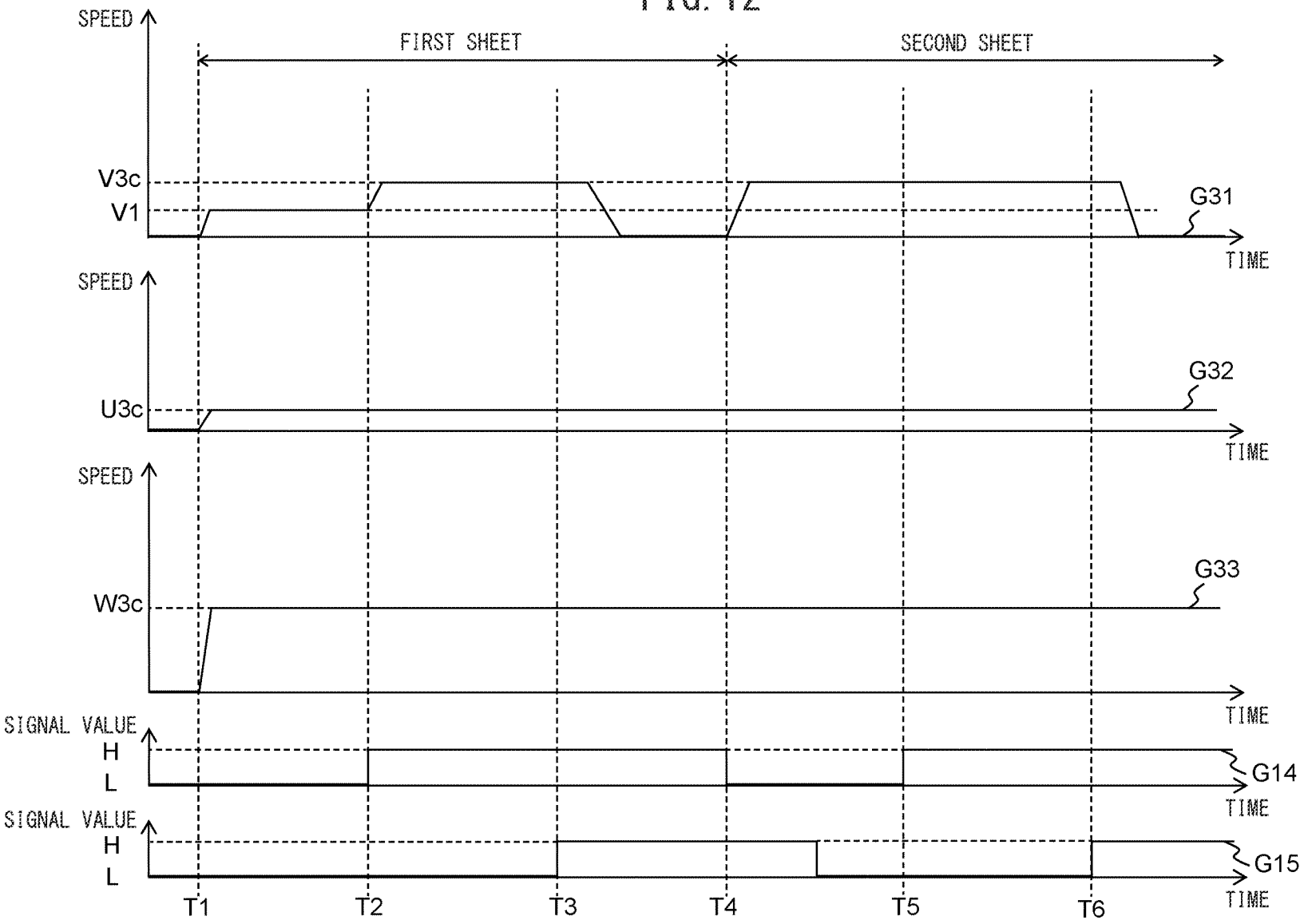
FIG. 12 is a graph for illustrating changes in the speeds of the rollers.

FIG. 10 to FIG. 12 are graphs for illustrating changes in the speeds of the feed roller 112, the brake roller 113, the conveyance roller 119, the first facing roller 120, the ejection roller 123, and the second facing roller 124. FIG. 10 illustrates changes in the speed of each roller in the high-speed mode, FIG. 11 illustrates changes in the speed of each roller in the medium-speed mode, and FIG. 12 illustrates changes in the speed of each roller in the low-speed mode.

In FIG. 10 to FIG. 12, graphs G11, G21, and G31 illustrate changes in the speed of the feed roller 112, graphs G12, G22, and G32 illustrate changes in the speed of the brake roller 113, and graphs G13, G23, and G33 illustrate changes in the speed of the conveyance roller 119. Since the speeds of the first facing roller 120, the ejection roller 123, and the second facing roller 124 change similarly to the speed of the conveyance roller 119, changes in the speed of the conveyance roller 119 will be representatively described below. In each of the graphs G11 to G13, G21 to G23, and G31 to G33, the horizontal axis indicates time, and the vertical axis indicates speed.

A graph G14 illustrates changes in the signal value of the fifth medium sensor 118, and a graph G15 illustrates changes in the signal value of the sixth medium sensor 121. In each of the graphs G14 and G15, the horizontal axis indicates time, and the vertical axis indicates the signal value. According to the present embodiment, when a medium does not exist at the position of each sensor, the signal value of a related signal takes on L, and when a medium exists at the position of each sensor, the signal value of a related signal takes on H.

In FIG. 10 to FIG. 12, a time T1 denotes the time when medium feeding is started. As illustrated in FIG. 10 to FIG. 12, the control module 151 sets the speed of the feed roller 112 to an initial speed V1 at the start of medium feeding when the conveyance mode is set to any of the high-speed mode, the medium-speed mode, and the low-speed mode. When the conveyance mode is set to the high-speed mode, the control module 151 sets the speed of the brake roller 113 to an initial speed U1 and sets the speed of the conveyance roller 119 to an initial speed W1. The initial speed U1 of the brake roller 113 is set to a speed higher than ½ of the initial speed V1 of the feed roller 112. Furthermore, the initial speed U1 of the brake roller 113 may be set to a speed lower than the initial speed V1 of the feed roller 112.

When the conveyance mode is set to the medium-speed mode, the control module 151 sets the speed of the brake roller 113 to a final speed U3*b* and sets the speed of the conveyance roller 119 to a final speed W3*b*. The final speed U3*b* of the brake roller 113 is set to a speed lower (slower) than a final speed U3*a* of the brake roller 113 in the high-speed mode described later. The final speed W3*b* of the conveyance roller 119 is set to a speed lower than a final speed W3*a* of the conveyance roller 119 in the high-speed mode described later. When the conveyance mode is set to the low-speed mode, the control module 151 sets the speed of the brake roller 113 to a final speed U3*c* and sets the speed of the conveyance roller 119 to a final speed W3*c*. The final speed U3*c* of the brake roller 113 is set to a speed lower than the final speed U3*b* of the brake roller 113 in the medium-speed mode. The final speed W3*c* of the conveyance roller 119 is set to a speed lower than the final speed W3*b* of the conveyance roller 119 in the medium-speed mode.

Next, the control module 151 drives the first motor 131 and the second motor 132. Consequently, the control module 151 rotates the feed roller 112, the brake roller 113, the conveyance roller 119, the first facing roller 120, the ejection roller 123, and/or the second facing roller 124 to feed and convey a medium (step S104).

The control module 151 controls the first motor 131 and the second motor 132 to rotate each roller at the set speed. As illustrated in FIG. 10 to FIG. 12, each roller rotates at the set speed after an elapse of a predetermined through-up period from the start of drive of each motor at the time T1. When the control module 151 increases the speed of the roller, each roller rotates at the set speed after an elapse of the predetermined through-up period from the change of the speed of each motor. Further, when the control module 151 reduces the speed of the roller, each roller rotates at the set speed after an elapse of the predetermined through-down period from the change of the speed of each motor.

Next, the control module 151 waits until the front edge of the conveyed medium passes the position of the fifth medium sensor 118 (step S105). The control module 151 periodically acquires a fifth medium signal from the fifth medium sensor 118, and determines that the front edge of the medium has passed the position of the fifth medium sensor 118 when the signal value of the fifth medium signal changes from a value indicating that a medium does not exist to a value indicating that a medium exists.

Next, the control module 151 changes the speeds of the feed roller 112 and the brake roller 113 (step S106).

In FIG. 10 to FIG. 12, a time T2 denotes the time when the signal value of the fifth medium signal has changed from L to H, i.e., when the front edge of the medium has passed the position of the fifth medium sensor 118. As illustrated in FIG. 10 to FIG. 12, the speed to which the feed roller 112 is changed when the front edge of the medium passes the position of the fifth medium sensor 118 varies depending on the conveyance mode.

When the conveyance mode is set to the high-speed mode, the control module 151 changes the speed of the feed roller 112 to a final speed V3*a*. The final speed V3*a* of the feed roller 112 is set to a speed higher than the initial speed V1 of the feed roller 112 and lower than or equal to the final speed W3*a* of the conveyance roller 119 described later. The final speed V3*a* of the feed roller 112 may be set to a speed identical to the final speed W3*a* of the conveyance roller 119. When the conveyance mode is set to the medium-speed mode, the control module 151 changes the speed of the feed roller 112 to a final speed V3*b*. The final speed V3*b* of the feed roller 112 in the medium-speed mode is set to a speed higher than the initial speed V1 and lower than the final speed V3*a* in the high-speed mode. When the conveyance mode is set to the low-speed mode, the control module 151 changes the speed of the feed roller 112 to a final speed V3*c*. The final speed V3*c* of the feed roller 112 in the low-speed mode is set to a speed higher than the initial speed V1 and lower than the final speed V3*b* in the medium-speed mode.

When the conveyance mode is set to the high-speed mode, the control module 151 changes the speed of the brake roller 113 to the final speed U3*a* and changes the speed of the conveyance roller 119 to the final speed W3*a*. The final speed U3*a* of the brake roller 113 is set to a speed higher than the initial speed U1 of the brake roller 113. The final speed W3*a* of the conveyance roller 119 is set to a speed higher than the initial speed W1 of the conveyance roller 119. When the conveyance mode is set to the medium-speed mode, the speeds of the brake roller 113 and the conveyance roller 119 are already set to the final speeds U3*b* and W3*b*, and therefore the control module 151 does not change the speeds of the brake roller 113 and the conveyance roller 119. Similarly, when the conveyance mode is set to the low-speed mode, the speeds of the brake roller 113 and the conveyance roller 119 are already set to the final speeds U3*c* and W3*c*, and therefore the control module 151 does not change the speeds of the brake roller 113 and the conveyance roller 119.

Next, the control module 151 waits until the front edge of the conveyed medium passes the position of the conveyance roller 119 (step S107). The control module 151 periodically acquires a sixth medium signal from the sixth medium sensor 121 and determines that the front edge of the medium has passed the position of the sixth medium sensor 121 when the signal value of the sixth medium signal changes from a value indicating that a medium does not exist to a value indicating that a medium exists. The control module 151 determines that the front edge of the medium has passed the position of the conveyance roller 119 when the front edge of the medium passes the position of the sixth medium sensor 121.

Next, the control module 151 controls the first motor 131 to stop the feed roller 112 (step S108).

In FIG. 10 to FIG. 12, a time T3 denotes the time when the signal value of the sixth medium signal has changed from L to H, i.e., when the front edge of the medium has passed the position of the sixth medium sensor 121. As illustrated in FIG. 10 to FIG. 12, after the front edge of the medium passes the position of the sixth medium sensor 121, the control module 151 stops the feed roller 112 (change the speed to 0). Consequently, from this point, the medium is conveyed by the conveyance roller 119, and the feed roller 112 is rotated by the medium being conveyed. By stopping the feed roller 112, the control module 151 can suppress occurrence of jamming of the medium due to the medium being pushed by the feed roller 112 and being bent between the feed roller 112 and the conveyance roller 119.

Next, the control module 151 causes the imaging device 122 to start imaging of the medium (step S109).

Next, the control module 151 waits until the rear edge of the conveyed medium passes the position of the fifth medium sensor 118 (step S110). The control module 151 periodically acquires the fifth medium signal from the fifth medium sensor 118, and determines that the rear edge of the medium has passed the position of the fifth medium sensor 118 when the signal value of the fifth medium signal changes from a value indicating that a medium exists to a value indicating that a medium does not exist.

Next, the control module 151 determines whether a medium remains on the loading tray 103, based on the first medium signal received from the first medium sensor 111 (step S111).

When a medium remains on the loading tray 103, the control module 151 sets the speed of the feed roller 112 for feeding a succeeding medium (step S112).

In FIG. 10 to FIG. 12, a time T4 denotes the time when the signal value of the fifth medium signal has changed from H to L, i.e., when the rear edge of the medium has passed the position of the fifth medium sensor 118. As illustrated in FIG. 10 to FIG. 12, the speed to which the feed roller 112 is set for feeding a succeeding medium when the rear edge of the medium passes the position of the fifth medium sensor 118 varies depending on the conveyance mode. When the conveyance mode is set to the high-speed mode or the medium-speed mode, the control module 151 sets the speed of the feed roller 112 to a first intermediate speed V2*a*. The first intermediate speed V2*a* is an example of a first speed and is set to a speed higher than the initial speed V1 and lower than the final speed V3*a* and the final speed V3*b*. The first speed is the speed of the feed roller 112 in a first step when a second or subsequent medium is fed. The first intermediate speed V2*a* may be set to a speed almost identical to the final speed V3*c*. When the conveyance mode is set to the low-speed mode, the control module 151 sets the speed of the feed roller 112 to the final speed V3*c*.

Next, by driving the first motor 131, the control module 151 rotates the feed roller 112 to feed and convey the succeeding medium (step S113). The control module 151 controls the first motor 131 in such a way that the feed roller 112 rotates at a set speed.

Next, the control module 151 waits until the front edge of the succeeding medium passes the position of the second medium sensor 114 (step S114). The control module 151 periodically acquires the second medium signal from the second medium sensor 114, and determines that the front edge of the medium has passed the position of the second medium sensor 114 when the signal value of the second medium signal changes from a value indicating that a medium does not exist to a value indicating that a medium exists.

Next, the control module 151 changes the speed of the feed roller 112 (step S115).

As illustrated in FIG. 10 to FIG. 12, the speed to which the feed roller 112 is changed when the front edge of the succeeding medium passes the position of the second medium sensor 114 varies depending on the conveyance mode. When the conveyance mode is set to the high-speed mode, the control module 151 changes the speed of the feed roller 112 to a second intermediate speed V2*b*. The second intermediate speed V2*b* is an example of a second speed and is set to a speed higher than the first intermediate speed V2*a* and lower than the final speed V3*a*. The second speed is the speed of the feed roller 112 in a second step when a second or subsequent medium is fed. The second intermediate speed V2*b* may be set to a value almost identical to the final speed V3*b*. When the conveyance mode is set to the medium-speed mode, the control module 151 changes the speed of the feed roller 112 to the final speed V3*b*. When the conveyance mode is set to the low-speed mode, the control module 151 does not change the speed of the feed roller 112.

Next, the control module 151 waits until the rear edge of the preceding medium passes the imaging position of the imaging device 122 (step S116). The control module 151 periodically acquires the sixth medium signal from the sixth medium sensor 121, and determines that the rear edge of the preceding medium has passed the position of the sixth medium sensor 121 when the signal value of the sixth medium signal changes from a value indicating that a medium exists to a value indicating that a medium does not exist. The control module 151 determines that the rear edge of the preceding medium has passed the imaging position when a first predetermined time elapses after the rear edge of the preceding medium passes the position of the sixth medium sensor 121. The first predetermined time is set to a value acquired by adding a margin to the time required for a medium to move from the position of the sixth medium sensor 121 to the imaging position.

Next, the control module 151 acquires an input image from the imaging device 122 and stores the acquired input image into the storage device 140. The control module 151 outputs the input image stored in the storage device 140 by transmitting the image to the information processing apparatus through the interface device 135 and deletes the image from the storage device 140 (step S117).

Next, the control module 151 waits until the front edge of the succeeding medium passes the position of the fifth medium sensor 118, similarly to the processing in step S105 (step S118).

Next, the control module 151 changes the speed of the feed roller 112 (step S119).

In FIG. 10 to FIG. 12, a time T5 denotes the time when the signal value of the fifth medium signal has changed from L to H, i.e., when the front edge of the succeeding medium has passed the position of the fifth medium sensor 118. As illustrated in FIG. 10 to FIG. 12, when the conveyance mode is set to the high-speed mode, the control module 151 changes the speed of the feed roller 112 to the final speed V3*a* when the front edge of the succeeding medium has passed the position of the fifth medium sensor 118. When the conveyance mode is set to the medium-speed mode or the low-speed mode, the control module 151 does not change the speed of the feed roller 112.

Next, the control module 151 returns the processing to step S107 and repeats the processing in and after step S107 on the succeeding medium. In this case, the control module 151 waits until the front edge of the succeeding medium passes the position of the conveyance roller 119 (a time T6 in FIG. 10) in step S107 and controls the first motor 131 to stop the feed roller 112 in step S108.

When a medium does not remain on the loading tray 103 in step S111, the control module 151 waits until the rear edge of the conveyed medium passes the imaging position of the imaging device 122, similarly to the processing in step S116 (step S120).

Next, the control module 151 acquires an input image from the imaging device 122 and outputs the acquired input image by transmitting the image to the information processing apparatus through the interface device 135 (step S121).

Next, the control module 151 waits until the rear edge of the conveyed medium passes the position of the ejection roller 123 (step S122). The control module 151 determines that the rear edge of the medium has passed the position of the ejection roller 123 when a second predetermined time elapses after the rear edge of the medium passes the position of the sixth medium sensor 121. The second predetermined time is set to a value acquired by adding a margin to the time required for the medium to move from the position of the sixth medium sensor 121 to the position of the ejection roller 123.

Next, the control module 151 controls the second motor 132 to stop the brake roller 113, the conveyance roller 119, the first facing roller 120, the ejection roller 123, and/or the second facing roller 124 (step S123) and ends the series of steps.

The control module 151 may execute the processing of step S118 and after at step S117 even when transmission of the input image is not completed. In that case, the control module 151 may temporarily stop feeding of the succeeding medium in step S118 in a case of free space in the storage device 140 being less than a predetermined amount when the front edge of the succeeding medium passes the position of the fifth medium sensor 118. The control module 151 controls the first motor 131 to stop the feed roller 112 until the free space in the storage device 140 becomes greater than or equal to the predetermined amount. Consequently, the medium conveying apparatus 100 can efficiently convey a medium while reliably transmitting an input image.

The control module 151 may temporarily stop feeding of the succeeding medium in step S118 in a case of the distance between the rear edge of the preceding medium and the front edge of the succeeding medium being short when the front edge of the succeeding medium passes the position of the fifth medium sensor 118. For example, the control module 151 detects the time elapsed from when the rear edge of the preceding medium passes the position of the fifth medium sensor 118 or the sixth medium sensor 121 until the front edge of the succeeding medium passes the position of the fifth medium sensor 118. When the measured time is less than a third predetermined time, the control module 151 controls the first motor 131 to stop the feed roller 112 until the third predetermined time elapses after the rear edge of the preceding medium passes the position of the fifth medium sensor 118 or the sixth medium sensor 121. Consequently, the medium conveying apparatus 100 can efficiently convey a medium while suppressing occurrence of jamming of the medium.

Figure 13A:
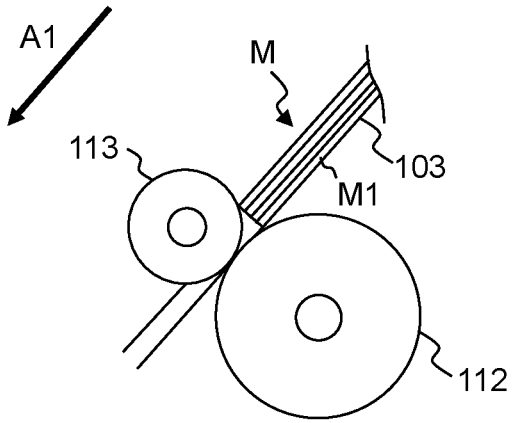
FIG. 13A is a schematic diagram for illustrating technical significance.
Figure 13B:
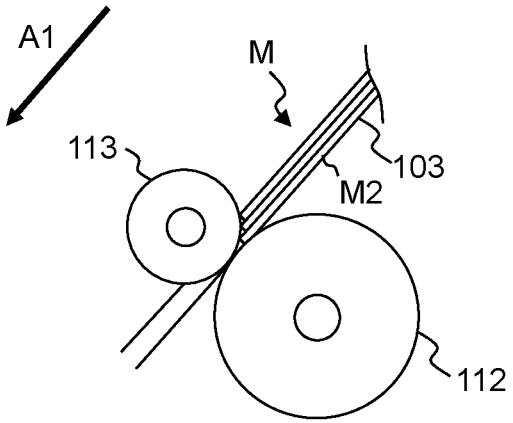
FIG. 13B is a schematic diagram for illustrating technical significance.

FIG. 13A and FIG. 13B are schematic diagrams for illustrating technical significance of feeding a medium in accordance with the medium reading process illustrated in FIG. 8 and FIG. 9.

FIG. 13A and FIG. 13B are schematic diagrams of the feed roller 112 and the brake roller 113 viewed from the side. FIG. 13A illustrates a situation in which a first medium M1 is fed in a state of a medium group M being placed on the loading tray 103, and FIG. 13B illustrates a situation in which a second or subsequent medium M2 is fed in a state of the medium group M being placed on the loading tray 103.

As illustrated in the FIG. 13A, when a certain amount of medium group M is placed on the loading tray 103, the front edge of the medium group M is normally aligned by a user or an alignment member. Therefore, the front edge of the first medium M1 placed at the bottom has not arrived at the nip region of the feed roller 112 and the brake roller 113. In this case, the frictional force between media is increased by the weight of the medium group placed on the first medium M1. The medium group placed on the first medium M1 tends to move to the downstream side with the first medium M1 being fed by the frictional force and is pressed to the brake roller 113. When the speed of the feed roller 112 at this time is excessively high, multi feed of media may occur due to the brake roller 113 lifted upward by the medium group placed on the first medium M1 and the medium group entering between the feed roller 112 and the brake roller 113.

When the speed of the feed roller 112 at this time is excessively high, jamming of a medium may occur due to a lift of the front edge of the first medium M1 before arriving at the nip region of the feed roller 112 and the brake roller 113, and buckling of the medium M1.

As described in steps S103 to S105 in FIG. 8, when feeding the first medium of media placed on the loading tray 103, the control module 151 controls the first motor 131 to rotate the feed roller 112 at a constant speed in a separation period from the start of medium feeding by the feed roller 112 to detection of the front edge of the medium by the fifth medium sensor 118. The separation period when the first medium is fed is a period from the time T1 to the time T2 in FIG. 10 to FIG. 12. In particular, when feeding the first medium, the control module 151 controls the first motor 131 to rotate the feed roller 112 at the initial speed V1 lower than the first intermediate speed V2*a* at which a second or subsequent medium is fed. By reducing the speed of the feed roller 112 in the separation period of the first medium, the control module 151 can suppress occurrence of multi feed of media or jamming of a medium.

As illustrated in the FIG. 13B, when the first medium M1 is fed, each second or subsequent medium M2 is separated by the brake roller 113, and the front edge of the medium M2 is in a state of being in contact with the brake roller 113. Similarly to the case of the first medium M1 being fed, when the speed of the feed roller 112 is excessively high, multi feed of media or jamming of a medium may occur when each second or subsequent medium M2 is fed as well. However, the possibility of occurrence of multi feed of medium or jamming of a medium when each second or subsequent medium M2 is fed is less compared with the case of the first medium M1 being fed. When the feeding speed of each second or subsequent medium M2 in the separation period is excessively low, a considerable time is required for conveyance of all media to be completed. However, if the speed of the feed roller 112 at a standstill is sharply increased when feeding each second or subsequent medium M2, step out of the first motor 131 may occur.

As described in steps S112 to S115 and S118 in FIG. 9, in a case where the conveyance mode is set to the high-speed mode, when feeding a second or subsequent medium, in the separation period, the control module 151 controls the first motor 131 to rotate the feed roller 112 at the first intermediate speed V2*a* and the second intermediate speed V2*b* that are higher than the initial speed V1 at which the first medium is fed. The separation period when a second or subsequent medium is fed is a period from the time T4 to the time T5 in FIG. 10 to FIG. 12. In particular, when feeding a second or subsequent medium of media placed on the loading tray 103, the control module 151 controls the first motor 131 to rotate the feed roller 112 at the first intermediate speed V2*a* and then at the second intermediate speed V2*b*. Thus, the control module 151 increases the speed of the feed roller 112 in the separation period of the second or subsequent medium stepwise to speeds higher than the speed in the separation period of the first medium while reducing the speed in the separation period of the second or subsequent medium. Consequently, the control module 151 can reduce the processing time required for the medium reading process while suppressing occurrence of multi feed of media or jamming of a medium, and step out of the first motor 131; and higher feeding performance (reduction in occurrence of an abnormality) and higher processing performance (reduction in the conveyance time) can be simultaneously achieved.

Figure 14:
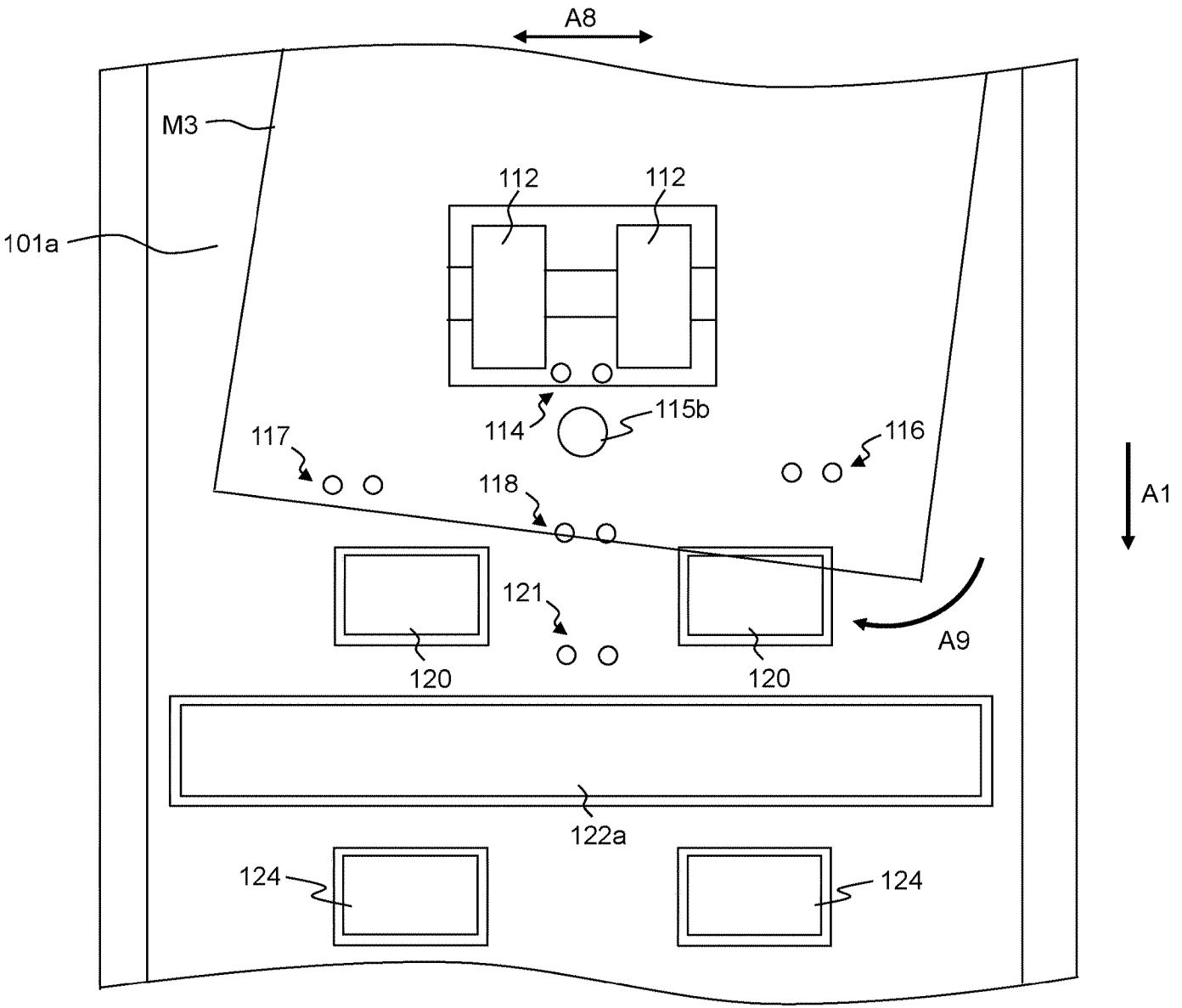
FIG. 14 is a schematic diagram for illustrating technical significance.

FIG. 14 is a schematic diagram for illustrating technical significance of feeding a medium in accordance with the medium reading process illustrated in FIG. 8 and FIG. 9. FIG. 14 is a schematic diagram of the lower guide 101*a* of the lower housing 101 viewed from above.

FIG. 14 illustrates a state in which the front edge of a medium M3 conveyed in a tilted manner is in contact with either one of the two conveyance rollers 119 (first facing rollers 120). When the speed of the conveyance rollers 119 is almost identical to the speed of the feed rollers 112, the medium M3 is subsequently conveyed to the downstream side while maintaining the current tilt. However, when the speed of the conveyance rollers 119 is higher than the speed of the feed rollers 112, the medium M3 is subsequently pulled by the conveyance roller 119 on the contacting side and rotates in a direction of an arrow A9. Accordingly, jamming of the medium may occur due to an increase in the tilt of the medium M3 and collision of the medium M3 with a side wall of the conveyance path. As the difference between the speed of the conveyance rollers 119 and the speed of the feed rollers 112 increases, the possibility of occurrence of jamming of a medium increases.

As described above, the control module 151 may temporarily stop medium feeding in a case of free space in the storage device 140 being insufficient or the distance between media being short when the front edge of the medium passes the position of the fifth medium sensor 118. However, when the control module 151 temporarily stops medium feeding, it takes a certain through-up period after medium feeding is subsequently resumed until the speed of the feed roller 112 arrives at a set speed. When the speed of the feed roller 112 is not sufficiently increased at the point in time when the front edge of the medium arrives at the position of the conveyance roller 119, a skew of the medium may occur. Therefore, when temporarily stopping medium feeding, the control module 151 needs to stop the medium at a position on a sufficiently upstream side of the conveyance roller 119. However, it takes a certain through-down period after the control module 151 stops the first motor 131 until rotation of the feed roller 112 completely stops. For example, the aforementioned issue can be avoided by sufficiently increasing the distance between the feed roller 112 and the conveyance roller 119; however, in that case, the size of the entire device increases.

As described in steps S106 and S119 in FIG. 8 and FIG. 9, in the high-speed mode, the control module 151 controls the first motor 131 to rotate the feed roller 112 at the final speed V3*a* higher than the second intermediate speed V2*b* after the fifth medium sensor 118 detects the front edge of a medium. Therefore, the speed of the feed roller 112 is set to the second intermediate speed V2*b* lower than the final speed V3*a* at the point in time when the front edge of the medium passes the position of the fifth medium sensor 118, and the control module 151 can completely stop rotation of the feed roller 112 in a sufficiently short period. In the medium-speed mode and the low-speed mode, the speed of the feed roller 112 is set to the final speed V3*b* and the final speed V3*c*, respectively, at the point in time when the front edge of the medium passes the position of the fifth medium sensor 118. However, since the final speed V3*b* and the final speed V3*c* are lower than the final speed V3*a*, the control module 151 can completely stop rotation of the feed roller 112 in a sufficiently short period.

Accordingly, when temporarily stopping medium feeding, the control module 151 can stop the medium at a position on a sufficiently upstream side of the conveyance roller 119. Consequently, when resuming medium feeding, the control module 151 can sufficiently increase the speed of the feed roller 112 before the front edge of the medium arrives at the position of the conveyance roller 119 and can suppress an increase in the tilt of the medium and suppress occurrence of jamming of the medium.

As described in steps S114 and S115 in FIG. 9, in a case of feeding a second or subsequent medium, when the second medium sensor 114 detects the front edge of the medium in the separation period, the control module 151 controls the first motor 131 to rotate the feed roller 112 at the second intermediate speed V2*b*. After the front edge of the medium passes the position of the second medium sensor 114, i.e., after the front edge passes the nip region of the feed roller 112 and the brake roller 113, a lift of the front edge of the medium due to collision with the brake roller 113 does not occur. Therefore, the possibility of occurrence of jamming of the medium due to buckling of the medium is low. The control module 151 determines that the front edge of the medium has passed the nip region of the feed roller 112 and the brake roller 113 when the second medium sensor 114 detects the front edge of the medium and increases the speed of the feed roller 112. Consequently, the control module 151 can reduce the medium feeding time while suppressing occurrence of jamming of the medium.

In particular, by a decrease in the period in which the feed roller 112 rotates at the first intermediate speed V2*a* and an increase in the period in which the feed roller 112 rotates at the second intermediate speed V2*b*, the medium feeding speed can be increased as a whole even when the second intermediate speed V2*b* is low. In other words, when temporarily stopping medium feeding as described above, the control module 151 can decrease the second intermediate speed V2*b*, and can stop the medium at a position on a sufficiently upstream side of the conveyance roller 119. In steps S114 and S115 in FIG. 9, the control module 151 may change the speed of the feed roller 112 when a fourth predetermined time elapses after the start of medium feeding instead of when the front edge of the medium passes the position of the second medium sensor 114. The fourth predetermined time is set to the time required for the front edge of the medium to pass the nip region of the feed roller 112 and the brake roller 113 after the start of medium feeding through a previously performed experiment. In that case, the second medium sensor 114 may be omitted. When the second medium sensor 114 is omitted, the fifth medium sensor 118 may be located at the position of the second medium sensor 114.

The control module 151 may increase the amount of current supplied to the first motor 131 and/or the second motor 132 in the through-up period of the first motor 131 and/or the second motor 132. Consequently, step out of each motor is less likely to occur even when the speed of the motor is increased in a short period, and the distance required for through-up can be reduced. Further, by limiting the period in which the amount of current is increased to the through-up period, the medium conveying apparatus 100 can suppress an increase in the amount of power consumption as a whole.

As illustrated in FIG. 13B, a medium entering the nip region of the feed roller 112 and the brake roller 113 is pushed back by the brake roller 113 rotating in a direction opposite to the medium feeding direction. As the ratio of the speed of the brake roller 113 to the speed of the feed roller 112 increases, the medium is more satisfactorily pushed back. In particular, as illustrated in FIG. 13A, when feeding of the first medium M1 starts, the front edge of each medium placed above the first medium M1 has not arrived at the nip region of the feed roller 112 and the brake roller 113. Therefore, when feeding of the first medium M1 starts, each medium enters the nip region of the feed roller 112 and the brake roller 113 with force. Accordingly, when the first medium M1 is fed, the ratio of the speed of the brake roller 113 to the speed of the feed roller 112 needs to be set to a somewhat large value such that other media are satisfactorily returned to the upstream side.

As illustrated in FIG. 13B, when a second or subsequent medium M2 is fed, the front edge of each medium M2 is already in contact with the brake roller 113. Accordingly, when a second or subsequent medium M2 is fed, a medium other than the medium being fed is satisfactorily pushed back even when the ratio of the speed of the brake roller 113 to the speed of the feed roller 112 is set to a somewhat small value.

As described above, the brake roller 113 is driven by the same second motor 132 as the conveyance roller 119 and the ejection roller 123. Consequently, the medium conveying apparatus 100 can achieve reduction in the apparatus cost and the apparatus size by reducing the number of motors. However, when the speed of the brake roller 113 is reduced, the speeds of the conveyance roller 119 and the ejection roller 123 are also reduced, and medium processing performance is deteriorated.

As the speed of the brake roller 113 increases, vibrations of the brake roller 113 increase and a loud vibration sound (so-called chattering sound) is generated. When feeding of a second or subsequent medium is started, the medium is in contact with the brake roller 113 and vibrations are suppressed; however, when feeding of the first medium M1 is started, the medium is not in contact with the brake roller 113 and vibrations are not suppressed. Accordingly, it is desirable to reduce the speed of the brake roller 113 particularly when feeding of the first medium M1 is started.

As described in steps S103 and S106 in FIG. 8, the control module 151 sets the rotation speed of the brake roller 113 in the separation period when the first medium of media placed on the loading tray 103 is fed to a speed lower than the rotation speed of the brake roller 113 in the separation period when a second or subsequent medium is fed. Consequently, the control module 151 can suppress vibrations of the brake roller 113 when the first medium is fed and suppress occurrence of a vibration sound. In the separation period, when the first medium is fed, the conveyance roller 119 has not conveyed the medium yet, and the medium conveyance time does not increase even when the rotation speed of the brake roller 113 is reduced. By increasing the rotation speed of the brake roller 113 in the separation period when a second or subsequent medium is fed, the control module 151 can keep the rotation speed of the conveyance roller 119 high. Accordingly, the medium conveying apparatus 100 can improve processing performance (reduction in the conveyance time) while suppressing an increase in the apparatus cost and the apparatus size.

As described in step S103 in FIG. 8, the control module 151 sets the speed of the feed roller 112 to the sufficiently low initial speed V1 and sets the initial speed U1 of the brake roller 113 to a speed higher than ½ of the initial speed V1 of the feed roller 112 at the start of medium feeding. In other words, the control module 151 sets the rotation speed of the brake roller 113 in such a way that the speed of the brake roller 113 in the separation period when the first medium of media placed on the loading tray 103 is fed is higher than ½ of the speed of the feed roller 112 in the separation period when the first medium is fed. Consequently, the brake roller 113 can satisfactorily push back a medium entering the nip region of the feed roller 112 and the brake roller 113 at the time of medium feeding.

As described in detail above, the medium conveying apparatus 100 increases the rotation speed of the feed roller 112 stepwise in a period from the start of medium feeding until the front edge of the medium passes the feed roller 112. Consequently, the medium conveying apparatus 100 can suitably control stoppage and resumption of medium feeding, for example, when free space in the storage device 140 is insufficient or when the distance between successively fed media is short, while reducing the medium feeding time. Accordingly, the medium conveying apparatus 100 can control medium feeding better.

In particular, the medium conveying apparatus 100 can control medium feeding better by devising control method of a motor without using a motor or a medium sensor with a special structure. Accordingly, the medium conveying apparatus 100 controls medium feeding better while suppressing an increase in the apparatus cost and the apparatus size.

By rotating the feed roller 112 at a low speed during medium separation and rotating the feed roller 112 at a high speed when medium separation is not performed, the medium conveying apparatus 100 can convey a medium in a short period while satisfactorily separating the medium.

Figure 15:
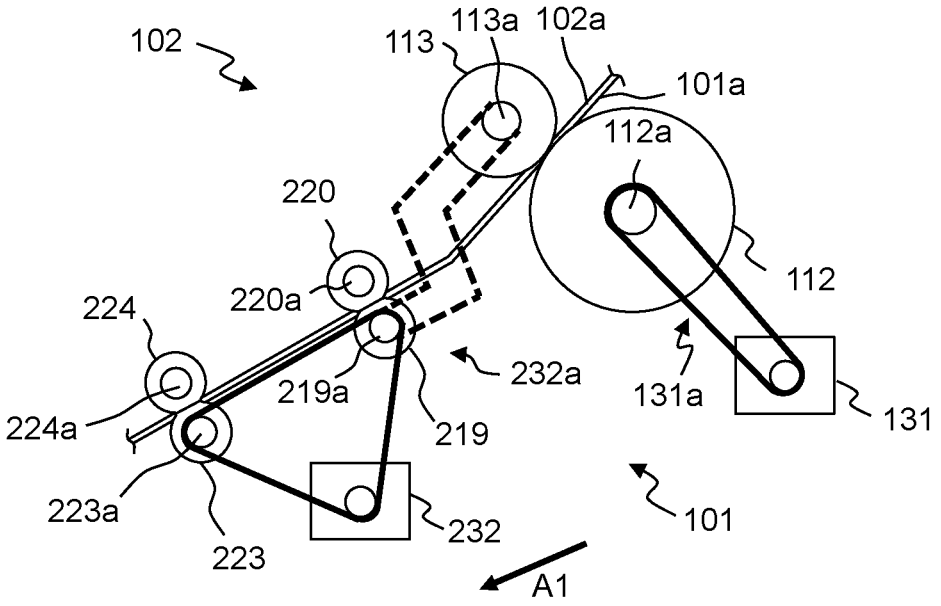
FIG. 15 is a schematic diagram for illustrating other examples of driving sources.

FIG. 15 is a schematic diagram for illustrating driving sources of a feed roller 112, a brake roller 113, a conveyance roller 219, a first facing roller 220, an ejection roller 223, and/or a second facing roller 224 in a medium conveying apparatus according to another embodiment.

As illustrated in FIG. 15, the medium conveying apparatus according to the present embodiment includes the conveyance roller 219, the first facing roller 220, the ejection roller 223, and the second facing roller 224 in place of the conveyance roller 119, the first facing roller 120, the ejection roller 123, and the second facing roller 124. Further, the medium conveying apparatus includes a second motor 232 in place of the second motor 132.

The conveyance roller 219 is provided in a lower housing 101, and the first facing roller 220 is provided on the upper side of the conveyance roller 219 in an upper housing 102. The ejection roller 223 is provided in the lower housing 101, and the second facing roller 224 is provided on the upper side of the ejection roller 223 in the upper housing 102.

The second motor 232 is provided in the lower housing 101 separately from a first motor 131, is connected to the conveyance roller 219, the ejection roller 223, and the brake roller 113 through a second transmission mechanism 232*a*, and drives the conveyance roller 219, the ejection roller 223, and the brake roller 113. The second motor 232 generates a driving force for driving the conveyance roller 219, the ejection roller 223, and the brake roller 113 in accordance with a control signal from a processing circuit 150. The second transmission mechanism 232*a* includes one or a plurality of pulleys, belts, gears, etc., provided between the second motor 232, and a shaft 219*a* of the conveyance roller 219, a shaft 223*a* of the ejection roller 223, and a shaft 113*a* of the brake roller 113. In particular, one or a plurality of gears for changing the rotation direction and the rotation speed of each roller are provided between the shaft 219*a* of the conveyance roller 219 and/or the shaft 223*a* of the ejection roller 223, and the shaft 113*a* of the brake roller 113. The gears are located outside a medium conveyance path in a width direction A8 to transmit the driving force with the medium conveyance path in between. The second transmission mechanism 232*a* transmits the driving force generated by the second motor 232 to the conveyance roller 219, the ejection roller 223, and the brake roller 113. Consequently, the second motor 232 causes the conveyance roller 219, the ejection roller 223, and the brake roller 113 to feed, convey, and eject a medium by rotating the conveyance roller 219, the ejection roller 223, and the brake roller 113. The second motor 232 is an example of a driving source of the brake roller 113.

The first facing roller 220 is a driven roller driven to rotate by the conveyance roller 219, and the second facing roller 224 is a driven roller driven to rotate by the ejection roller 223. The first facing roller 220 and/or the second facing roller 224 may be provided to be driven by the driving force from the second motor 232. In that case, one or a plurality of gears are further provided between the shaft 219*a* of the conveyance roller 219 and a shaft 220*a* of the first facing roller 220, and/or between the shaft 223*a* of the ejection roller 223 and a shaft 224*a* of the second facing roller 224. The second transmission mechanism 232*a* further transmits the driving force generated by the second motor 232 to the first facing roller 220 and/or the second facing roller 224.

As described in detail above, the medium conveying apparatus can control medium feeding better even when driving the conveyance roller 219 and the brake roller 113 by the same second motor 232 while providing the conveyance roller 219 in the lower housing 101.

Figure 16:
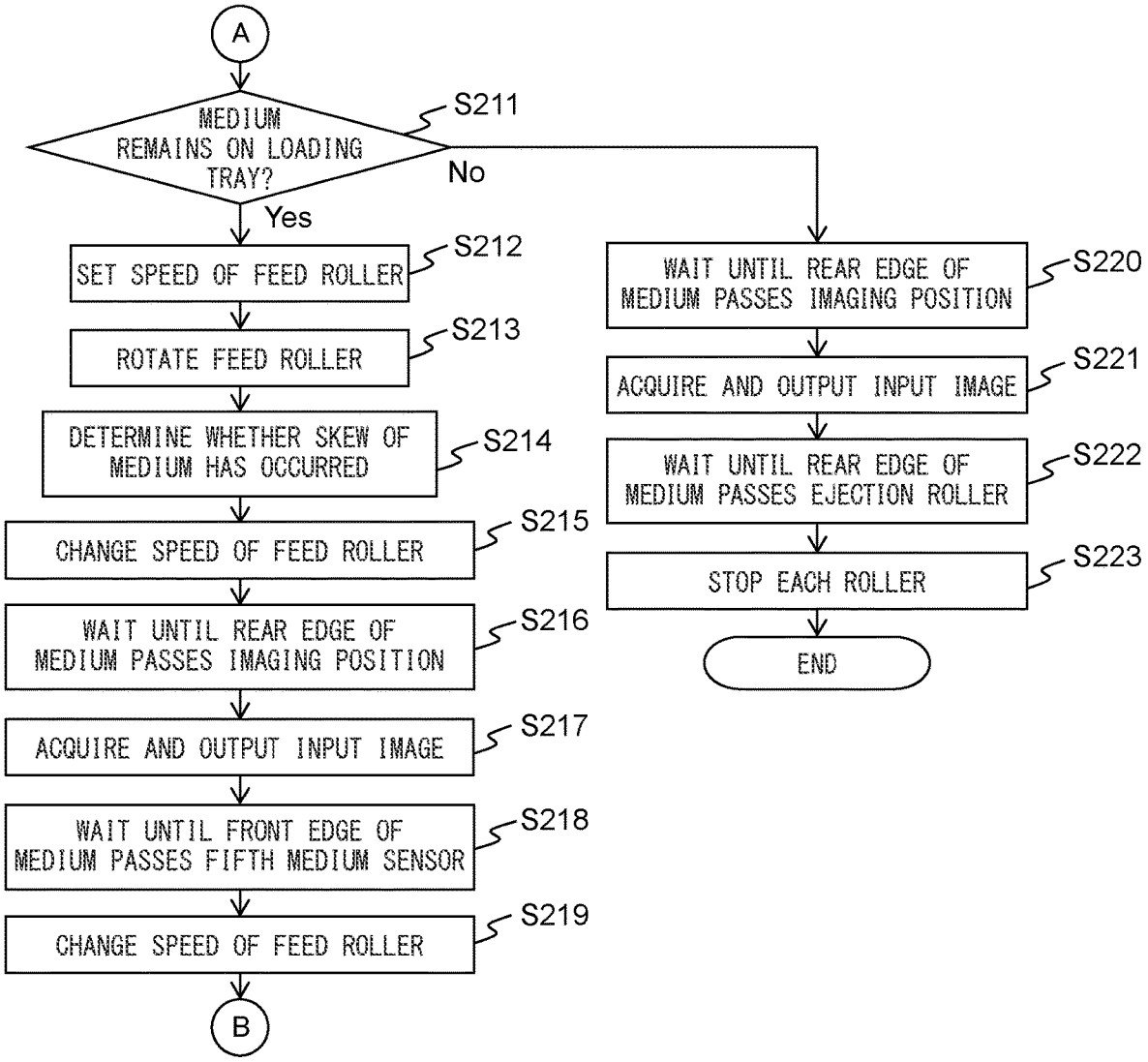
FIG. 16 is a flowchart illustrating an example of part of operation of another type of medium reading processing.

FIG. 16 is a flowchart illustrating an example of part of operation of medium reading process in a medium conveying apparatus according to another embodiment.

The flowchart illustrated in FIG. 16 is executed in place of the flowchart illustrated in FIG. 9. Processing in steps S211 to S213 and S216 to S223 in FIG. 16 is similar to the processing in steps S111 to S113 and S116 to S123 in FIG. 9; and therefore description thereof is omitted, and only steps S214 and S215 will be described below.

After a control module 151 drives a feed roller 112 in step S213, a determination module 152 determines whether a skew of the conveyed medium has occurred (step S214). The determination module 152 periodically acquires the third medium signal and the fourth medium signal from the third medium sensor 116 and the fourth medium sensor 117 and determines whether a skew of the medium has occurred, based on the acquired third medium signal and the acquired fourth medium signal. The determination module 152 determines that the front edge of the medium has passed the position of the third medium sensor 116 when the signal value of the third medium signal changes from a value indicating that a medium does not exist to a value indicating that a medium exists. Further, the determination module 152 determines that the front edge of the medium has passed the position of the fourth medium sensor 117 when the signal value of the fourth medium signal changes from a value indicating that a medium does not exist to a value indicating that a medium exists.

The determination module 152 determines that a skew of the medium has occurred when the front edge of the medium does not pass one of the positions of the third medium sensor 116 and the fourth medium sensor 117 within a fifth predetermined time after passing the other position. The fifth predetermined time is set to, through a previously performed experiment, a value between the difference between passing times of the positions of the sensors when jamming of a medium has not occur and the difference between passing times of the positions of the sensors when jamming of a medium occurs. The determination module 152 determines that a skew of the medium has not occurred when the front edge of the medium passes one of the positions of the third medium sensor 116 and the fourth medium sensor 117 within the fifth predetermined time after passing the other position.

Next, the control module 151 changes the speed of the feed roller 112 (step S215). Similarly to the processing in step S115, the control module 151 changes the speed of the feed roller 112 to a final speed V3*b* when the conveyance mode is set to a medium-speed mode and does not change the speed of the feed roller 112 when the conveyance mode is set to a low-speed mode. When the conveyance mode is set to a high-speed mode, the control module 151 changes the speed of the feed roller 112, based on the determination result of a skew of the medium. The control module 151 may change the speed of the feed roller 112 based on the difference between passing time of the position of the third medium sensor 116 and passing time of the position of the fourth medium sensor 117 without determining a skew of the medium has occurred. For example, when the difference is more than a predetermined value, the control module 151 sets a speed of the feed roller 112 to a speed lower than a speed of the feed roller 112 when the difference is less than or equal to the predetermined value.

Figure 17:
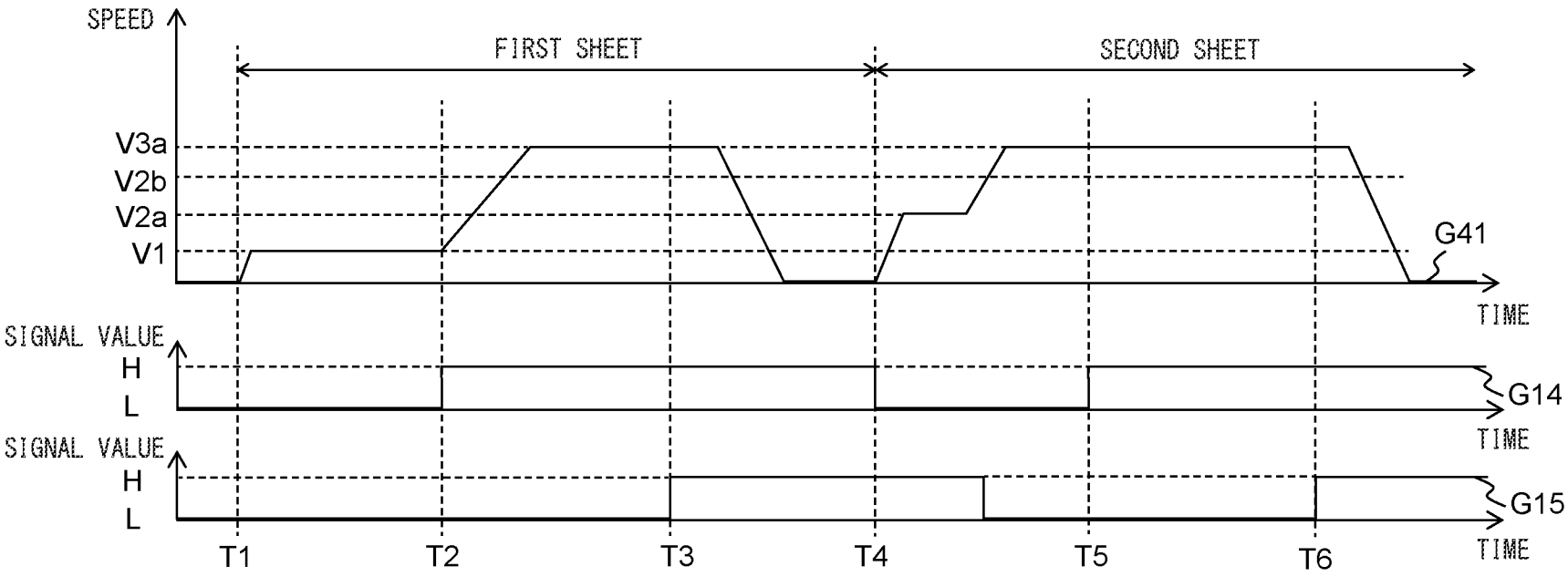
FIG. 17 is a graph for illustrating changes in the speed of a roller.

FIG. 17 is a graph for illustrating changes in the speed of the feed roller 112 in the high-speed mode.

In FIG. 17, a graph G41 illustrates changes in the speed of the feed roller 112. In the graph G41, the horizontal axis indicates time, and the vertical axis indicates speed. The speeds of a brake roller 113 and a conveyance roller 119 change similarly to the graphs G12 and G13 illustrated in FIG. 10. Graphs G14 and G15 illustrate changes in the signal values of a fifth medium sensor 118 and a sixth medium sensor 121 and change similarly to the graphs G14 and G15 illustrated in FIG. 10. Times T1 to T6 indicate times similar to the times T1 to T6 indicated in FIG. 10.

When a skew of a medium occurs, the control module 151 changes the speed of the feed roller 112 to a second intermediate speed V2*b*, as illustrated in the graph G11 illustrated in FIG. 10. When a skew of a medium does not occur, the control module 151 changes the speed of the feed roller 112 to a final speed V3*a*, as the graph G41 illustrated in FIG. 17. In this case, the final speed V3*a* is an example of a second speed. The final speed V3*a* is set to a speed identical to the speed of the feed roller 112. In other words, when the determination module 152 determines that a skew of a medium has occurred, the control module 151 sets the second intermediate speed V2*b* as the second speed in such a way that the speed of the feed roller 112 is lower than the speed of the conveyance roller 119. When the determination module 152 does not determine that a skew of a medium has occurred, the control module 151 sets the final speed V3*a* as the second speed in such a way that the speed of the feed roller 112 is identical to the speed of the conveyance roller 119.

As described above, when free space in a storage device 140 is insufficient or when the distance between media is short, the control module 151 may temporarily stop medium feeding. However, when a medium is tilted and the speed of the conveyance roller 119 is higher than the speed of the feed roller 112, jamming of the medium may occur due to an increase in the tilt of the medium and collision of the medium with a side wall of a conveyance path. By setting the speed of the feed roller 112 to the second intermediate speed V2*b* when a skew of a medium occurs, the control module 151 can stop the medium at a position on a sufficiently upstream side of the conveyance roller 119 when temporarily stopping medium feeding. Consequently, the control module 151 can sufficiently increase the speed of the feed roller 112 before the front edge of the medium arrives at the position of the conveyance roller 119 when resuming medium feeding and can suppress increase in the tilt of the medium and suppress occurrence of jamming of the medium.

When the medium is not tilted, the possibility of occurrence of jamming of the medium due to an increase in the tilt of the medium is low even when the speed of the conveyance roller 119 is higher than the speed of the feed roller 112. By setting the speed of the feed roller 112 to the final speed V3*a* when a skew of the medium does not occur, the control module 151 can reduce the medium feeding time. Accordingly, the control module 151 can reduce the medium conveyance time while suppressing occurrence of jamming of the medium.

As described in detail above, the medium conveying apparatus can control medium feeding better when the speed of the feed roller 112 is changed depending on whether a skew of a medium has occurred as well.

Figure 18:
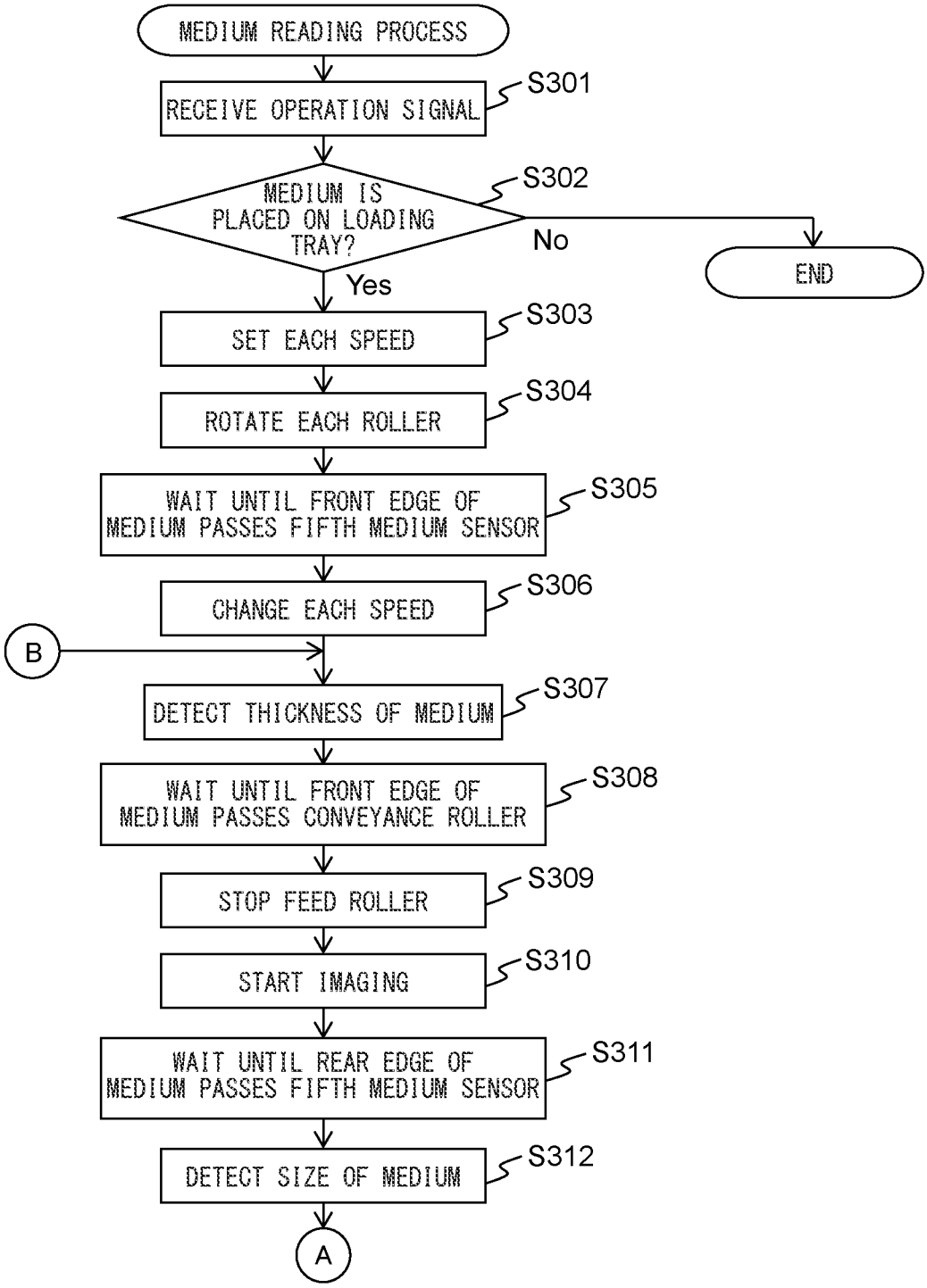
FIG. 18 is a flowchart illustrating an example of part of operation of yet another type of medium reading processing.

FIG. 18 is a flowchart illustrating an example of part of operation of medium reading process in a medium conveying apparatus according to yet another embodiment.

The flowchart illustrated in FIG. 18 is executed in place of the flowchart illustrated in FIG. 8. Processing in steps S301 to S306 and S308 to S311 in FIG. 18 is similar to the processing in steps S101 to S106 and S107 to S110 in FIG. 8; and therefore, description thereof is omitted, and only steps S307 and S312 will be described below.

After waiting until the front edge of the medium passes the position of a fifth medium sensor 118 in step S305 or S118, i.e., after the front edge of the medium passes the position of an ultrasonic sensor 115, a control module 151 detects the thickness of a conveyed medium (step S307). The control module 151 detects the thickness of the medium, based on the ultrasonic signal received from the ultrasonic sensor 115. An ultrasonic wave transmitted by the ultrasonic transmitter 115*a* and passing through a medium is attenuated by the medium, and as the thickness of the medium increases, the amount of attenuation of the ultrasonic wave increases. The medium conveying apparatus 100 previously stores a table defining a relation between the magnitude of the ultrasonic wave received by the ultrasonic receiver 115*b*, i.e., the signal value of the ultrasonic signal, and the thickness of a medium into a storage device 140. The control module 151 specifies the thickness of a medium related to the signal value of the received ultrasonic signal with reference to the table stored in the storage device 140.

The control module 151 may further determine whether multi feed of media has occurred, based on the ultrasonic signal received from the ultrasonic sensor 115. When a plurality of media are conveyed in a stacked manner, an ultrasonic wave passing through the media is attenuated by an air layer between media conveyed in a stacked manner. Accordingly, the control module 151 can determine whether multi feed of media has occurred, based on whether the signal value of the ultrasonic signal is less than or equal to a multi feed threshold value. The multi feed threshold value is set to a value between the signal value of the ultrasonic signal when one sheet of paper is conveyed and the signal value of the ultrasonic signal when two sheets of paper are conveyed. When determining that multi feed of media has occurred, the control module 151 stops conveyance and ejection of a medium by stopping a first motor 131 and a second motor 132. The control module 151 may stop the medium reading process after ejecting a currently conveyed medium. The control module 151 may control each roller to, by driving each motor, reversely feed media remaining in a conveyance path, temporarily return the media to a loading tray 103, and refeed (separate) the media. Consequently, a user does not need to replace the media onto the loading tray 103 and refeed the media, and the control module 151 can improve user convenience. Further, the control module 151 may notify a user of information indicating that multi feed of media has occurred by displaying the information on a display device 106 or transmitting the information to an information processing apparatus through an interface device 135.

The control module 151 may detect the thickness of a medium by using a thickness sensor other than the ultrasonic sensor 115. The thickness sensor is located at a position where the ultrasonic sensor 115 is located. The thickness sensor may be located at any position on a medium conveyance path. For example, the thickness sensor is a reflected light sensor including a pair of a light emitter and a light receiver that are provided on one side of the medium conveyance path and a pair of a light emitter and a light receiver that are provided on the other side. The reflected light sensor detects the distance between each pair and each surface of a medium based on the time elapsed after one pair emits light onto one surface of the medium before the pair receives reflected light and the time elapsed after the other pair emits light onto the other surface of the medium before the pair receives reflected light. The reflected light sensor generates a thickness signal indicating a subtracted value acquired by subtracting the detected distances from the distance between the two pairs as the thickness. The medium conveying apparatus 100 previously stores a table defining a relation between the signal value of the thickness signal and the thickness of a medium into the storage device 140. The control module 151 specifies the thickness of a medium related to the signal value of the received thickness signal with reference to the table stored in the storage device 140. The thickness sensor is not limited to a sensor using light, and any other sensor that can detect the thickness of a medium, such as a pressure sensor or a thickness sensor using a contact segment, may be used as the thickness sensor.

After waiting until the rear edge of the medium passes the position of the fifth medium sensor 118 in step S311, the control module 151 detects the size of the conveyed medium (step S312). For example, the control module 151 detects the length of the medium in a medium conveying direction A1 as the size of the medium. The control module 151 detects the length of the medium in the medium conveying direction A1, based on a fifth medium signal received from the fifth medium sensor 118. The control module 151 calculates the movement distance of the medium by a feed roller 112 by driving the first motor 131 in a period from detection of the front edge of the medium to detection of the rear edge of the medium by the fifth medium sensor 118 as the length of the medium in the medium conveying direction A1. In other words, the control module 151 calculates a value acquired by multiplying the time period from detection of the front edge of the medium to detection of the rear edge of the medium by the fifth medium sensor 118 by the conveyance speed of the medium as the length of the medium in the medium conveying direction A1.

The control module 151 may detect the length of the medium in a width direction A8 as the size of the medium. In that case, a number of fifth medium sensors 118 are spaced in the width direction A8 in the medium conveying apparatus 100, and placement intervals of the fifth medium sensors 118 are previously stored. The control module 151 detects the length of a conveyed medium in the width direction A8, based on the distance between the outermost fifth medium sensors 118 detecting the medium.

The control module 151 may detect the length of a medium in the medium conveying direction A1 or the length of the medium in the width direction A8, based on an input image generated by an imaging device 122 when imaging of the medium is completed. In that case, the control module 151 detects an edge of the medium from the input image by using a known image processing technology and detects the length of the medium in the medium conveying direction A1 or the width direction A8, based on the distance between the upper edge and the lower edge of the medium or the distance between the left edge and the right edge.

When the flowchart illustrated in FIG. 18 is executed, the control module 151 changes the speed of the feed roller 112, based on the length of the medium, in step S115 and/or S119 in the flowchart illustrated in FIG. 9.

Figure 19:
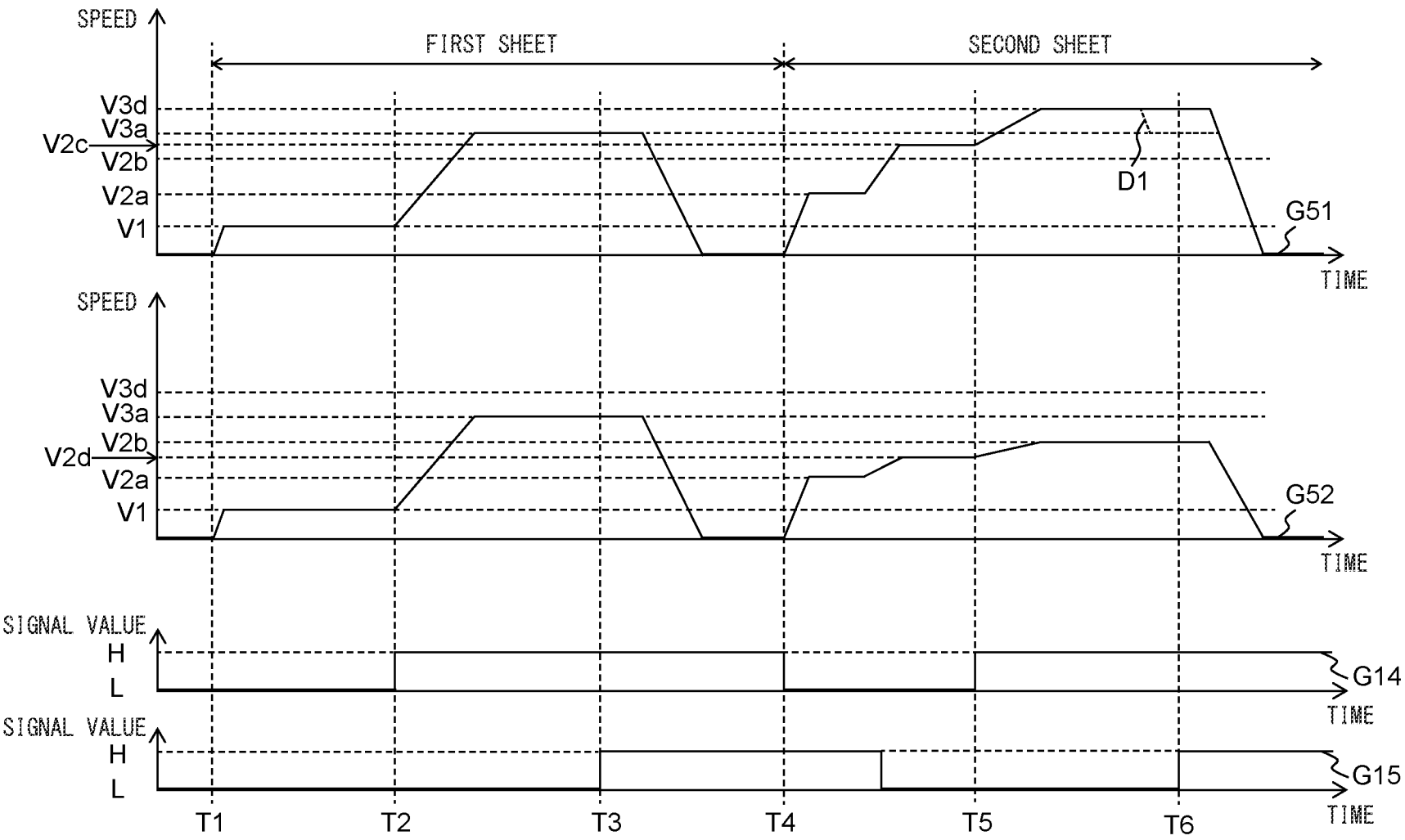
FIG. 19 is a graph for illustrating changes in the speed of a roller.

FIG. 19 is a graph for illustrating changes in the speed of the feed roller 112 in a high-speed mode.

In FIG. 19, graphs G51 and G52 illustrate examples of changes in the speed of the feed roller 112. In each of the graphs G51 and G52, the horizontal axis indicates time, and the vertical axis indicates speed. The speeds of a brake roller 113 and a conveyance roller 119 change similarly to those illustrated in the graphs G12 and G13 in FIG. 10. Graphs G14 and G15 illustrate changes in the signal values of the fifth medium sensor 118 and a sixth medium sensor 121 and change similarly to the graphs G14 and G15 illustrated in FIG. 10. Times T1 to T6 indicate times similar to the times T1 to T6 indicated in FIG. 10.

In step S115, when the size of the medium is less than or equal to a first size threshold value and greater than a second size threshold value, the control module 151 changes the speed of the feed roller 112 to the second intermediate speed V2*b* as illustrated in the graph G11 illustrated in FIG. 10. For example, the first size threshold value is set to a value between the A4 longitudinal size and the A3 longitudinal size when the size of the medium is the length of the medium in the medium conveying direction A1 and is set to a value between the A4 lateral size and the A3 lateral size when the size of the medium is the length of the medium in the width direction A8. The second size threshold value is set to a value less than the first size threshold value. For example, the second size threshold value is set to a value between the A5 longitudinal size and the A4 longitudinal size when the size of the medium is the length of the medium in the medium conveying direction A1 and is set to a value between the A5 lateral size and the A4 lateral size when the size of the medium is the length of the medium in the width direction A8. The first size threshold value and the second size threshold value are examples of a size threshold value.

When the size of the medium is greater than the first size threshold value, the control module 151 changes the speed of the feed roller 112 to a second intermediate speed V2*c* as illustrated in the graph G51. The second intermediate speed V2*c* is set to a speed higher than the second intermediate speed V2*b* when the size of the medium is less than or equal to the first size threshold value and greater than the second size threshold value, and lower than the final speed V3*a*. When the size of the medium is less than or equal to the second size threshold value, the control module 151 changes the speed of the feed roller 112 to a second intermediate speed V2*d* as illustrated in the graph G52. The second intermediate speed V2*d* is set to a speed lower than the second intermediate speed V2*b* when the size of the medium is less than or equal to the first size threshold value and greater than the second size threshold value, and higher than the first intermediate speed V2*a*.

In step S119, when the size of the medium is less than or equal to the first size threshold value and greater than the second size threshold value, the control module 151 changes the speed of the feed roller 112 to the final speed V3*a* as illustrated in the graph G11 illustrated in FIG. 10. When the size of the medium is greater than the first size threshold value, the control module 151 changes the speed of the feed roller 112 to a final speed V3*d* as illustrated in the graph G51. The final speed V3*d* is set to a speed higher than the final speed V3*a* at which the feed roller 112 is set when the size of the medium is less than or equal to the first size threshold value and greater than the second size threshold value. When changing the speed of the feed roller 112 to the final speed V3*d*, the control module 151 may change the speed of the feed roller 112 to the final speed V3*a* before the front edge of the succeeding medium passes the position of the fifth medium sensor 118, as illustrated in a dotted line D1 in the graph G51. In other words, the control module 151 decelerates the speed of the feed roller 112 to the final speed V3*a* before the front edge of the succeeding medium passes the position of the conveyance roller 119. Consequently, the control module 151 can suppress occurrence of jamming of the medium due to the medium being pushed by the feed roller 112 and being bent between the feed roller 112 and the conveyance roller 119. When the size of the medium is less than or equal to the second size threshold value, the control module 151 changes the speed of the feed roller 112 to the second intermediate speed V2*b* as illustrated in the graph G52.

When the size of the medium is greater than the first size threshold value, the control module 151 may change the speed of the feed roller 112 to a speed similar to the speed when the size of the medium is less than or equal to the first size threshold value and greater than the second size threshold value. Alternatively, when the size of the medium is less than or equal to the second size threshold value, the control module 151 may change the speed of the feed roller 112 to a speed similar to the speed when the size of the medium is less than or equal to the first size threshold value and greater than the second size threshold value.

Thus, when the size of a preceding medium is small, the control module 151 lowers the speed of the feed roller 112 after the front edge of a succeeding medium passes a nip region of the feed roller 112 and the brake roller 113 than the speed when the size of the preceding medium is large. In other words, when the size of the preceding medium is less than or equal to a size threshold value, the control module 151 sets a second speed to a speed lower than the second speed when the size of the preceding medium is greater than the size threshold value.

In general, as the length of a medium decreases, the distance between successively conveyed media tends to decrease. The control module 151 can suppress occurrence of collision between successively conveyed media by lowering the speed of the feed roller 112 when the size of the preceding medium is small than the speed of the feed roller 112 when the size of the preceding medium is large.

When the flowchart illustrated in FIG. 18 is executed, the control module 151 may change the speed of the feed roller 112 in step S115 and/or S119 in the flowchart illustrated in FIG. 9 based on the thickness of the medium.

In step S115, when the thickness of the medium is less than or equal to a first thickness threshold value and greater than a second thickness threshold value, the control module 151 changes the speed of the feed roller 112 to the second intermediate speed V2*b* as the graph G11 illustrated in FIG. 10. For example, the first thickness threshold value is set to a value between the thickness of plain paper copier (PPC) paper and the thickness of a common business card. The second thickness threshold value is set to a value less than the first thickness threshold value. For example, the second thickness threshold value is set to a value between the thickness of common thin paper and the thickness of PPC paper. The first thickness threshold value and the second thickness threshold value are examples of a thickness threshold value.

When the thickness of the medium is greater than the first thickness threshold value, the control module 151 changes the speed of the feed roller 112 to the second intermediate speed V2*c* as the graph G51. When the thickness of the medium is less than or equal to the second thickness threshold value, the control module 151 changes the speed of the feed roller 112 to the second intermediate speed V2*d* as the graph G52.

In step S119, when the thickness of the medium is less than or equal to the first thickness threshold value and greater than the second thickness threshold value, the control module 151 changes the speed of the feed roller 112 to the final speed V3*a* as the graph G11 illustrated in FIG. 10. When the thickness of the medium is greater than the first thickness threshold value, the control module 151 changes the speed of the feed roller 112 to the final speed V3*d* as the graph G51. When the size of the medium is less than or equal to the second thickness threshold value, the control module 151 changes the speed of the feed roller 112 to the second intermediate speed V2*b* as the graph G52.

When the thickness of the medium is greater than the first thickness threshold value, the control module 151 may change the speed of the feed roller 112 to a speed similar to the speed when the thickness of the medium is less than or equal to the first thickness threshold value and greater than the second thickness threshold value. Alternatively, when the thickness of the medium is less than or equal to the second thickness threshold value, the control module 151 may change the speed of the feed roller 112 to a speed similar to the speed when the thickness of the medium is less than or equal to the first thickness threshold value and greater than the second thickness threshold value.

Thus, when a preceding medium is thin, the control module 151 lowers the speed of the feed roller 112 after the front edge of a succeeding medium passes the nip region of the feed roller 112 and the brake roller 113 than the speed when the preceding medium is thick. In other words, when the thickness of the preceding medium is less than or equal to a thickness threshold value, the control module 151 sets the second speed to a speed lower than the second speed when the thickness of the preceding medium is greater than the thickness threshold value.

In general, as the thickness of a medium decreases, the possibility of occurrence of jamming of the medium tends to increase. The control module 151 can suppress the occurrence of jamming of the medium by lowering the speed of the feed roller 112 when a preceding medium is thin than the speed of the feed roller 112 when the preceding medium is thick.

The processing in either of steps S307 and S311 may be omitted. The control module 151 may change the speed of the feed roller 112 based on both the size and the thickness of a medium. In that case, the control module 151 decreases the speed of the feed roller 112 as the length of a preceding medium decreases and decreases the speed of the feed roller 112 as the thickness of the preceding medium decreases.

As described in detail above, the medium conveying apparatus can control medium feeding better when changing the speed of the feed roller 112 based on the size or the thickness of a medium as well.

Figure 20:
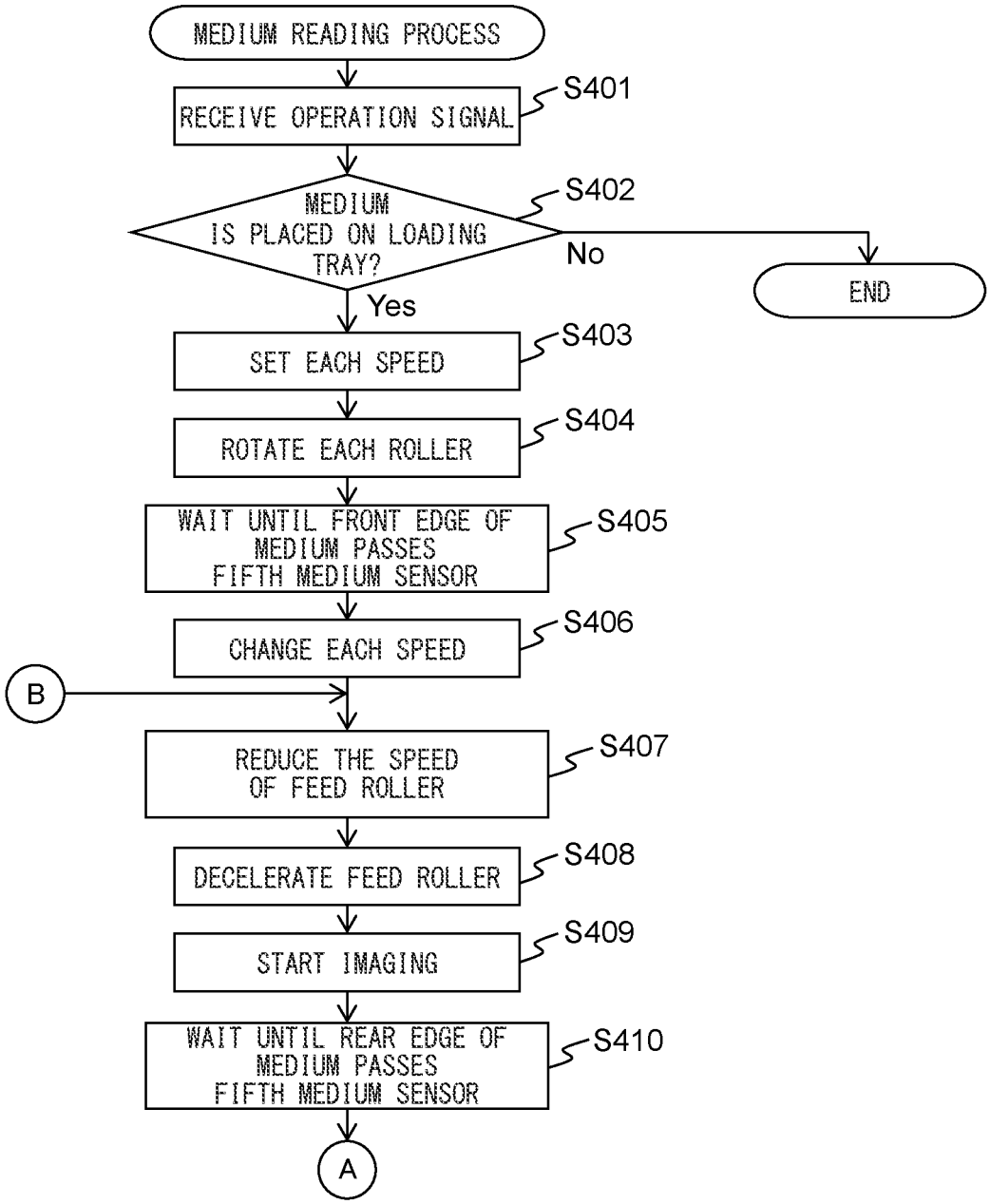
FIG. 20 is a flowchart illustrating an operation example of yet another type of medium reading processing.
Figure 21:
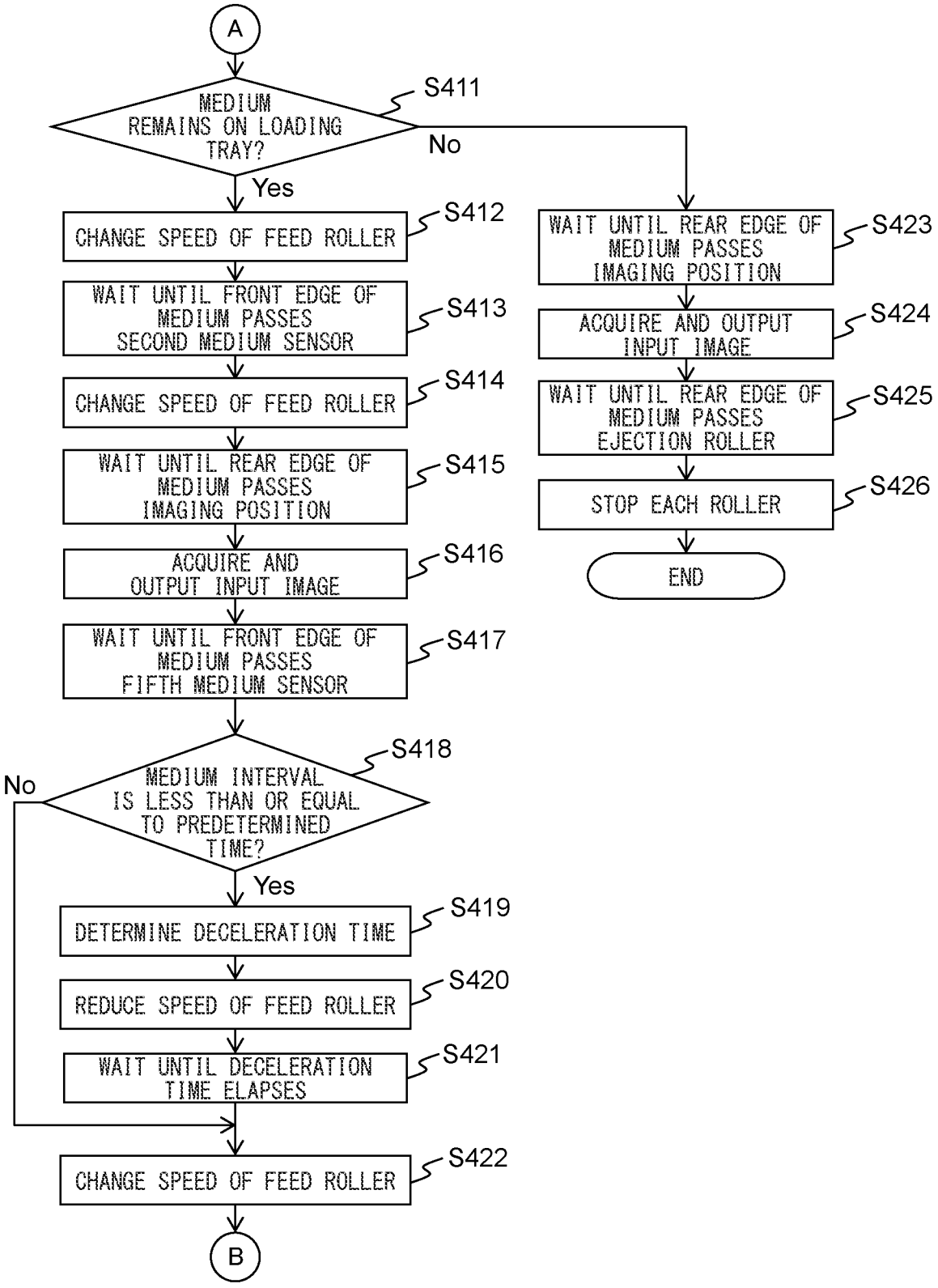
FIG. 21 is a flowchart illustrating an operation example of the yet another type of medium reading processing.

FIG. 20 and FIG. 21 are flowcharts illustrating an operation example of medium reading process in a medium conveying apparatus according to yet another embodiment.

The flowcharts illustrated in FIG. 20 and FIG. 21 are executed in place of the flowcharts illustrated in FIG. 8 and FIG. 9. Processing in steps S401 to S407, S409 to S411, S413 to S417, and S422 to S426 in FIG. 20 and FIG. 21 is similar to the processing in steps S101 to S107, S109 to S111, S114 to S118, and S119 to S123 in FIGS. 8 and 9, and therefore description thereof is omitted. Only steps S408, S412, and S418 to S421 will be described below.

After waiting until the front edge of the medium passes the position of the conveyance roller 119 in step S407, the control module 151 controls the first motor 131 to reduce the speed of the feed roller 112 without stopping the feed roller 112 (step S408). In other words, when the front edge of the medium passes the conveyance roller 119, the control module 151 controls the first motor 131 to cause the feed roller 112 to continue rotation while reducing the rotation speed.

Figure 22:
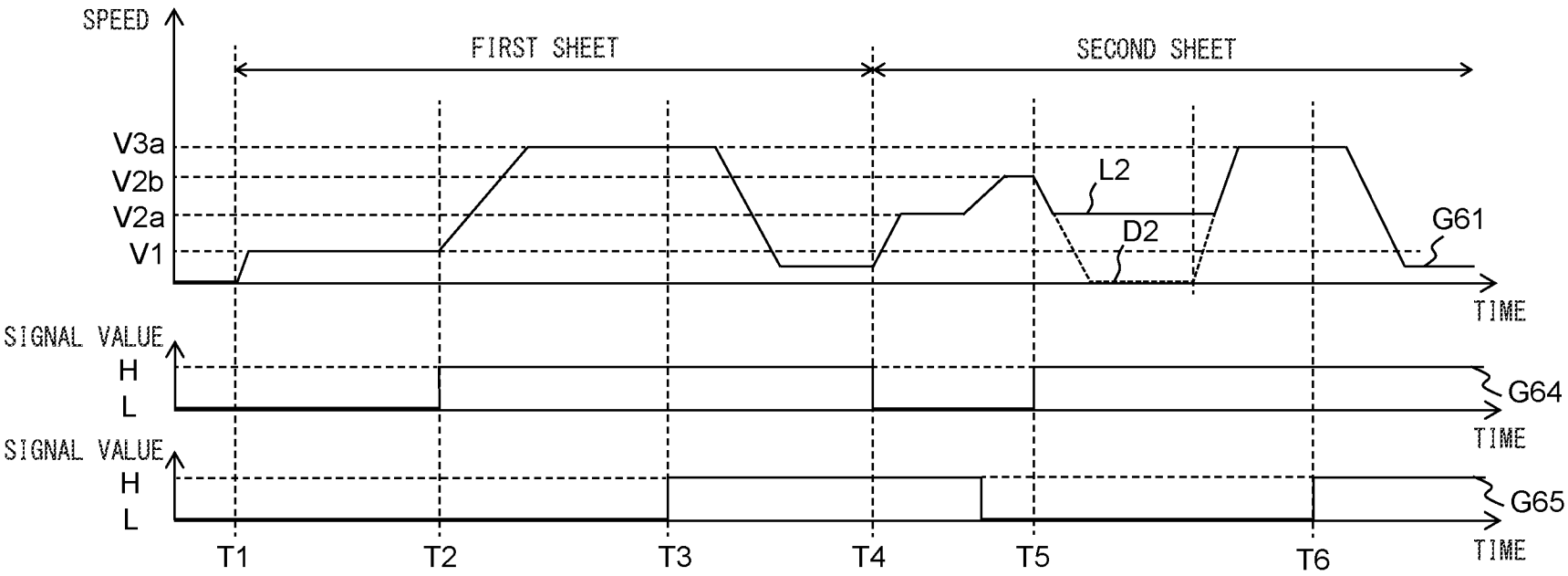
FIG. 22 is a graph for illustrating changes in the speed of a roller.

FIG. 22 is a graph for illustrating changes in the speed of the feed roller 112 in a high-speed mode.

A graph G61 in FIG. 22 illustrates an example of changes in the speed of the feed roller 112. In the graph G61, the horizontal axis indicates time, and the vertical axis indicates speed. The speeds of a brake roller 113 and a conveyance roller 119 change similarly as the graphs G12 and G13 illustrated in FIG. 10. Graphs G64 and G65 illustrate changes in the signal values of a fifth medium sensor 118 and a sixth medium sensor 121. In each of the graphs G64 and G65, the horizontal axis indicates time, and the vertical axis indicates the signal value. Times T1 to T6 indicate times similar to the times T1 to T6 indicated in FIG. 10. However, in the examples illustrated in the graphs G61, G64, and G65, the distance between the rear edge of a preceding medium and the front edge of a succeeding medium is shorter, and the time period between the time T4 and the time T5 is shorter, compared with the examples illustrated in the graphs in FIG. 10.

As illustrated in the graph G61 between the time T3 and the time T4, when the front edge of the medium passes the conveyance roller 119, the speed of the feed roller 112 is reduced but is not 0. Consequently, the control module 151 can shorten the distance between successively fed media and reduce the conveyance time of the media while suppressing occurrence of jamming of a medium between the feed roller 112 and the conveyance roller 119.

After waiting until the rear edge of the medium passes the position of the fifth medium sensor 118 in step S410, when determining that a medium remains on a loading tray 103 in step S411, the control module 151 changes the speed of the feed roller 112 (step S412). The control module 151 sets the speed of the feed roller 112 to the first intermediate speed V2*a* when the conveyance mode is set to the high-speed mode, similarly to step S112 in FIG. 9.

After waiting until the front edge of the medium passes the position of the fifth medium sensor 118 in step S417, the control module 151 calculates the time elapsed after the rear edge of the preceding medium passes a first position before the front edge of the succeeding medium passes a second position (step S418). The time elapsed after the rear edge of the preceding medium passes the first position before the front edge of the succeeding medium passes the second position may be hereinafter referred to as a medium interval. For example, the first position and the second position are set to the position of the fifth medium sensor 118. In that case, the control module 151 calculates the time period from the time when the rear edge of the preceding medium has passed the position of the fifth medium sensor 118 in step S410 to the time when the front edge of the succeeding medium has passed the position of the fifth medium sensor 118 in step S417 as the medium interval. The first position and the second position may be any other position, such as the position of a second medium sensor 114. The first position and the second position are not limited to the same positions and may be positions different from each other.

Next, the control module 151 determines whether the calculated medium interval is less than or equal to a predetermined time (step S418). When the medium interval is greater than the predetermined time, the control module 151 proceeds the processing to step S422.

When the medium interval is less than or equal to the predetermined time, the control module 151 determines a deceleration time in which the feed roller 112 is decelerated, based on the medium interval (step S419). The deceleration time is the time elapsed after the feed roller 112 is temporarily stopped before rotation of the feed roller 112 is resumed or the time elapsed after the feed roller 112 is decelerated before the feed roller 112 is accelerated.

The control module 151 determines the deceleration time in such a way that the deceleration time increases as the medium interval decreases and the deceleration time decreases as the medium interval increases. The medium conveying apparatus 100 previously stores a table defining a relation between the medium interval and the deceleration time into a storage device 140, and the control module 151 identifies the deceleration time related to the medium interval with reference to the table stored in the storage device 140.

Next, the control module 151 reduces the speed of the feed roller 112 (step S420).

As illustrated in the graph G61 in FIG. 22, when the medium interval (a time period from the time T4 to the time T5) is short, the control module 151 reduces the speed of the feed roller 112 to a predetermined speed at the time T5 when the front edge of the succeeding medium has passed the position of the fifth medium sensor 118. For example, the control module 151 changes the speed of the feed roller 112 to a speed at least lower than the second intermediate speed V2*b* and decelerates the feed roller 112 as indicated by a solid line L2 in the graph G61. The control module 151 may change the speed of the feed roller 112 to 0 and stop the feed roller 112 as indicated by a dotted line D2 in the graph G61.

Next, the control module 151 waits until the deceleration time determined in step S420 elapses (step S421).

Next, the control module 151 changes the speed of the feed roller 112 (step S422).

As illustrated in FIG. 22, the control module 151 changes the speed of the feed roller 112 to the final speed V3*a* when the conveyance mode is set to the high-speed mode, similarly to the processing in step S119 in FIG. 9.

Thus, the control module 151 temporarily stops or decelerates the feed roller 112 when the medium interval is less than or equal to the predetermined time. Consequently, the control module 151 can suppress occurrence of collision between successively fed media.

The control module 151 temporarily stops or decelerates the feed roller 112 when the front edge of a medium succeeding a preceding medium passes the fifth medium sensor 118. Then, the control module 151 determines a timing at which rotation of the feed roller 112 is resumed after the feed roller 112 is temporarily stopped or a timing at which the feed roller 112 is accelerated after the feed roller 112 is decelerated, based on the medium interval. Consequently, the control module 151 can suitably set a time period for decelerating the feed roller 112 and can suppress an excessive increase in the medium conveyance time while suppressing occurrence of collision between successively fed media.

The control module 151 may control the first motor 131 to stop the feed roller 112 in step S408, similarly to step S108 in FIG. 8. In that case, the control module 151 resumes rotation of the feed roller 112 in step S412 by setting the speed of the feed roller 112 and redriving the first motor 131, similarly to steps S112 and S113 in FIG. 9.

As described in detail above, the medium conveying apparatus can more control medium feeding better when changing the speed of the feed roller 112 based on intervals between successively fed media as well.

Figure 23:
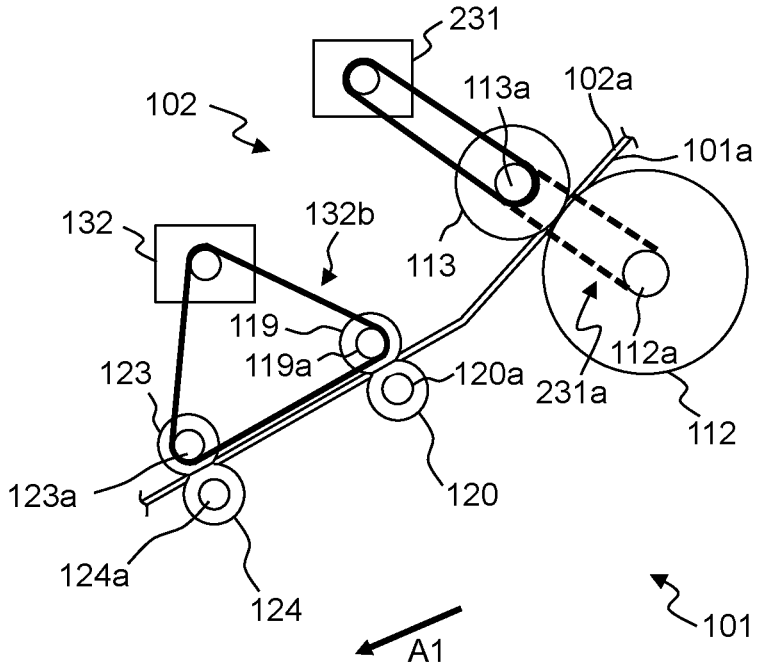
FIG. 23 is a schematic diagram for illustrating yet other driving sources.

FIG. 23 is a schematic diagram for illustrating driving sources of the feed roller 112, the brake roller 113, the conveyance roller 119, the first facing roller 120, the ejection roller 123, and/or the second facing roller 124 in a medium conveying apparatus according to yet another embodiment.

As illustrated in FIG. 23, the medium conveying apparatus according to the present embodiment includes a first motor 231 in place of the first motor 131. Further, the medium conveying apparatus includes a second transmission mechanism 132*b* in place of the second transmission mechanism 132*a* for a second motor 132.

The first motor 231 is provided in the upper housing 102, is connected to the feed roller 112 and the brake roller 113 through a first transmission mechanism 231*a*, and drives the brake roller 113 along with the feed roller 112. The first motor 231 generates a driving force for driving the feed roller 112 and the brake roller 113 in accordance with a control signal from the processing circuit 150. The first transmission mechanism 231*a* includes one or a plurality of pulleys, belts, gears, etc., that are provided between the first motor 231, and the shaft 113*a* of the brake roller 113 and the shaft 112*a* of the feed roller 112. The first transmission mechanism 231*a* transmits the driving force generated by the first motor 231 to the feed roller 112 and the brake roller 113. In particular, one or a plurality of gears for changing the rotation direction and the rotation speed of each roller are provided between the shaft 113*a* of the brake roller 113 and the shaft 112*a* of the feed roller 112. The gears are located outside the medium conveyance path in the width direction A8 to transmit the driving force with the medium conveyance path in between. Consequently, the first motor 231 feeds a medium by rotating the feed roller 112 and the brake roller 113. The first motor 231 is an example of a driving source of the brake roller 113.

The first motor 231 can reliably transmit the driving force to the brake roller 113 before the feed roller 112 since the first motor 231 is provided in the housing on the brake roller 113 side (the upper housing 102). Consequently, the first motor 231 can start rotation of the brake roller 113 before starting rotation of the feed roller 112 and can stably separate a medium. Further, it is preferable that the first motor 231 is directly connected to the shaft 113*a* of the brake roller 113 by a belt. Consequently, the first motor 231 can more reliably start rotation of the brake roller 113 before starting rotation of the feed roller 112.

A second motor 132 is provided in the upper housing 102 separately from the first motor 231, is connected to the conveyance roller 119 and the ejection roller 123 through the second transmission mechanism 132*b*, and drives the conveyance roller 119 and the ejection roller 123. The second motor 132 generates a driving force for driving the conveyance roller 119 and the ejection roller 123 in accordance with a control signal from the processing circuit 150. The second transmission mechanism 132*b* includes one or a plurality of pulleys, belts, gears, etc., that are provided between the second motor 132, a shaft 119*a* of the conveyance roller 119 and a shaft 123*a* of the ejection roller 123. The second transmission mechanism 132*b* transmits the driving force generated by the second motor 132 to the conveyance roller 119 and the ejection roller 123. Consequently, the second motor 132 causes the conveyance roller 119 and the ejection roller 123 to convey and eject a medium by rotating the conveyance roller 119 and the ejection roller 123.

Figure 24:
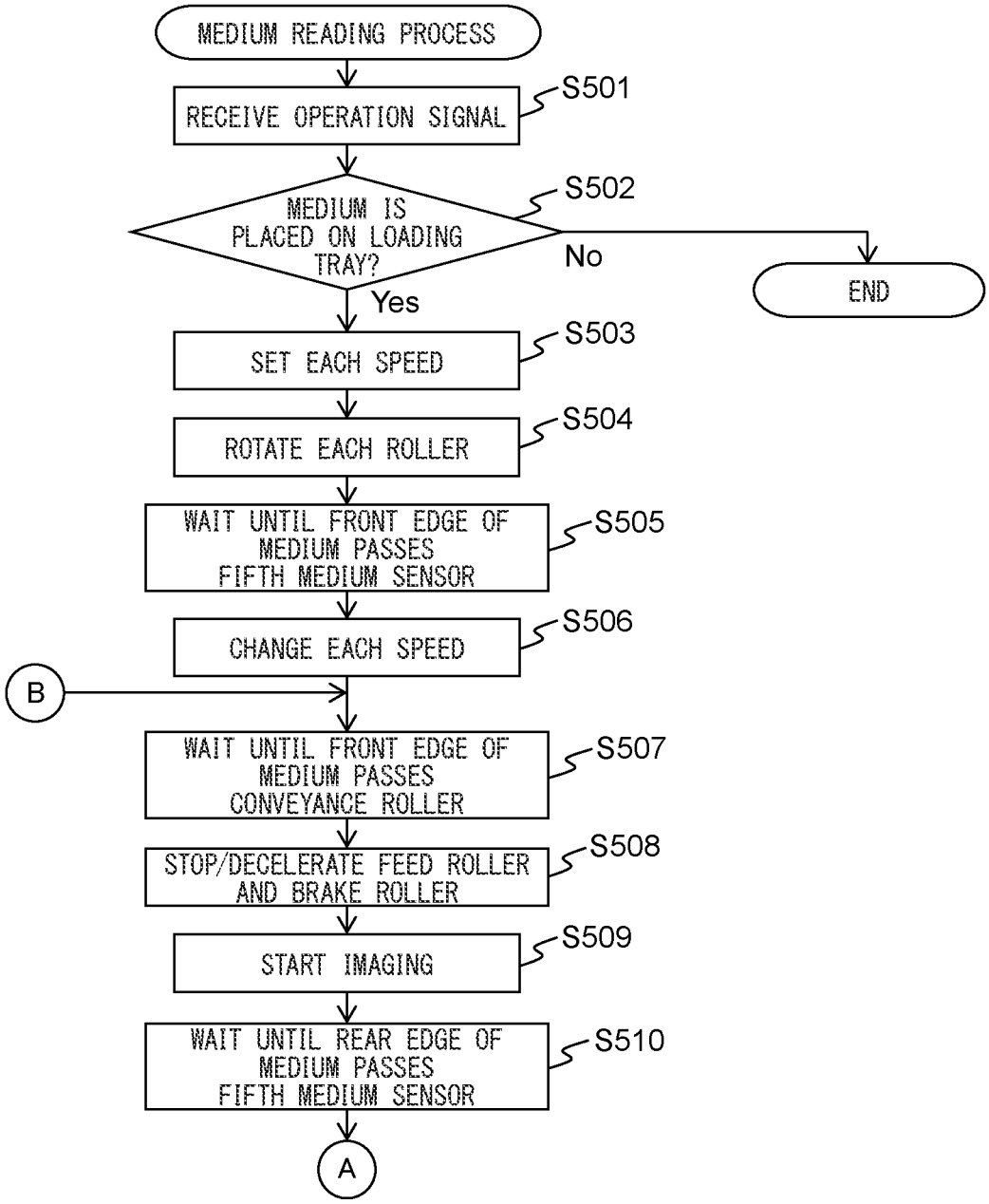
FIG. 24 is a flowchart illustrating an operation example of yet another type of medium reading processing.
Figure 25:
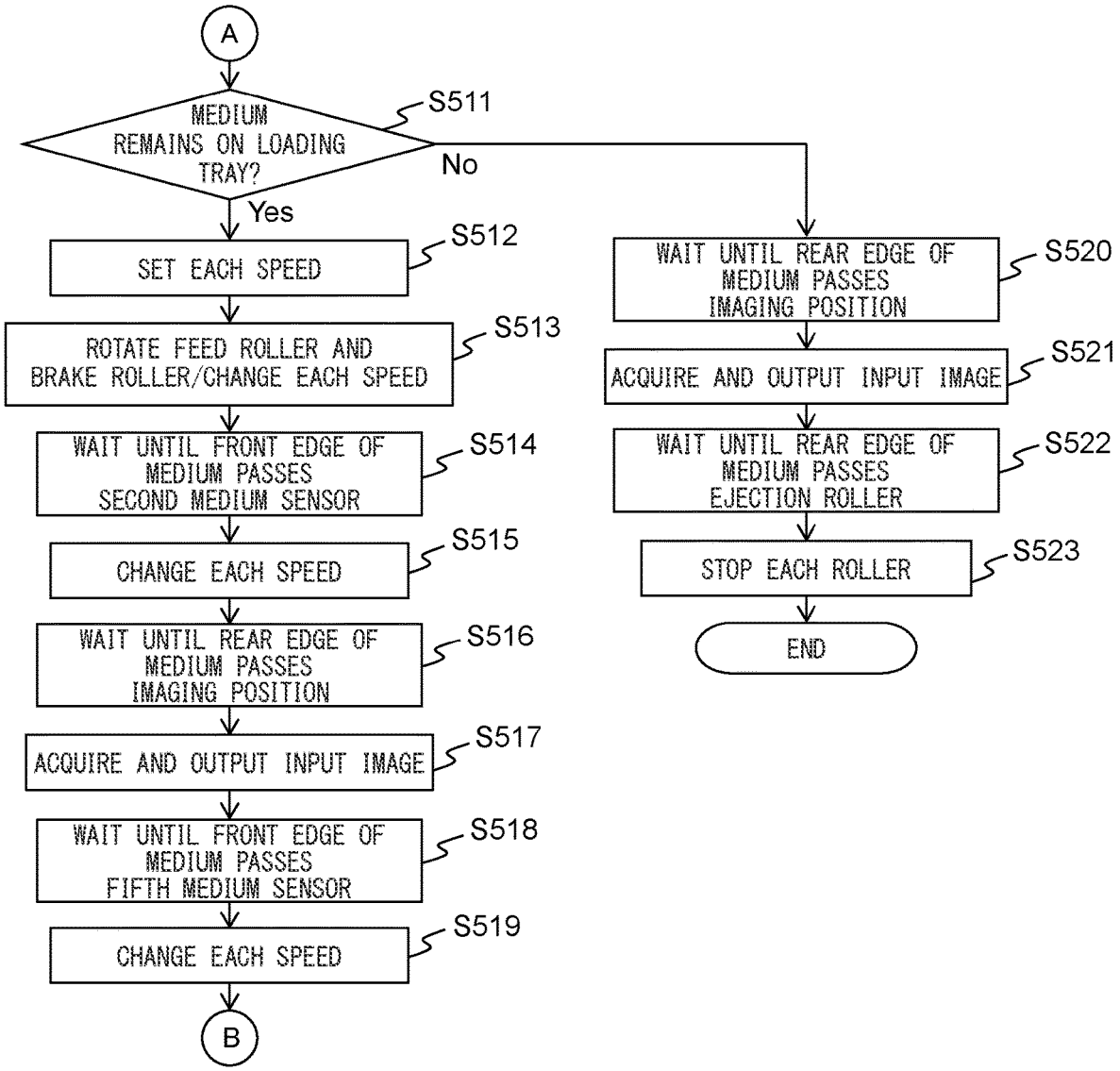
FIG. 25 is a flowchart illustrating an operation example of yet another type of medium reading processing.

FIG. 24 and FIG. 25 are flowcharts illustrating an operation example of medium reading process in a medium conveying apparatus according to the yet another embodiment.

The flowcharts illustrated in FIG. 24 and FIG. 25 are executed in place of the flowcharts illustrated in FIG. 8 and FIG. 9. Processing in steps S501 to S507, S509 to S511, S514, S516 to S518, and S520 to S523 in FIG. 24 and FIG. 25 is similar to the processing in steps S101 to S107, S109 to S111, S114, S116 to S118, and S120 to S123 in FIGS. 8 and 9, and therefore description thereof is omitted. Only steps S508, S512, S513, S515, and S519 will be described below.

After waiting until the front edge of the medium passes the position of the conveyance roller 119 in step S507, the control module 151 controls the first motor 231 to stop or decelerate the brake roller 113 along with the feed roller 112 (step S508). The medium conveying apparatus 100 has a first mode giving priority to securing the distance between media and a second mode giving priority to preventing occurrence of multi feed of media. The first mode and the second mode are set by a user by using the operation device 105 or the information processing apparatus.

Figure 26:
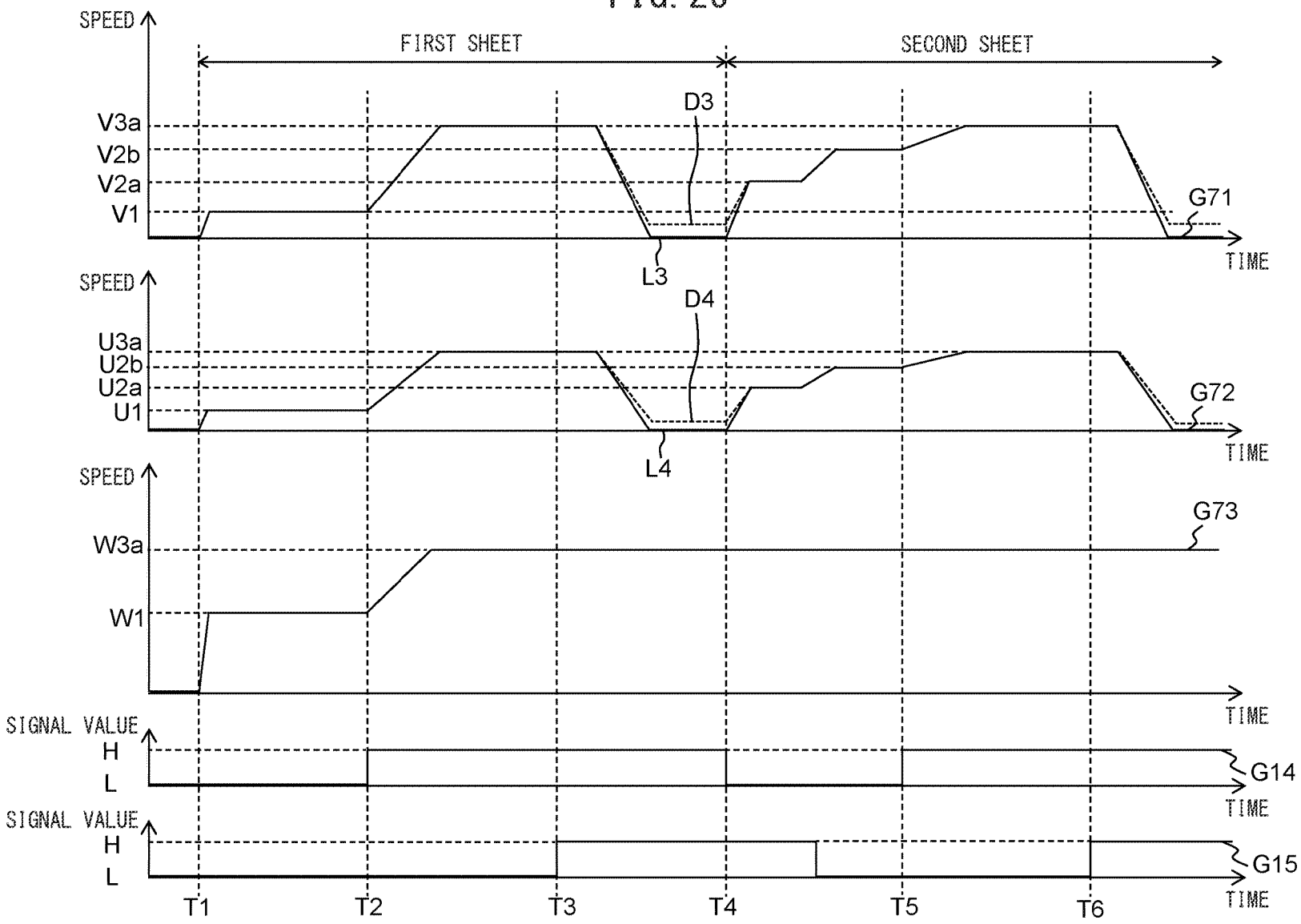
FIG. 26 is a graph for illustrating changes in the speeds of rollers.

FIG. 26 is a graph for illustrating changes in the speeds of a feed roller, a brake roller, and a conveyance roller in a high-speed mode.

In FIG. 26, a graph G71 illustrates an example of changes in the speed of the feed roller 112, a graph G72 illustrates an example of changes in the speed of the brake roller 113, and a graph G73 illustrates an example of changes in the speed of the conveyance roller 119. In each of the graphs G71 to G73, the horizontal axis indicates time, and the vertical axis indicates speed. Graphs G14 and G15 illustrate changes in the signal values of a fifth medium sensor 118 and a sixth medium sensor 121, and change similarly to the graphs G14 and G15 illustrated in FIG. 10. Times T1 to T6 indicate times similar to the times T1 to T6 indicated in FIG. 10.

When set to the first mode, the control module 151 controls the first motor 231 to stop the feed roller 112 and the brake roller 113. In this case, as indicated by a solid line L3 in the graph G71 and a solid line L4 in the graph G72, the speeds of the feed roller 112 and the brake roller 113 become 0 between the time T3 and the time T4. Consequently, the control module 151 can reliably suppress occurrence of jamming of a medium between the feed roller 112 and the conveyance roller 119.

When set to the second mode, the control module 151 controls the first motor 231 to cause the feed roller 112 and the brake roller 113 to continue rotation while reducing the rotation speeds (without stopping). In this case, as indicated by a dotted line D3 in the graph G71 and a dotted line D4 in the graph G72, the speeds of the feed roller 112 and the brake roller 113 do not become 0 but are reduced between the time T3 and the time T4. Consequently, the control module 151 can suppress reduction in separation performance due to stopping the brake roller 113 and can suppress occurrence of multi feed of media.

When determining that a medium remains on the loading tray 103 in step S511 after waiting until the rear edge of the medium passes the position of the fifth medium sensor 118 in step S510, the control module 151 sets the speed of the feed roller 112 for feeding a succeeding medium (step S512).

When being set to the first mode, the control module 151 sets the speed of the feed roller 112 to the first intermediate speed V2*a* at the time T4 as illustrated in the graph G71 in FIG. 26. Further, the control module 151 sets the speed of the brake roller 113 to a first intermediate speed U2*a* at the time T4 as illustrated in the graph G72. The first intermediate speed U2*a* is set to a speed higher than the initial speed U1 and lower than the final speed U3*a*.

Next, the control module 151 controls the first motor 231 to rotate the feed roller 112 and the brake roller 113 at the set speeds (step S513). When being set to the first mode and stopping the feed roller 112 and the brake roller 113, the control module 151 resumes rotation of the feed roller 112 and the brake roller 113 to feed and convey a succeeding medium.

When set to the second mode and not stopping the feed roller 112 and the brake roller 113, the control module 151 changes the speeds of the feed roller 112 and the brake roller 113. The control module 151 increases the speed of the feed roller 112 to the first intermediate speed V2*a* and increases the speed of the brake roller 113 to the first intermediate speed U2*a*.

After waiting until the front edge of the succeeding medium passes the position of the second medium sensor 114 in step S514, the control module 151 changes the speeds of the feed roller 112 and the brake roller 113 (step S515).

The control module 151 changes the speed of the feed roller 112 to the second intermediate speed V2*b* as illustrated in the graph G71 in FIG. 26. Further, the control module 151 changes the speed of the brake roller 113 to a second intermediate speed U2*b* as illustrated in the graph G72. The second intermediate speed U2*b* is set to a speed higher than the first intermediate speed U2*a* and lower than the final speed U3*a*.

After waiting until the front edge of the succeeding medium passes the position of the fifth medium sensor 118 in step S518, the control module 151 changes the speeds of the feed roller 112 and the brake roller 113 (step S519).

The control module 151 changes the speed of the feed roller 112 to a final speed V3*a* at the time T5 as illustrated in the graph G71 in FIG. 26. Further, the control module 151 changes the speed of the brake roller 113 to the final speed U3*a* as illustrated in the graph G72.

In step S508, the control module 151 may stop the feed roller 112 by controlling the first electromagnetic clutch 133 to interrupt the driving force from the first motor 231 to the feed roller 112, while decelerating the brake roller 113. In other words, when the front edge of the medium passes the conveyance roller 119, the control module 151 continues to transmit the driving force from the first motor 231 to the brake roller 113 while interrupting the driving force from the first motor 231 to the feed roller 112 by controlling the first electromagnetic clutch 133. In that case, the control module 151 resumes rotation of the feed roller 112 in step S513 by controlling the first electromagnetic clutch 133 to transmit the driving force from the first motor 231 to the feed roller 112. Consequently, the control module 151 can suppress decrease in the distance between successively fed media while suppressing degradation in separation performance due to stopping the brake roller 113. The medium conveying apparatus may interrupt the driving force from the first motor 231 to the feed roller 112 by a mechanism, such as a planetary gear mechanism, other than the electromagnetic clutch. The planetary gear is provided to be able to move between a position at which the planetary gear transmits the driving force from the first motor 231 to the feed roller 112 and a position at which the planetary gear does not transmit the driving force from the first motor 231 to the feed roller 112.

According to the present embodiment, the feed roller 112 and the brake roller 113 are driven by the same first motor 231, and therefore the speed of the feed roller 112 and the speed of the brake roller 113 have a proportional relation. The speed of the brake roller 113 is set to be lower than the speed of the feed roller 112 and higher than ½ of the speed of the feed roller 112.

The medium conveying apparatus may operate in either mode of the first mode and the second mode in a fixed manner.

As described in detail above, the medium conveying apparatus can control medium feeding better when the feed roller 112 and the brake roller 113 are driven by the same first motor 231 as well.

Figure 27:
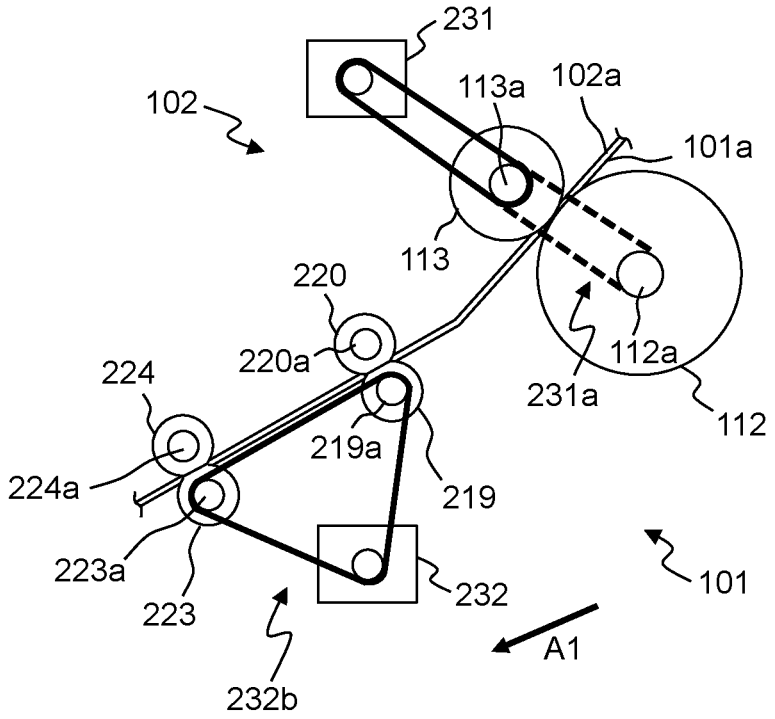
FIG. 27 is a schematic diagram for illustrating yet other driving sources.

FIG. 27 is a schematic diagram for illustrating driving sources of a feed roller, a brake roller, a conveyance roller, a first facing roller, an ejection roller, and/or a second facing roller in a medium conveying apparatus according to yet another embodiment.

As illustrated in FIG. 27, the medium conveying apparatus according to the present embodiment includes the conveyance roller 219, the first facing roller 220, the ejection roller 223, and the second facing roller 224 in place of the conveyance roller 119, the first facing roller 120, the ejection roller 123, and the second facing roller 124. The structures of the conveyance roller 219, the first facing roller 220, the ejection roller 223, and the second facing roller 224 are similar to the structures of the conveyance roller 219, the first facing roller 220, the ejection roller 223, and the second facing roller 224 in the medium conveying apparatus illustrated in FIG. 15. Further, the medium conveying apparatus includes the second motor 232 in place of the second motor 132. The structure of the second motor 232 is similar to the structure of the second motor 232 in the medium conveying apparatus illustrated in FIG. 15. Further, the medium conveying apparatus includes the first motor 231 in place of the first motor 131. The structure of the first motor 231 is similar to the structure of the first motor 231 in the medium conveying apparatus illustrated in FIG. 23.

In other words, the first motor 231 drives the brake roller 113 along with the feed roller 112, and the second motor 232 drives the conveyance roller 219 and the ejection roller 223 in the medium conveying apparatus according to the present embodiment, similarly to the medium conveying apparatus illustrated in FIG. 23.

As described in detail above, the medium conveying apparatus can control medium feeding better when the feed roller 112 and the brake roller 113 are driven by the same first motor 231 while providing the conveyance roller 219 in the lower housing 101 as well.

Figure 28:
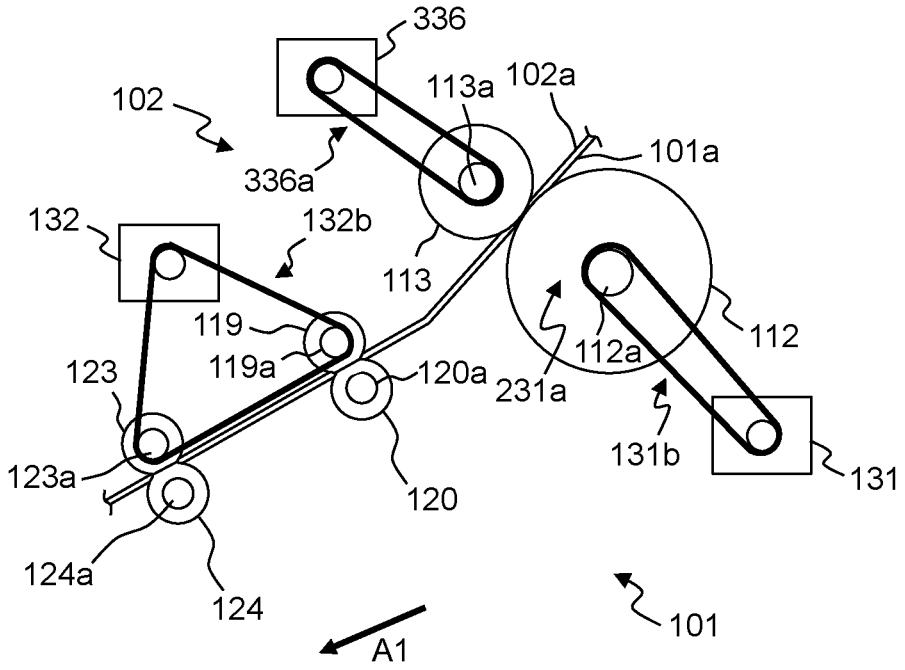
FIG. 28 is a schematic diagram for illustrating yet other driving sources.

FIG. 28 is a schematic diagram for illustrating driving sources of a feed roller, a brake roller, a conveyance roller, a first facing roller, an ejection roller, and/or a second facing roller in a medium conveying apparatus according to yet another embodiment.

As illustrated in FIG. 28, the medium conveying apparatus according to the present embodiment includes a third motor 336 in addition to the first motor 131. The medium conveying apparatus includes a first transmission mechanism 131*b* in place of the first transmission mechanism 131*a* for the first motor 131 and includes a second transmission mechanism 132*b* in place of the second transmission mechanism 132*a* for the second motor 132. The structure of the second motor 132 is similar to the structure of the second motor 132 illustrated in FIG. 23.

The first motor 131 is connected to the feed roller 112 through the first transmission mechanism 131*b* and drives the feed roller 112. The first motor 131 generates a driving force for driving the feed roller 112 in accordance with a control signal from the processing circuit 150. The first transmission mechanism 131*b* includes one or a plurality of pulleys, belts, gears, etc., that are provided between the first motor 131 and a shaft 112*a* of the feed roller 112 and transmits the driving force generated by the first motor 131 to the feed roller 112. Consequently, the first motor 131 feeds a medium by rotating the feed roller 112.

The third motor 336 is provided in the upper housing 102 separately from the first motor 131 and the second motor 132, is connected to the brake roller 113 through a third transmission mechanism 336*a*, and drives the brake roller 113. The third motor 336 generates a driving force for driving the brake roller 113 in accordance with a control signal from the processing circuit 150. The third transmission mechanism 336*a* includes one or a plurality of pulleys, belts, gears, etc., that are provided between the third motor 336 and a shaft 113*a* of the brake roller 113 and transmits the driving force generated by the third motor 336 to the brake roller 113. Consequently, the third motor 336 feeds a medium by rotating the brake roller 113. The third motor 336 is an example of a driving source of the brake roller 113.

Figure 29:
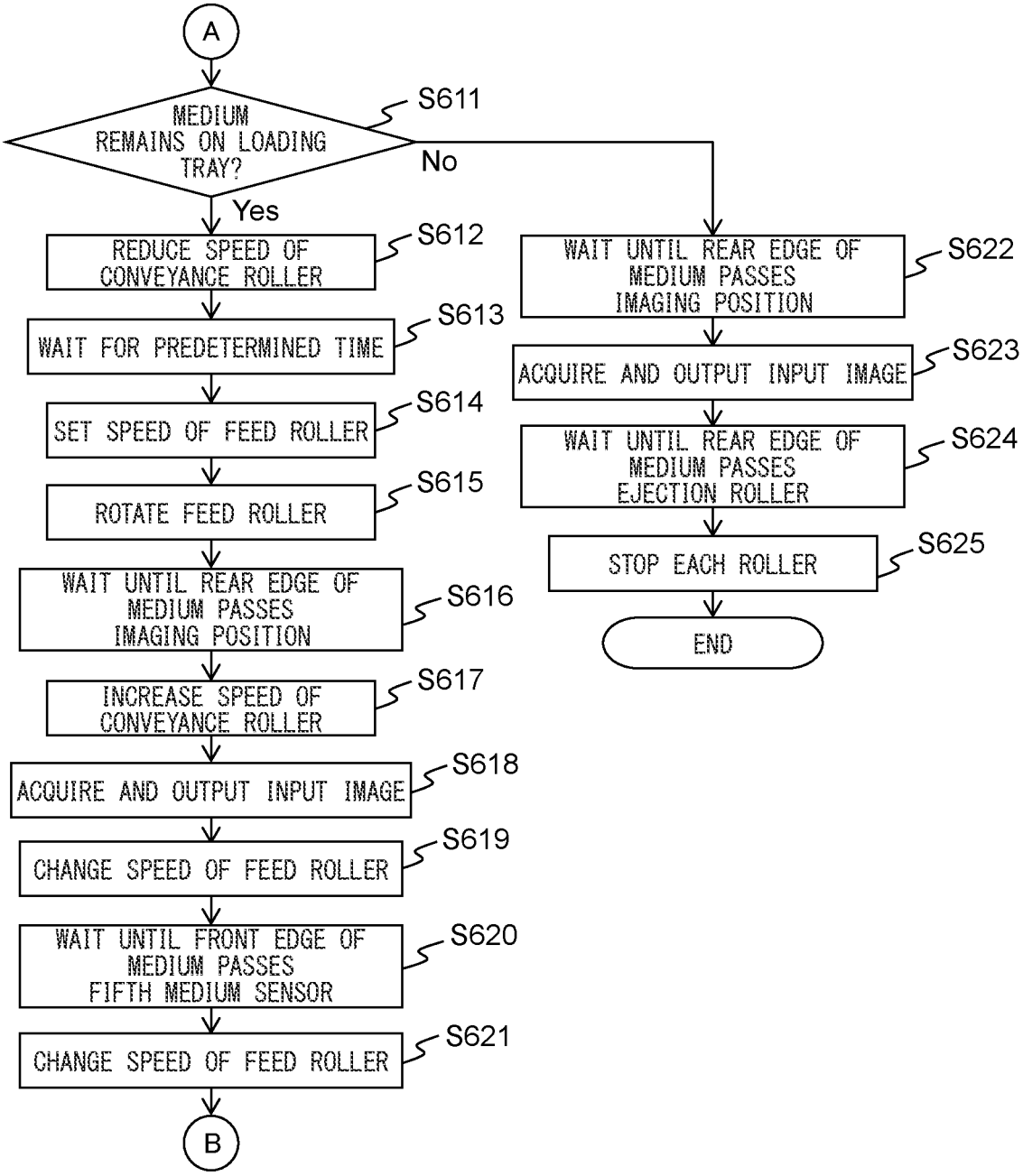
FIG. 29 is a flowchart illustrating an example of part of operation of yet another type of medium reading processing.

FIG. 29 is a flowchart illustrating an example of part of operation of medium reading process in a medium conveying apparatus according to the yet another embodiment.

The flowchart illustrated in FIG. 29 is executed in place of the flowchart illustrated in FIG. 9. Processing in steps S611, S614, S615, S616, S618, S620, and S622 to S625 in FIG. 29 is similar to the processing in steps S111, S112, S113, S116, S117, S118, and S120 to S123 in FIG. 9, and therefore description thereof is omitted. Only steps S612, S613, S617, S619, and S621 will be described below.

After waiting until the rear edge of the medium passes the position of the fifth medium sensor 118 in step S110, when determining that a medium remains on the loading tray 103 in step S611, the control module 151 controls the second motor 132 to reduce the speed of the conveyance roller 119 (step S612). In other words, the control module 151 reduces the rotation speed of the conveyance roller 119 when the rear edge of the medium passes the fifth medium sensor 118.

Figure 30:
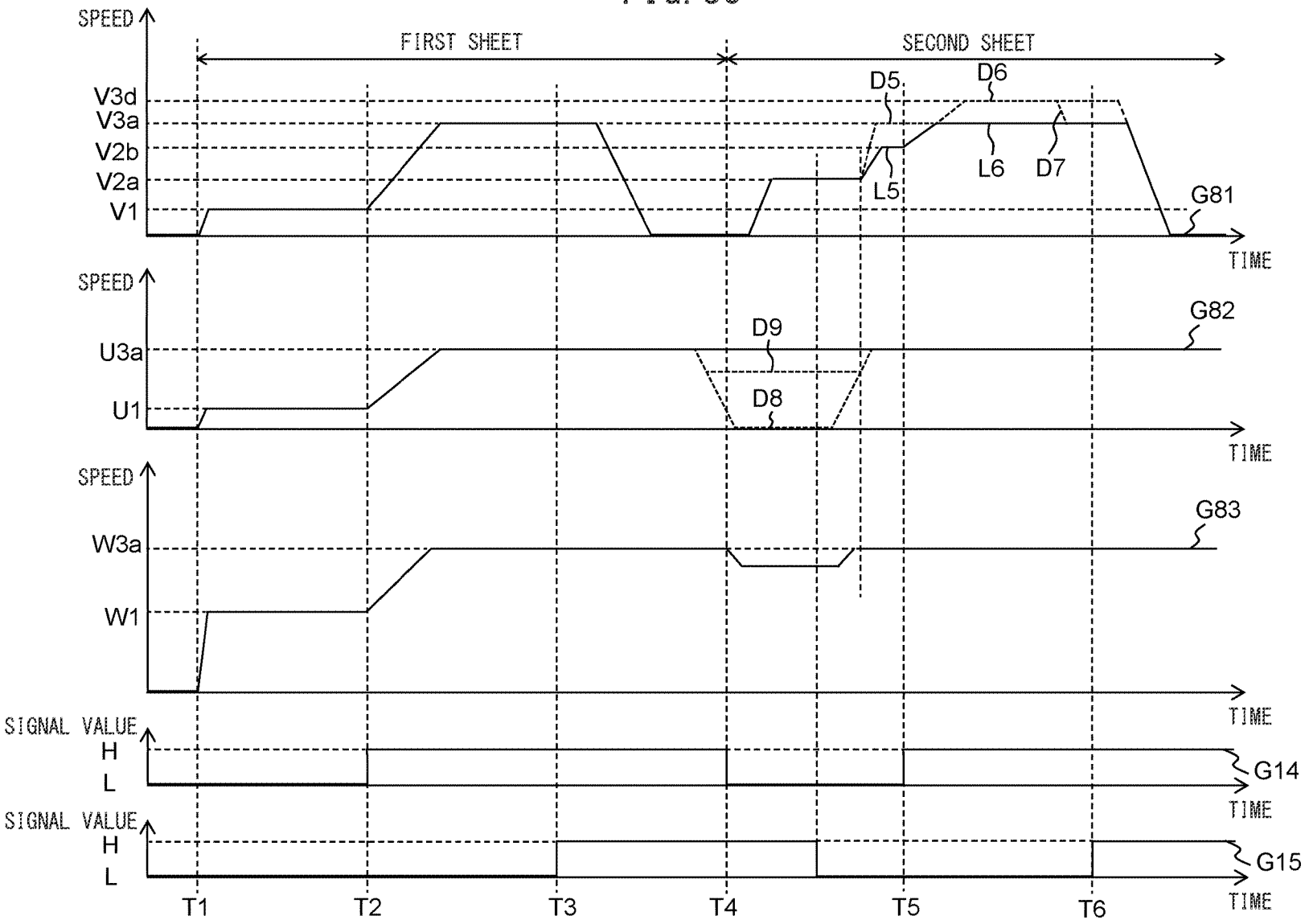
FIG. 30 is a graph for illustrating changes in the speeds of rollers.

FIG. 30 is a graph for illustrating changes in the speeds of the feed roller 112, the brake roller 113, and the conveyance roller 119 in the high-speed mode.

In FIG. 30, a graph G81 illustrates an example of changes in the speed of the feed roller 11, a graph G82 illustrates an example of changes in the speed of the brake roller 113, and a graph G83 illustrates an example of changes in the speed of the conveyance roller 119. In each of the graphs G81 to G83, the horizontal axis indicates time, and the vertical axis indicates speed. Graphs G14 and G15 illustrate changes in the signal values of the fifth medium sensor 118 and the sixth medium sensor 121 and change similarly to the graphs G14 and G15 illustrated in FIG. 10. Times T1 to T6 indicate times similar to the times T1 to T6 indicated in FIG. 10. The control module 151 may reduce the rotation speed of the conveyance roller 119 when the rear edge of the medium passes the second medium sensor 114 instead of the fifth medium sensor 118.

As illustrated in the graph G83, the control module 151 reduces the speed of the conveyance roller 119 when the rear edge of the medium passes the fifth medium sensor 118 at the time T4. During separation, a force attempting to keep a medium on the upstream side is exerted on the medium by the feed roller 112 and the brake roller 113. The force disappears when the rear edge of the medium leaves the feed roller 112 and the brake roller 113, and therefore the conveyance speed of the medium tends to increase. By reducing the speed of the conveyance roller 119 when the rear edge of the medium passes the feed roller 112 and the brake roller 113, the control module 151 can convey the medium at a stable speed.

Next, the control module 151 waits until a sixth predetermined time elapses (step S613). The sixth predetermined time is set to a time by which medium feeding by the feed roller 112 can be delayed for the amount of delay in medium conveyance due to deceleration of the conveyance roller 119. Consequently, the control module 151 can delay medium feeding by the feed roller 112 for the amount of delay in medium conveyance by the conveyance roller 119 and can convey the medium at a stable speed. The processing in step S613 may be omitted.

After waiting until the rear edge of the medium passes the imaging position in step S616, the control module 151 controls the second motor 132 to increase the speed of the conveyance roller 119 (step S617). In other words, the control module 151 increases the rotation speed of the conveyance roller 119 when the rear edge of the medium passes the imaging position of the imaging device 122.

As illustrated in the graph G83 in FIG. 30, the control module 151 increases the speed of the conveyance roller 119 when the rear edge of the medium passes the imaging position between the time T4 and the time T5. By changing the speed of the conveyance roller 119 after the rear edge of the medium passes the imaging position, the control module 151 can suppress occurrence of expansion or contraction within an input image. Further, when the rear edge of the medium passes the conveyance roller 119 and a first facing roller 120, the conveyance force exerted on the medium decreases, and the conveyance speed of the medium tends to decrease. By increasing the speed of the ejection roller 123 after the rear edge of the medium passes the conveyance roller 119 and the first facing roller 120, the control module 151 can convey the medium at a stable speed.

After acquiring an input image in step S618, the control module 151 controls the first motor 131 to increase the speed of the feed roller 112 (step S619). In other words, the control module 151 increases the rotation speed of the feed roller 112 when the rear edge of the medium passes the conveyance roller 119.

As indicated by a solid line L5 in the graph G81 in FIG. 30, the control module 151 increases the speed of the feed roller 112 to the second intermediate speed V2*b* when the rear edge of the medium passes the position of the conveyance roller 119 (after the signal value in the graph G15 changes from H to L). In particular, the control module 151 increases the speed of the feed roller 112 after increasing the speed of the conveyance roller 119. Consequently, the control module 151 can suppress occurrence of jamming of the medium due to the medium being pushed by the feed roller 112 and being bent between the feed roller 112 and the conveyance roller 119.

As indicated by a dotted line D5 in the graph G81, the control module 151 may increase the speed of the feed roller 112 to the final speed V3*a* higher than the second intermediate speed V2*b* after the rear edge of the medium passes the position of the conveyance roller 119. Consequently, the control module 151 can make up for the delay in medium conveyance by the conveyance roller 119 and the feed roller 112.

After waiting until the front edge of the medium passes the fifth medium sensor 118 in step S620, the control module 151 controls the first motor 131 to increase the speed of the feed roller 112 (step S621).

As indicated by a solid line L6 in the graph G81 in FIG. 30, the control module 151 increases the speed of the feed roller 112 to the final speed V3*a* at the time T5. As indicated by a dotted line D6 in the graph G81, the control module 151 may increase the speed of the feed roller 112 to the final speed V3*d* higher than the final speed V3*a* at the time T5. Consequently, the control module 151 can make up for the delay in medium conveyance by the conveyance roller 119 and the feed roller 112. When changing the speed of the feed roller 112 to the final speed V3*d*, the control module 151 may change the speed of the feed roller 112 to the final speed V3*a* before the front edge of the succeeding medium passes the position of the fifth medium sensor 118, as indicated by a dotted line D7 in the graph G81. Consequently, the control module 151 can suppress occurrence of jamming of the medium due to the medium being pushed by the feed roller 112 and being bent between the feed roller 112 and the conveyance roller 119.

According to the present embodiment, the driving source of the feed roller 112, the driving source of the brake roller 113, and the driving source of the conveyance roller 119 and the ejection roller 123 are separately provided, and therefore the speeds of the rollers can be changed at timings independent of each other. Therefore, the control module 151 can flexibly control feeding and conveyance of a medium.

As indicated by a dotted line D8 in the graph G82, the control module 151 may temporarily stop the brake roller 113 while the rear edge of the medium is passing the nip region of the feed roller 112 and the brake roller 113 and resume rotation of the brake roller 113 after the rear edge passes the nip region. Alternatively, as indicated by a dotted line D9 in the graph G82, the control module 151 may reduce the speed of the brake roller 113 while the rear edge of the medium is passing the nip region, increase the speed of the brake roller 113 after the rear edge passes the nip region, and return to the final speed U3*a*. When the rear edge of the preceding medium passes the nip region of the feed roller 112 and the brake roller 113, the brake roller 113 may rotate in a direction opposite to the medium feeding direction with force due to reduction in a load exerted on the brake roller 113 in a medium feeding direction by the medium. At that time, a succeeding medium may be pushed back to the upstream side due to elastically deformed parts of the feed roller 112 and the brake roller 113 returning to the original shapes. In that case, jamming of a medium may occur due to the front edge of the succeeding medium being pushed up (turned up) by the brake roller 113. By reducing the speed of the brake roller 113 when the rear edge of a medium passes the nip region, the control module 151 can suppress occurrence of jamming of the succeeding medium due to the front edge of the medium being turned up.

The control module 151 may start rotation of the brake roller 113 before rotation of the feed roller 112. Consequently, the control module 151 can suppress avalanching a plurality of media placed on the loading tray 103 into between the feed roller 112 and the brake roller 113 and can suppress the occurrence of multi feed of media.

As described in detail above, the medium conveying apparatus can control medium feeding better when the speed of the conveyance roller 119 is changed while the feed roller 112, the brake roller 113, and the conveyance roller 119 are driven by separate motors as well.

The medium conveying apparatus may drive the brake roller 113 by either the first motor or the second motor when changing the speed of the conveyance roller 119. In that case, the control module 151 adjusts the timing of changing the speed of the brake roller 113 to the timing of changing the speed of the feed roller 112 or the conveyance roller 119. Further, the control module 151 may change the speed of the feed roller 112 or the brake roller 113 by controlling the first electromagnetic clutch 133 or the second electromagnetic clutch 134. Further, the medium conveying apparatus may include a driving force interruption mechanism, such as an electromagnetic clutch, between the conveyance roller 119 and the second motor, and the control module 151 may change the speed of the conveyance roller 119 by controlling the driving force interruption mechanism.

Figure 31:
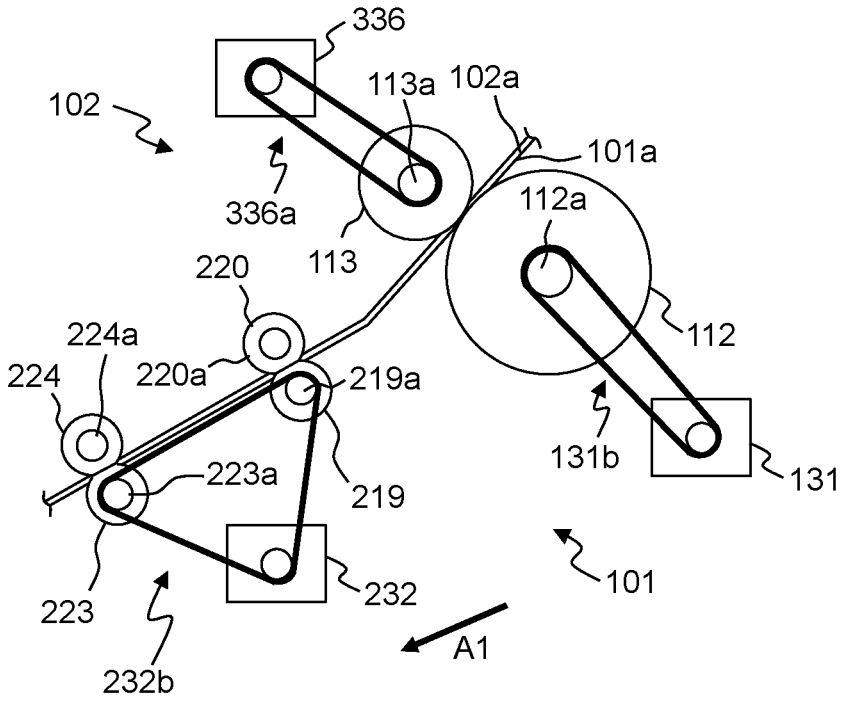
FIG. 31 is a schematic diagram for illustrating yet other driving sources.

FIG. 31 is a schematic diagram for illustrating driving sources of a feed roller, a brake roller, a conveyance roller, a first facing roller, an ejection roller, and/or a second facing roller in a medium conveying apparatus according to yet another embodiment.

As illustrated in FIG. 31, the medium conveying apparatus according to the present embodiment includes the conveyance roller 219, the first facing roller 220, the ejection roller 223, and the second facing roller 224 in place of the conveyance roller 119, the first facing roller 120, the ejection roller 123, and the second facing roller 124. The structures of the conveyance roller 219, the first facing roller 220, the ejection roller 223, and the second facing roller 224 are similar to the structures of the conveyance roller 219, the first facing roller 220, the ejection roller 223, and the second facing roller 224 in the medium conveying apparatus illustrated in FIG. 15. Further, the medium conveying apparatus includes the second motor 232 in place of the second motor 132. The structure of the second motor 232 is similar to the structure of the second motor 232 in the medium conveying apparatus illustrated in FIG. 15. Further, the medium conveying apparatus includes the third motor 336 in addition to the first motor 131. The structures of the first motor 131 and the third motor 336 are similar to the structures of the first motor 131 and the third motor 336 in the medium conveying apparatus illustrated in FIG. 28.

In other words, the first motor 131 drives the feed roller 112, the third motor 336 drives the brake roller 113, and the second motor 232 drives the conveyance roller 219 and the ejection roller 223 in the medium conveying apparatus according to the present embodiment, similarly to the medium conveying apparatus illustrated in FIG. 28.

As described in detail above, the medium conveying apparatus can control medium feeding better when the feed roller 112, the brake roller 113, and the conveyance roller 219 are driven by separate motors while providing the conveyance roller 219 in the lower housing 101.

Figure 32:
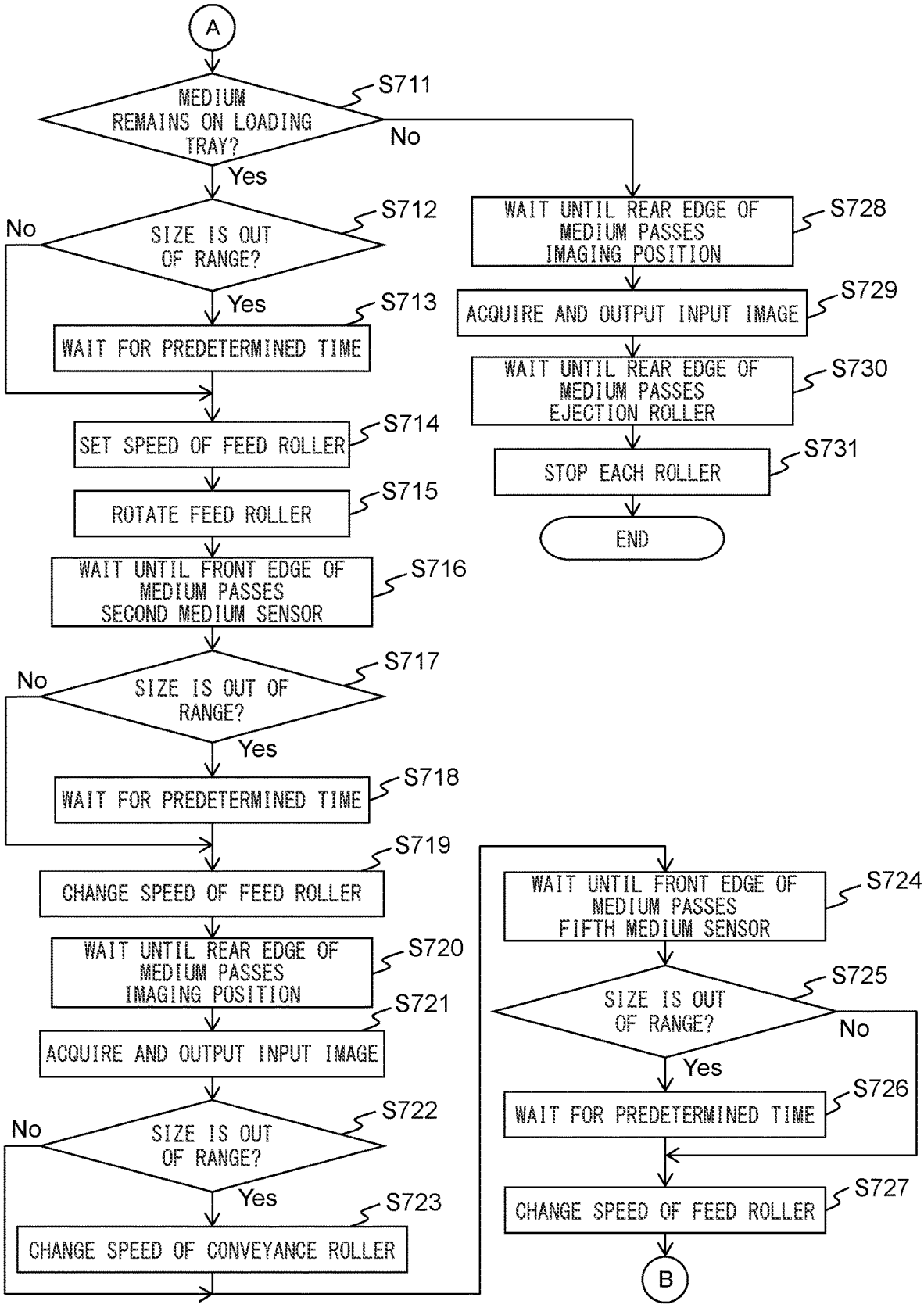
FIG. 32 is a flowchart illustrating an example of part of operation of yet another type of medium reading processing.

FIG. 32 is a flowchart illustrating an example of part of operation of medium reading process in a medium conveying apparatus according to yet another embodiment. The medium conveying apparatus according to the present embodiment includes the driving sources illustrated in FIG. 28 or the driving sources illustrated in FIG. 31.

The flowchart illustrated in FIG. 32 is executed in place of the flowchart illustrated in FIG. 9. Processing in steps S711, S714 to S716, S719 to S721, S724, and S727 to S731 in FIG. 32 is similar to the processing in steps S111, S112 to S114, S115 to S117, S118, and S119 to S123 in FIG. 9, and therefore description thereof is omitted. Only steps S712, S713, S717, S718, S722, S723, S725, and S726 will be described below. When the flowchart illustrated in FIG. 32 is executed, steps S301 to S312 in the flowchart illustrated in FIG. 18 are executed in place of steps S101 to S110 in the flowchart illustrated in FIG. 8.

After waiting until the rear edge of the medium passes the position of the fifth medium sensor 118 in step S311, the control module 151 determines whether the size of the preceding medium is greater than the first size threshold value and whether the size is greater than the second size threshold value (step S712). When the size of the preceding medium is less than or equal to the first size threshold value and greater than or equal to the second size threshold value, the control module 151 proceeds the processing to step S714 without particularly executing processing.

When the size of the preceding medium is greater than the first size threshold value or less than the second size threshold value, the control module 151 waits until a seventh predetermined time elapses (step S713). For example, the seventh predetermined time is set to a time acquired by subtracting the time required for medium conveyance from the time required for image processing when a medium greater than the first size threshold value is conveyed. Alternatively, the seventh predetermined time may be set to the maximum value of the stopping time of the feed roller 112 when collision of a medium occurs in a previously performed experiment of successively conveying media smaller than the second size threshold value while changing the stopping time. Alternatively, the seventh predetermined time may be set to a time by which medium feeding by the feed roller 112 can be delayed for the amount of delay in medium ejection due to deceleration of an ejection roller 123 in the processing described later.

In other words, the control module 151 stops the feed roller 112 in step S309 when the front edge of the medium passes a conveyance roller 119 in step S308. Further, the control module 151 resumes feeding by the feed roller 112 in step S715 after the rear edge of the medium passes the position of the fifth medium sensor 118 in step S311. The control module 151 delays the resumption timing of feeding by the feed roller 112 when the size of the medium of which the rear edge has passed the position of the fifth medium sensor 118 is greater than the first size threshold value relative to the resumption timing of feeding by the feed roller 112 when the size of the medium of which the rear edge has passed the position of the fifth medium sensor 118 is less than or equal to the first size threshold value. Similarly, the control module 151 delays the resumption timing of feeding by the feed roller 112 when the size of the medium of which the rear edge has passed the position of the fifth medium sensor 118 is less than the second size threshold value relative to the resumption timing of feeding by the feed roller 112 when the size of the medium of which the rear edge has passed the position of the fifth medium sensor 118 is greater than or equal to the second size threshold value.

Figure 33:
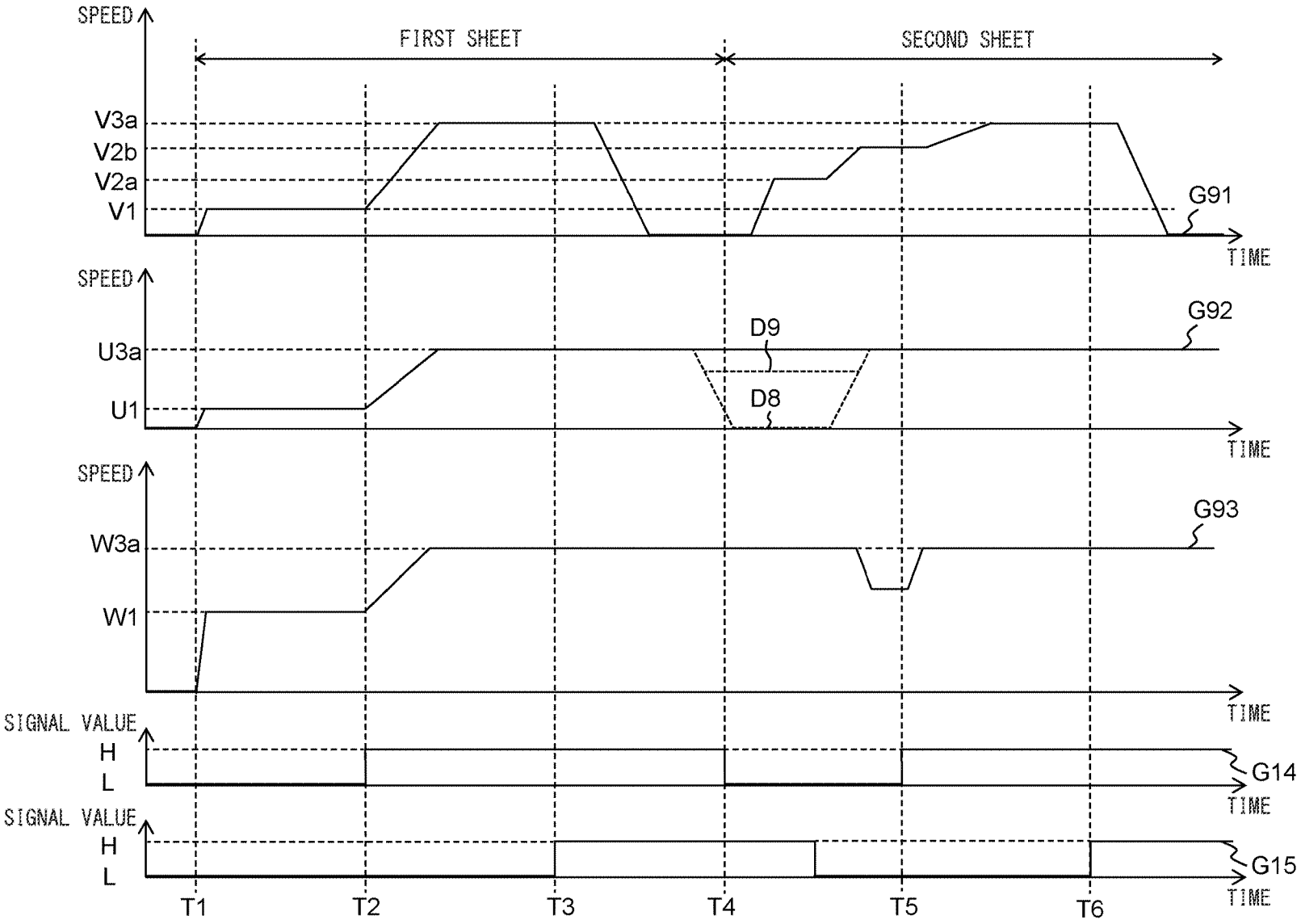
FIG. 33 is a graph for illustrating changes in the speeds of rollers.

FIG. 33 is a graph for illustrating changes in the speeds of the feed roller 112, the brake roller 113, and the conveyance roller 119 in a high-speed mode when the size of a preceding medium is greater than the first size threshold value or less than the second size threshold value.

In FIG. 33, a graph G91 illustrates an example of changes in the speed of the feed roller 112, a graph G92 illustrates an example of changes in the speed of the brake roller 113, and a graph G93 illustrates an example of changes in the speed of the conveyance roller 119. In each of the graphs G91 to G93, the horizontal axis indicates time, and the vertical axis indicates speed. Graphs G14 and G15 illustrate changes in the signal values of the fifth medium sensor 118 and a sixth medium sensor 121 and change similarly to the graphs G14 and G15 illustrated in FIG. 10. Times T1 to T6 indicate times similar to the times T1 to T6 indicated in FIG. 10.

As illustrated in the graph G91, when the size of a preceding medium is greater than the first size threshold value or less than the second size threshold value, the control module 151 delays the resumption timing of feeding by the feed roller 112 at the time T4. When a large-sized medium is conveyed, the size of an input image increases, and a considerable time may be required for image processing. By delaying the resumption timing of feeding when a large-sized medium is conveyed, the control module 151 can smoothly convey the medium and acquire a satisfactory image without stopping the medium for image processing. Further, as described above, the distance between successively conveyed media generally tends to decrease as the length of the media decreases. By delaying the resumption timing of feeding when a small-sized medium is conveyed, the control module 151 can suppress occurrence of collision between successively conveyed media. Further, when a large-sized medium or a small-sized medium is conveyed, the control module 151 reduces the speed of the ejection roller 123 in the processing described later. In that case, the control module 151 can convey the medium at a stable speed by delaying the resumption timing of feeding.

After waiting until the front edge of the medium passes the position of the second medium sensor 114 in step S716, the control module 151 determines whether the size of the preceding medium is greater than the first size threshold value and whether the size is less than the second size threshold value (step S717). When the size of the preceding medium is less than or equal to the first size threshold value and greater than or equal to the second size threshold value, the control module 151 proceeds the processing to step S719 without executing particular processing.

When the size of the preceding medium is greater than the first size threshold value or less than the second size threshold value, the control module 151 waits until the seventh predetermined time elapses (step S718).

As illustrated in the graph G91 in FIG. 33, when the size of the preceding medium is greater than the first size threshold value or less than the second size threshold value, the control module 151 delays the timing of increasing the speed of the feed roller 112 between the time T4 and the time T5. Consequently, the control module 151 can smoothly convey a large-sized medium and acquire a satisfactory image without stopping the medium for image processing. Further, when a small-sized medium is conveyed, the control module 151 can suppress occurrence of collision with another medium. Further, the control module 151 can convey a medium at a stable speed.

After acquiring an input image step S721, the control module 151 determines whether the size of the preceding medium is greater than the first size threshold value and whether the size is less than the second size threshold value (step S722). When the size of the preceding medium is less than or equal to the first size threshold value and greater than or equal to the second size threshold value, the control module 151 proceeds the processing to step S724 without particularly executing processing.

When the size of the preceding medium is greater than the first size threshold value or less than the second size threshold value, the control module 151 controls the second motor 132 to reduce the speeds of the conveyance roller 119 and the ejection roller 123 (step S723).

In other words, the control module 151 sets the rotation speed of the ejection roller 123 when the size of the medium is greater than the first size threshold value to a speed lower than the rotation speed of the ejection roller 123 when the size of the medium is less than or equal to the first size threshold value. Further, the control module 151 sets the rotation speed of the ejection roller 123 when the size of the medium is less than the second size threshold value to a speed lower than the rotation speed of the ejection roller 123 when the size of the medium is greater than or equal to the second size threshold value.

As illustrated in the graph G93 in FIG. 33, when the size of the preceding medium is greater than the first size threshold value or less than the second size threshold value, the control module 151 reduces the speed of the ejection roller 123 between the time T4 and the time T5. When a large-sized medium is ejected, the front edge of the medium may go past the front edge of the ejection tray 104, and the medium may fly out of the ejection tray 104 by the weight of the front edge going past the ejection tray 104. By reducing the speed of the ejection roller 123 when a large-sized medium is ejected, the control module 151 can suppress occurrence of flying out of the medium from the ejection tray 104. Further, when a plurality of media with different sizes are ejected, only a small-sized medium may be ejected with force, and the rear edges of the media may not be aligned. By reducing the speed of the ejection roller 123 when a small-sized medium is ejected, the control module 151 can improve media alignment.

After waiting until the front edge of the medium passes the position of the fifth medium sensor 118 in step S724, the control module 151 determines whether the size of the preceding medium is greater than the first size threshold value and whether the size is less than the second size threshold value (step S725). When the size of the preceding medium is less than or equal to the first size threshold value and greater than or equal to the second size threshold value, the control module 151 proceeds the processing to step S727 without executing particular processing.

When the size of the preceding medium is greater than the first size threshold value or less than the second size threshold value, the control module 151 waits until the seventh predetermined time elapses (step S727).

In other words, the control module 151 increases the rotation speed of the feed roller 112 in step S727 after the fifth medium sensor 118 detects the front edge of the medium in step S724. The control module 151 delays the timing of increasing the rotation speed of the feed roller 112 when the size of the preceding medium is greater than the first size threshold value relative to the timing of increasing the rotation speed of the feed roller 112 when the size of the preceding medium is less than or equal to the first size threshold value. Similarly, the control module 151 delays the timing of increasing the rotation speed of the feed roller 112 when the size of the preceding medium is less than the second size threshold value relative to the timing of increasing the rotation speed of the feed roller 112 when the size of the preceding medium is greater than or equal to the second size threshold value.

As illustrated in the graph G91 in FIG. 33, when the size of the preceding medium is greater than the first size threshold value or less than the second size threshold value, the control module 151 delays the timing of increasing the speed of the feed roller 112 at the time T5. Consequently, the control module 151 can smoothly convey a large-sized medium and acquire a satisfactory image without stopping the medium for image processing. Further, when a small-sized medium is conveyed, the control module 151 can suppress occurrence of collision with another medium. Further, the control module 151 can convey a medium at a stable speed.

One of processing in steps S712 and S713, S717 and S718, S722 and S723, and S725 and S726 may be omitted. Further, the control module 151 may determine only either of whether the size of the medium is greater than the first size threshold value and whether the size of the medium is less than the second size threshold value in step S712, S717, S722, or S725. In that case, the control module 151 executes the processing in step S713, S718, S723, or S726 regardless of whether the size of the medium is less than the second size threshold value or whether the size of the medium is greater than the first size threshold value.

In step S712, S717, or S725, the control module 151 may determine whether the size of a medium preceding the medium of which the rear edge has passed the position of the fifth medium sensor 118 is greater than the first size threshold value and whether the size is less than the second size threshold value. In other words, the control module 151 delays the resumption timing of feeding by the feed roller 112 when the size of a medium preceding the medium of which the rear edge has passed the position of the fifth medium sensor 118 is greater than the first size threshold value relative to the resumption timing of feeding by the feed roller 112 when the size of a medium preceding the medium of which the rear edge has passed the position of the fifth medium sensor 118 is less than or equal to the first size threshold value. Similarly, the control module 151 delays the resumption timing of feeding by the feed roller 112 when the size of a medium preceding the medium of which the rear edge has passed the position of the fifth medium sensor 118 is less than the second size threshold value relative to the resumption timing of feeding by the feed roller 112 when the size of a medium preceding the medium of which the rear edge has passed the position of the fifth medium sensor 118 is greater than or equal to the second size threshold value.

In these cases, the control module 151 can smoothly convey a large-sized medium and acquire a satisfactory image without stopping the medium for image processing as well. Further, when a small-sized medium is conveyed, the control module 151 can suppress occurrence of collision with another medium.

As indicated by a dotted line D8 in G92 in FIG. 33, the control module 151 may temporarily stop the brake roller 113 while the rear edge of the medium is passing the nip region of the feed roller 112 and the brake roller 113 and resume rotation of the brake roller 113 after the rear edge passes the nip region. Alternatively, as indicated by a dotted line D9 in G92, the control module 151 may reduce the speed of the brake roller 113 while the rear edge of the medium is passing the nip region and increase and return the speed of the brake roller 113 to the final speed U3*a* after the rear edge passes the nip region. Consequently, the control module 151 can suppress occurrence of jamming of a medium due to the front edge of the succeeding medium being turned up.

The control module 151 may start rotation of the brake roller 113 before rotation of the feed roller 112. Consequently, the control module 151 can suppress a surge of a plurality of media placed on the loading tray 103 into between the feed roller 112 and the brake roller 113 and can suppress occurrence of multi feed of media.

As described in detail above, the medium conveying apparatus can control medium feeding better when the speed of the ejection roller 123 is changed based on the size of the medium as well.

The medium conveying apparatus may drive the brake roller 113 by either a first motor or a second motor when changing the speed of the ejection roller 123. In that case, the control module 151 adjusts the timing of changing the speed of the brake roller 113 to the timing of changing the speed of the feed roller 112 or the ejection roller 123. Further, the control module 151 may change the speed of the feed roller 112 or the brake roller 113 by controlling the first electromagnetic clutch 133 or the second electromagnetic clutch 134. Further, the medium conveying apparatus may include a driving force interruption mechanism, such as an electromagnetic clutch, between the ejection roller 123 and the second motor, and the control module 151 may change the speed of the conveyance roller 119 by controlling the driving force interruption mechanism. The driving force interruption mechanism may be a planetary gear mechanism. The planetary gear is provided to be able to move between a position at which the planetary gear transmits the driving force from the second motor to the ejection roller 123 and a position at which the planetary gear does not transmit the driving force from the second motor to the ejection roller 123.

Figure 34:
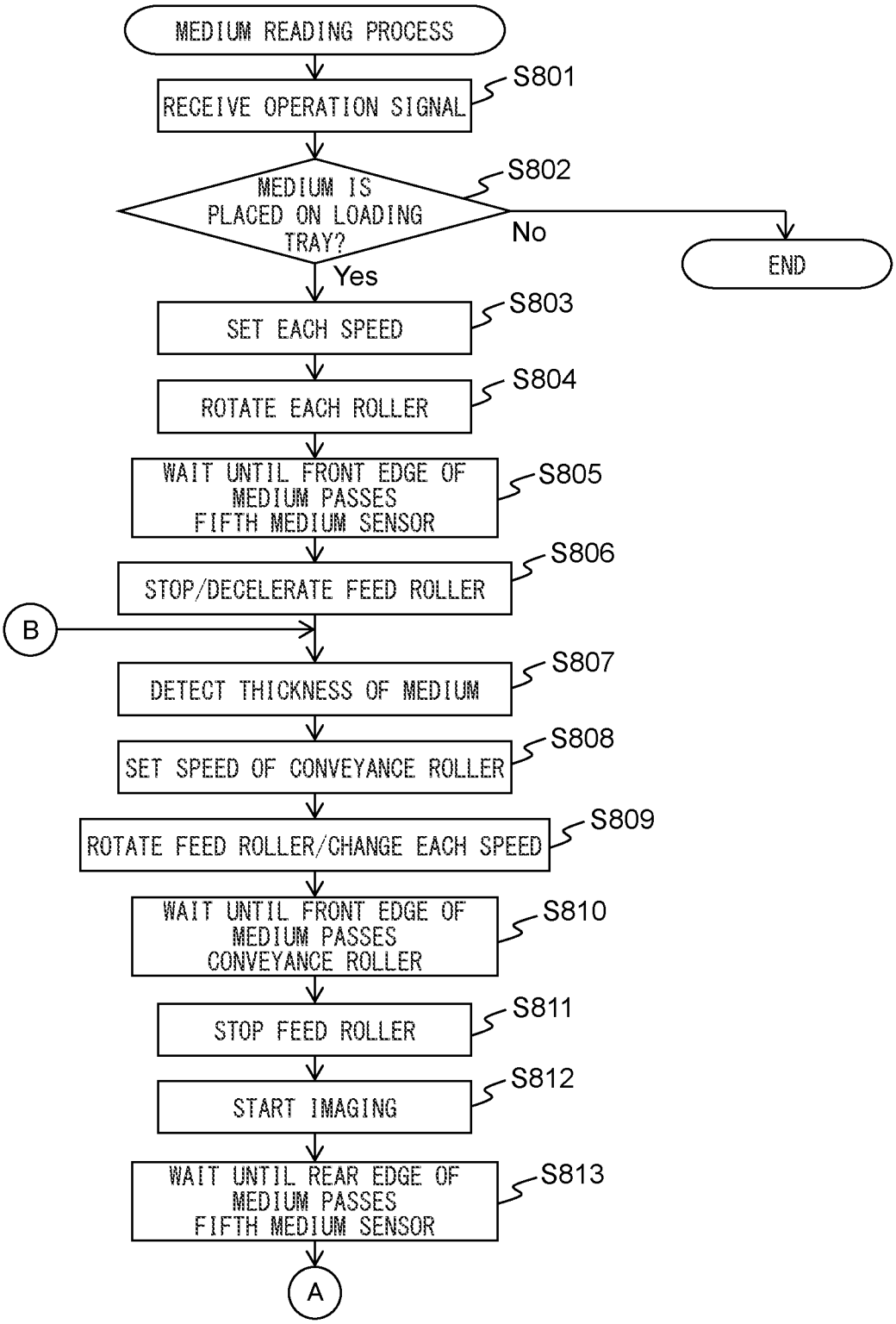
FIG. 34 is a flowchart illustrating an operation example of yet another type of medium reading processing.
Figure 35:
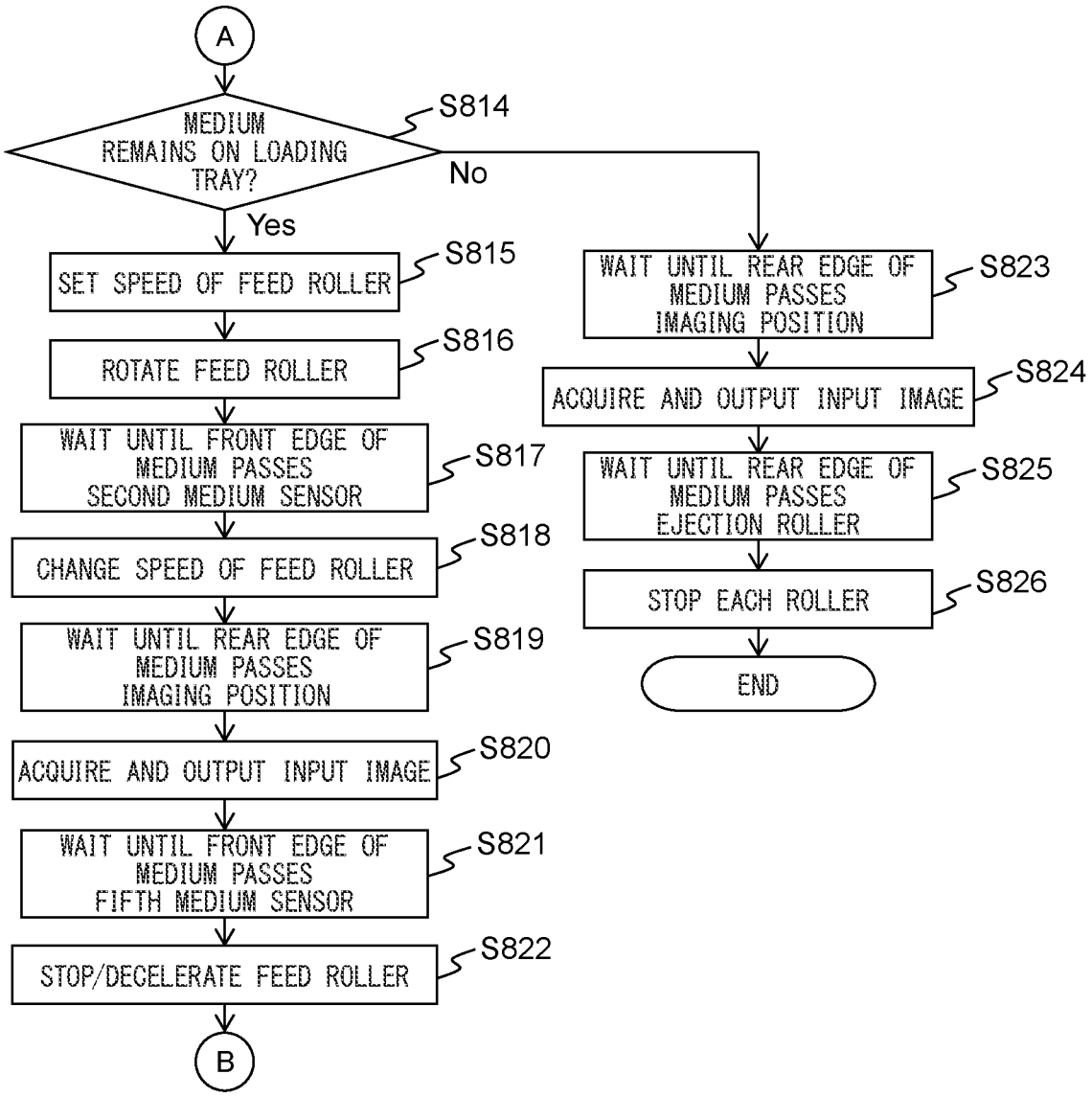
FIG. 35 is a flowchart illustrating an operation example of yet another type of medium reading processing.

FIG. 34 and FIG. 35 are flowcharts illustrating an operation example of medium reading process in a medium conveying apparatus according to yet another embodiment. The medium conveying apparatus according to the present embodiment includes the driving sources illustrated in FIG. 28 or the driving sources illustrated in FIG. 31.

The flowcharts illustrated in FIG. 34 and FIG. 35 are executed in place of the flowcharts illustrated in FIG. 8 and FIG. 9. Processing in steps S801 to S805, S810 to S821, and S823 to S826 in FIG. 34 and FIG. 35 is similar to the processing in steps S101 to S105, S107 to SS118, and S120 to S123 in FIG. 8 and FIG. 9, and therefore description thereof is omitted. Only steps S806 to S809 and S822 will be described below.

After waiting until the front edge of the medium passes the position of a fifth medium sensor 118 in step S805, the control module 151 controls a first motor 131 to temporarily stop the feed roller 112 or reduce the speed of the feed roller 112 (step S806).

Figure 36:
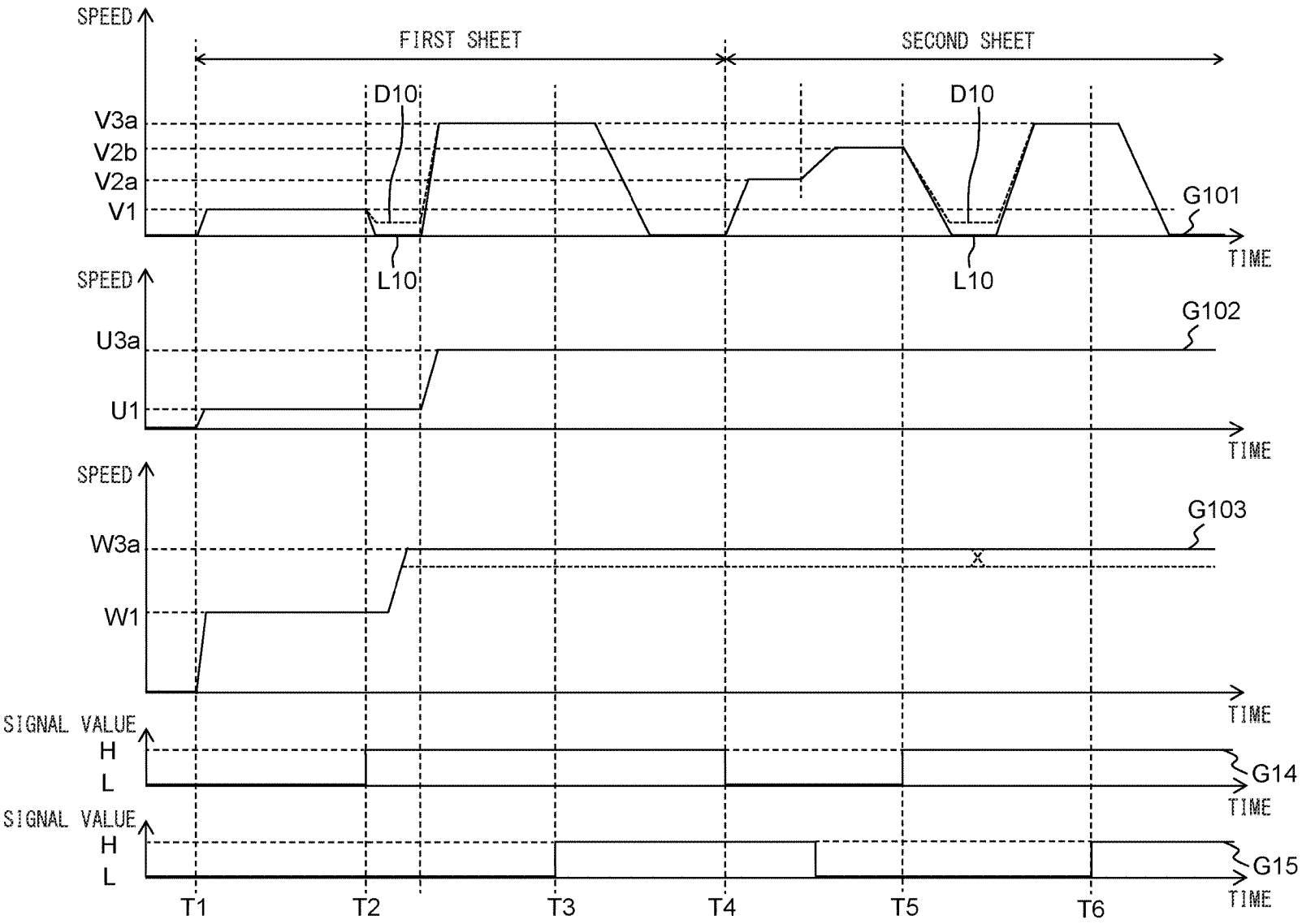
FIG. 36 is a graph for illustrating changes in the speeds of rollers.

FIG. 36 is a graph for illustrating changes in the speeds of the feed roller 112, a brake roller 113, and a conveyance roller 119 in a high-speed mode.

In FIG. 36, a graph G101 illustrates an example of changes in the speed of the feed roller 112, a graph G102 illustrates an example of changes in the speed of the brake roller 113, and a graph G103 illustrates an example of changes in the speed of the conveyance roller 119. In each of the graphs G101 to G103, the horizontal axis indicates time, and the vertical axis indicates speed. Graphs G14 and G15 illustrate changes in the signal values of the fifth medium sensor 118 and a sixth medium sensor 121 and change similarly to the graphs G14 and G15 illustrated in FIG. 10. Times T1 to T6 indicate times similar to the times T1 to T6 indicated in FIG. 10.

As indicated by a solid line L10 in the graph G101, the control module 151 stops the feed roller 112 at the time T2. Alternatively, as indicated by a dotted line D10 in the graph G101, the control module 151 decelerates the feed roller 112 at the time T2.

Next, the control module 151 detects the thickness of the conveyed medium, similarly to the processing in step S307 in FIG. 18 (step S807).

Next, the control module 151 sets and changes the speed of the conveyance roller 119, based on the detected thickness of the medium (step S808). The speed of the conveyance roller 119 is set within a range higher than or equal to the initial speed W1 and lower than or equal to the final speed W3*a*. In particular, the control module 151 sets the rotation speed of the conveyance roller 119 in such a way that the speed of the conveyance roller 119 is higher than or equal to the speed of the feed roller 112. Consequently, the control module 151 can suppress occurrence of jamming of a medium due to the medium being pushed by the feed roller 112 and being bent between the feed roller 112 and the conveyance roller 119.

The speed of the conveyance roller 119 is set to increase as the thickness of a medium decreases and decrease as the thickness of the medium increases. The speed of the conveyance roller 119 may be set to increase as the thickness of the medium increases and decrease as the thickness of the medium decreases. The medium conveying apparatus 100 previously stores a table defining a relation between the thickness of a medium and the speed of the conveyance roller 119 into the storage device 140. The control module 151 specifies a speed related to the detected thickness with reference to the table stored in the storage device 140.

Thus, the control module 151 sets the speed of the conveyance roller 119, based on a detected thickness of a medium. Consequently, the control module 151 can convey a medium at a suitable speed based on the thickness of the medium.

As illustrated in the graph G103 in FIG. 36, the control module 151 changes the speed of the conveyance roller 119 to the speed set in step S808 while the feed roller 112 is stopped or decelerated.

Next, the control module 151 resumes rotation of the feed roller 112 and changes the speed of the brake roller 113. Alternatively, the control module 151 changes the speeds of the feed roller 112 and the brake roller 113 (step S809).

As illustrated in the graph G101 in FIG. 36, after setting the speed of the feed roller 112 to the final speed V3*a*, the control module 151 resumes rotation of the feed roller 112 or changes the speed of the feed roller 112 in such a way that the speed increases to the final speed V3*a*. Further, as illustrated in the graph G102, the control module 151 changes the speed of the brake roller 113 to increase to the final speed U3*a*.

Thus, when the front edge of the medium passes the fifth medium sensor 118, the control module 151 temporarily stops or decelerates the feed roller 112, detects the thickness of the medium, and sets the rotation speed of the conveyance roller 119, based on the thickness of the medium. Subsequently, the control module 151 resumes rotation of the feed roller 112 or accelerates the feed roller 112. When the thickness of the medium is detected during medium feeding, a detection error may occur due to, for example, shaking of the medium. By detecting the thickness of the medium in a state of temporarily stopping or decelerating the feed roller 112, the control module 151 can more precisely detect the thickness of the medium.

After waiting until the front edge of the medium passes the position of the fifth medium sensor 118 in step S821, the control module 151 controls the first motor 131 to temporarily stop the feed roller 112 or reduce the speed of the feed roller 112 (step S822). From this point, the processing in steps S807 to S809 is executed, the control module 151 detects the thickness of the next medium, sets the rotation speed of the conveyance roller 119 based on the thickness of the medium, and subsequently resumes rotation of the feed roller 112 or accelerates the feed roller 112.

As illustrated in the graph G101 in FIG. 36, the control module 151 stops or decelerates the feed roller 112 at the time T5. Subsequently, the control module 151 changes the speed of the conveyance roller 119 to the speed newly set in step S808 as illustrated in the graph G103 and resumes rotation of the feed roller 112 or accelerates the feed roller 112 as illustrated in the graph G101.

As described in detail above, the medium conveying apparatus can control medium feeding better when changing the speed of the conveyance roller 119 based on the thickness of the medium.

The medium conveying apparatus may drive the brake roller 113 by either the first motor or the second motor when changing the speed of the conveyance roller 119, based on the thickness of the medium. In that case, the control module 151 adjusts the timing of changing the speed of the brake roller 113 to the timing of changing the speed of the feed roller 112 or the conveyance roller 119. Further, the control module 151 may change the speed of the feed roller 112 or the brake roller 113 by controlling the first electromagnetic clutch 133 or the second electromagnetic clutch 134. Further, the medium conveying apparatus may include a driving force interruption mechanism, such as an electromagnetic clutch, between the conveyance roller 119 and the second motor, and the control module 151 may change the speed of the conveyance roller 119 by controlling the driving force interruption mechanism. The driving force interruption mechanism may be a planetary gear mechanism. The planetary gear is provided to be able to move between a position at which the planetary gear transmits the driving force from the second motor to the conveyance roller 119 and a position at which the planetary gear does not transmit the driving force from the second motor to the conveyance roller 119.

Figure 37:
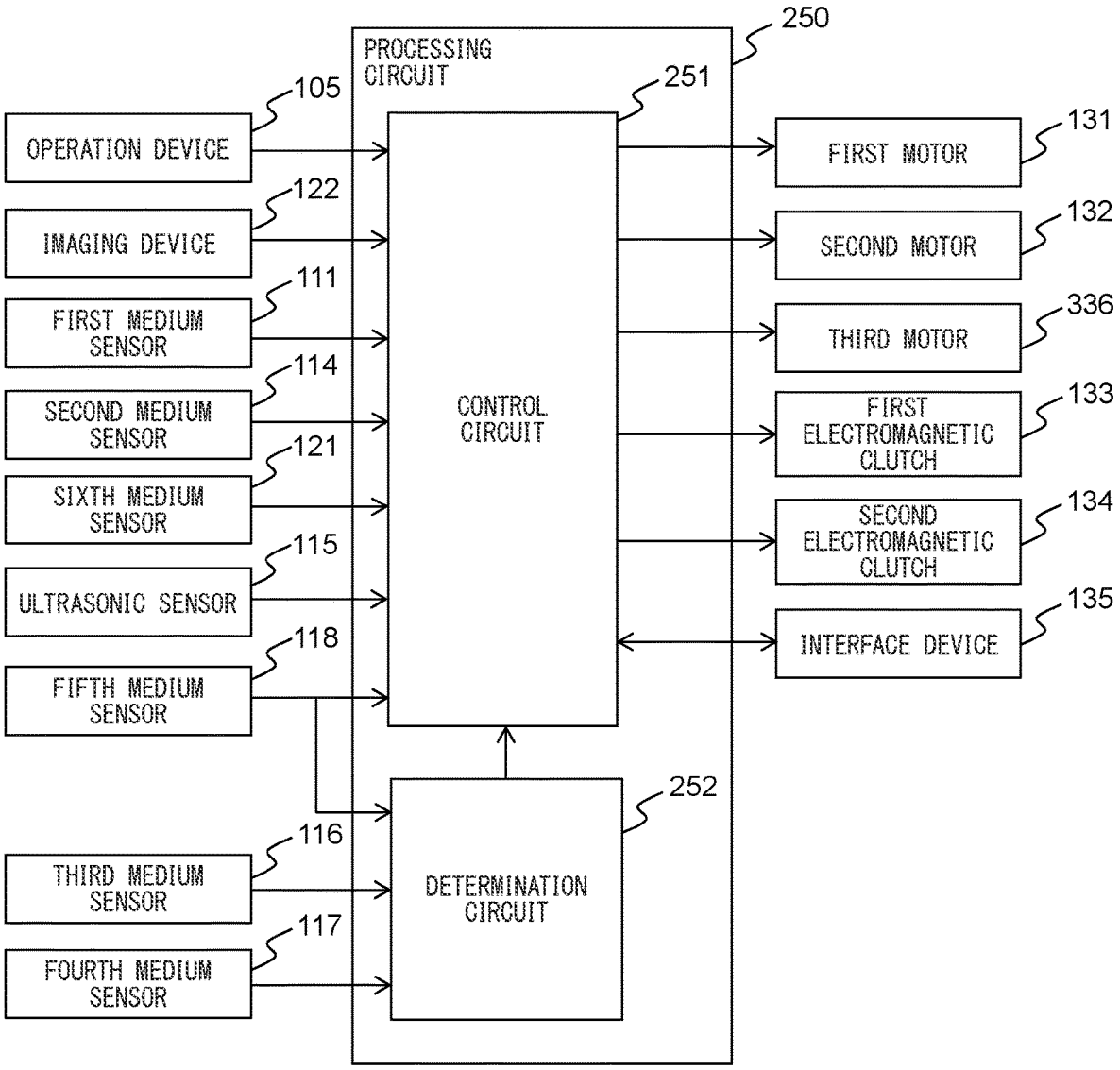
FIG. 37 is a diagram illustrating a schematic configuration of another example of processing circuit.

FIG. 37 is a diagram illustrating a schematic configuration of an example processing circuit in a medium conveying apparatus according to another embodiment. The processing circuit 250 is used in place of the processing circuit 150 in the medium conveying apparatus 100 and executes the medium reading process, etc., in place of the processing circuit 150. The processing circuit 250 includes a control circuit 251, a determination circuit 252, etc. Each component may be independently configured with an integrated circuit, a microprocessor, firmware, etc.

The control circuit 251 is an example of a control module and has a function similar to that of the control module 151. The control circuit 251 receives the operation signal from the operation device 105 or the interface device 135. Further, the control circuit 251 receives the first medium signal, the second medium signal, the ultrasonic signal, the fifth medium signal, and the sixth medium signal from the first medium sensor 111, the second medium sensor 114, the ultrasonic sensor 115, the fifth medium sensor 118, and the sixth medium sensor 121, respectively. Further, the control circuit 251 receives a determination result of a skew of a medium from the determination circuit 252. The control circuit 251 controls the first motor 131, the second motor 132, the third motor 336, the first electromagnetic clutch 133, and the second electromagnetic clutch 134, based on the received information, acquires the input image from the imaging device 122, and outputs the acquired image to the interface device 135.

The determination circuit 252 is an example of a determination module and has a function similar to that of the determination module 152. The determination circuit 252 receives the third medium signal, the fourth medium signal, and the fifth medium signal from the third medium sensor 116, the fourth medium sensor 117, and the fifth medium sensor 118, respectively. The determination circuit 252 determines whether a skew of a medium has occurred based on the received signals, and outputs the determination result to the control circuit 251.

As described in detail above, the medium conveying apparatus can control medium feeding better when the processing circuit 250 is used as well.

While preferred embodiments have been described above, the embodiment is not limited thereto. For example, the medium conveying apparatus 100 may have a thin paper conveyance mode for conveying thin paper as a medium and a normal mode for conveying other media. In that case, the control module 151 sets the rotation speed of the feed roller 112 in such a way that the speed of the feed roller 112 in the normal mode is higher than the speed of the feed roller 112 in the thin paper conveyance mode. Consequently, thin paper is conveyed at a lower speed compared with other media, and therefore the control module 151 can suppress occurrence of damage to thin paper due to conveyance.

Similarly to the aforementioned embodiments, the control module 151 sets the rotation speed of the feed roller 112 and the rotation speed of the conveyance roller 119 in such a way that the speed of the conveyance roller 119 is higher than the speed of the feed roller 112 in the normal mode and the thin paper conveyance mode. Consequently, the control module 151 can suppress occurrence of jamming of a medium due to the medium being pushed by the feed roller 112 and being bent between the feed roller 112 and the conveyance roller 119 in the normal mode and the thin paper conveyance mode. Furthermore, the control module 151 sets the rotation speed of the feed roller 112 and the rotation speed of the conveyance roller 119 in such a way that the ratio of the speed of the feed roller 112 to the speed of the conveyance roller 119 in the normal mode is less than the ratio of the speed of the feed roller 112 to the speed of the conveyance roller 119 in the thin paper conveyance mode. Consequently, the speed of the feed roller 112 approaches the speed of the conveyance roller 119 in the thin paper conveyance mode, and thin paper is more stably conveyed.

The medium conveying apparatus may have a separation mode that separates and feeds a medium and a non-separation mode that feeds a medium without separation. In that case, when operating in the separation mode, the control module 151 executes each type of medium reading process described above. When operating in the non-separation mode, the control module 151 controls each motor in such a way that the brake roller 113 rotates in the medium feeding direction or rotates following the feed roller 112. In that case, the control module 151 changes the magnitude of torque exerted on the brake roller 113 by controlling the second electromagnetic clutch 134. Consequently, the control module 151 can suitably feed a medium in both the separation mode and the non-separation mode.

The medium conveying apparatus may not have the high-speed mode, the medium-speed mode, and the low-speed mode and may operate in the high-speed mode in a fixed manner.

In determination using the fifth medium sensor 118, the control module 151 may use the second medium sensor 114 in place of the fifth medium sensor 118. In other words, in each type of processing described above, the control module 151 may execute each type of processing executed when the front edge or the rear edge of a medium passes the position of the fifth medium sensor 118 at a time when the front edge or the rear edge of the medium passes the position of the second medium sensor 114.

The size or the thickness of a medium may be set by a user by using the operation device 105 or the information processing apparatus instead of being detected by using a sensor. Alternatively, the size or the thickness of a medium may be specified from a medium type (such as paper, a postcard, or a business card) set by a user by using the operation device 105 or the information processing apparatus. In that case, the medium conveying apparatus previously stores a table defining a relation between a medium type and the size or the thickness of the medium into the storage device 140. The control module 151 specifies the size or the thickness of a conveyed medium with reference to the table stored in the storage device 140.

According to the embodiments, the medium conveying apparatus, the control method, and the control program can control medium feeding better.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a presentation of the superiority and inferiority of the invention. Although the embodiment(s) of the present inventions have been described in detail, it should be understood that the various changes, substitutions, and alterations could be made hereto without departing from the spirit and scope of the invention.

Supplementary Note 1

A medium conveying apparatus comprising:
a loading tray to place media;
a feed roller to separate and sequentially feed the media placed on the loading tray;
a motor to drive the feed roller;
a conveyance roller to convey the media fed by the feed roller;
a sensor located between the feed roller and the conveyance roller and configured to detect a medium; and
a control module to control the motor,
wherein, in a separation period from a start of medium feeding by the feed roller to detection of a front edge of the first medium by the sensor, when feeding a first medium of media placed on the loading tray, the control module controls the motor to rotate the feed roller at a constant speed, and when feeding a second or subsequent medium, the control module controls the motor to rotate the feed roller at a first speed and then at a second speed higher than the first speed.

Supplementary Note 2

The medium conveying apparatus according to supplementary note 1, wherein, when a front edge of a medium passes the conveyance roller, the control module controls the motor to continue rotation of the feed roller while reducing a rotation speed of the feed roller.

Supplementary Note 3

The medium conveying apparatus according to supplementary notes 1 or 2, wherein the control module reduces a rotation speed of the conveyance roller when a rear edge of a medium passes the sensor.

Supplementary Note 4

The medium conveying apparatus according to any one of supplementary notes 1 to 3, further comprising an imaging device located on a downstream side of the conveyance roller in a medium conveying direction and configured to image the media conveyed by the conveyance roller, wherein
the control module increases a rotation speed of the conveyance roller when a rear edge of a medium passes an imaging position of the imaging device.

Supplementary Note 5

The medium conveying apparatus according to any one of supplementary notes 1 to 4, wherein the control module increases a rotation speed of the feed roller when a rear edge of a medium passes the conveyance roller.

Supplementary Note 6

The medium conveying apparatus according to any one of supplementary notes 1 to 5, wherein
the control module
detects a size of a medium, wherein
when the size of a preceding medium is less than or equal to a size threshold value, the control module sets the second speed to a speed lower than the second speed when the size of the preceding medium is greater than the size threshold value.

Supplementary Note 7

The medium conveying apparatus according to any one of supplementary notes 1 to 6, wherein
the control module
detects a thickness of a medium, wherein
when the thickness of a preceding medium is less than or equal to a thickness threshold value, the control module sets the second speed to a speed lower than the second speed when the thickness of the preceding medium is greater than the thickness threshold value.

Supplementary Note 8

The medium conveying apparatus according to any one of supplementary notes 1 to 7, further comprising an ejection roller to eject the media conveyed by the conveyance roller, wherein the control module detects a size of a medium, wherein when the size of the medium is greater than a first size threshold value, the control module sets a rotation speed of the ejection roller to a speed lower than the rotation speed of the ejection roller when the size of the medium is less than or equal to the first size threshold value.

Supplementary Note 9

The medium conveying apparatus according to any one of supplementary notes 1 to 7, further comprising an ejection roller to eject the media conveyed by the conveyance roller, wherein the control module detects a size of a medium, wherein when the size of the medium is less than a second size threshold value, the control module sets a rotation speed of the ejection roller to a speed lower than the rotation speed of the ejection roller when the size of the medium is greater than or equal to the second size threshold value.

Supplementary Note 10

The medium conveying apparatus according to any one of supplementary notes 1 to 9, wherein the control module detects a size of a medium, and increases a rotation speed of the feed roller after the sensor detects a front edge of the medium, wherein when the size of a preceding medium is greater than a first size threshold value, the control module delays a timing of increasing a rotation speed of the feed roller relative to a timing of increasing the rotation speed of the feed roller when the size of the preceding medium is less than or equal to the first size threshold value.

Supplementary Note 11

The medium conveying apparatus according to any one of supplementary notes 1 to 10, wherein the control module detects a size of a medium, and stops the feed roller when a front edge of the medium passes the conveyance roller and resumes feeding by the feed roller after a rear edge of the medium passes a predetermined position, wherein when the size of a medium of which a rear edge has passed the predetermined position or a medium preceding the medium is greater than a first size threshold value, the control module delays a resumption timing of feeding by the feed roller relative to a resumption timing of feeding by the feed roller when the size of the medium of which the rear edge has passed the predetermined position or the medium preceding the medium is less than or equal to the first size threshold value.

Supplementary Note 12

The medium conveying apparatus according to any one of supplementary notes 1 to 11, wherein the control module detects a thickness of a medium, and sets a rotation speed of the conveyance roller based on the thickness of the medium.

Supplementary Note 13

The medium conveying apparatus according to supplementary note 12, wherein, when a front edge of the medium passes the sensor, the control module temporarily stops or decelerates the feed roller, detects the thickness of the medium, and sets a rotation speed of the conveyance roller and subsequently, the control module resumes rotation of the feed roller or accelerates the feed roller.

Supplementary Note 14

The medium conveying apparatus according to any one of supplementary notes 1 to 13, wherein the control module sets a rotation speed of the conveyance roller in such a way that a surface moving speed of the conveyance roller is higher than or equal to a surface moving speed of the feed roller.

Supplementary Note 15

The medium conveying apparatus according to supplementary note 14, wherein the medium conveying apparatus has a normal mode and a thin paper conveyance mode, and wherein the control module sets a rotation speed of the feed roller and a rotation speed of the conveyance roller in such a way that a ratio of the surface moving speed of the feed roller to the surface moving speed of the conveyance roller in the normal mode is less than a ratio of the surface moving speed of the feed roller to the surface moving speed of the conveyance roller in the thin paper conveyance mode, and the surface moving speed of the feed roller in the normal mode is higher than the surface moving speed of the feed roller in the thin paper conveyance mode.

Supplementary Note 16

The medium conveying apparatus according to any one of supplementary notes 1 to 15, wherein the control module temporarily stops or decelerates the feed roller when a time elapsed after a rear edge of a preceding medium passes a first position until a front edge of a succeeding medium passes a second position is less than or equal to a predetermined time.

Supplementary Note 17

The medium conveying apparatus according to any one of supplementary notes 1 to 16, wherein the control module temporarily stops or decelerates the feed roller when a front edge of a medium succeeding a preceding medium passes the sensor and determines a timing of resuming rotation of the feed roller or a timing of accelerating the feed roller based on a time elapsed after a rear edge of the preceding medium passes a first position until a front edge of the succeeding medium passes a second position.

What is claimed is:

1. A medium conveying apparatus comprising:

a loading tray to place media;

a feed roller to separate and sequentially feed the media placed on the loading tray;

a motor to drive the feed roller;

a sensor located on a downstream side of the feed roller in a medium conveying direction to detect a medium; and a processor to control the motor, wherein in a separation period from a start of medium feeding by the feed roller to detection of a front edge of the first medium by the sensor, when feeding a first medium of media placed on the loading tray, the processor controls the motor to rotate the feed roller at a constant speed, and when feeding a second or subsequent medium, the processor controls the motor to rotate the feed roller at a first speed and then at a second speed higher than the first speed.

2. The medium conveying apparatus according to claim 1, wherein the processor controls the motor to rotate the feed roller at a speed lower than the first speed when feeding the first medium of the media placed on the loading tray.

3. The medium conveying apparatus according to claim 1, wherein the processor controls the motor to rotate the feed roller at a speed higher than the second speed after detecting a front edge of the second or subsequent medium by the sensor.

4. The medium conveying apparatus according to claim 1, further comprising a brake roller located to face the feed roller and configured to rotate in a direction opposite to a medium feeding direction, wherein when feeding the first medium of the media placed on the loading tray, the processor sets a rotation speed of the brake roller in the separation period to a speed lower than a rotation speed of the brake roller in the separation period when feeding the second or subsequent medium.

5. The medium conveying apparatus according to claim 4, wherein, when feeding the first medium of the media placed on the loading tray, the processor sets a rotation speed of the brake roller in such a way that a surface moving speed of the brake roller in the separation period is higher than ½ of a surface moving speed of the feed roller in the separation period when feeding the first medium.

6. The medium conveying apparatus according to claim 1, further comprising a conveyance roller to convey the media fed by the feed roller, wherein the processor determines whether a skew of a medium has occurred, and wherein, when it is determined that the skew of the medium has occurred by the processor, the processor sets the second speed in such a way that a surface moving speed of the feed roller is lower than a surface moving speed of the conveyance roller, and when it is not determined that the skew of the medium has occurred by the processor, the processor sets the second speed in such a way that a surface moving speed of the feed roller is identical to a surface moving speed of the conveyance roller.

7. The medium conveying apparatus according to claim 1, further comprising:

a brake roller located to face the feed roller and configured to rotate in a direction opposite to a medium feeding direction;

a conveyance roller to convey the media fed by the feed roller; and a second motor to drive the brake roller and the conveyance roller.

8. The medium conveying apparatus according to claim 7, further comprising an electromagnetic clutch provided on a driving force transmission path from a driving source of the brake roller to the brake roller.

9. The medium conveying apparatus according to claim 1, further comprising:

a brake roller located to face the feed roller and configured to rotate in a direction opposite to a medium feeding direction; and a conveyance roller to convey the media fed by the feed roller; wherein the motor drives the brake roller along with the feed roller, and the medium conveying apparatus further comprises a second motor to drive the conveyance roller.

10. The medium conveying apparatus according to claim 9, further comprising an interruption mechanism that can interrupt a driving force from the motor to the feed roller, wherein, when a front edge of a medium passes the conveyance roller, the processor controls the interruption mechanism to continue transmitting a driving force from the motor to the brake roller while interrupting a driving force from the motor to the feed roller.

11. The medium conveying apparatus according to claim 1, further comprising:

a brake roller located to face the feed roller and configured to rotate in a direction opposite to a medium feeding direction;

a conveyance roller to convey the media fed by the feed roller;

a second motor to drive the conveyance roller; and a third motor to drive the brake roller.

12. The medium conveying apparatus according to claim 1, further comprising a second sensor located between the feed roller and the sensor and configured to detect a medium, wherein the processor controls the motor to rotate the feed roller at the second speed when the second sensor detects a front edge of a medium in the separation period.

13. A method for conveying a medium, the method comprising:

separating and sequentially feeding media placed on a loading tray by a feed roller;

driving the feed roller by a motor;

detecting a medium by a sensor located on a downstream side of the feed roller in a medium conveying direction; and controlling the motor, wherein in a separation period from a start of medium feeding by the feed roller to detection of a front edge of the first medium by the sensor, when feeding a first medium of media placed on the loading tray, controlling the motor to rotate the feed roller at a constant speed, and when feeding a second or subsequent medium, controlling the motor to rotate the feed roller at a first speed and then at a second speed higher than the first speed.

14. The method according to claim 13, wherein the motor is controlled to rotate the feed roller at a speed lower than the first speed when feeding the first medium of the media placed on the loading tray.

15. The method according to claim 13, wherein the motor is controlled to rotate the feed roller at a speed higher than the second speed after detecting a front edge of the second or subsequent medium by the sensor.

16. The method according to claim 13, wherein, when feeding the first medium of the media placed on the loading tray, a rotation speed in the separation period of a brake roller located to face the feed roller and configured to rotate in a direction opposite to a medium feeding direction is set to a speed lower than a rotation speed in the separation period of the brake roller when feeding the second or subsequent medium.

17. A computer-readable, non-transitory medium storing executable instructions for conveying a medium, the executable instructions comprising:

controlling a motor to drive a feed roller to separate and sequentially feed media placed on a loading tray, wherein in a separation period from a start of medium feeding by the feed roller to detection of a front edge of the first medium by a sensor located on a downstream side of the feed roller in a medium conveying direction, when feeding a first medium of media placed on the loading tray controlling the motor to rotate the feed roller at a constant speed, and when feeding a second or subsequent medium, controlling the motor to rotate the feed roller at a first speed and then rotate the feed roller at a second speed higher than the first speed.

18. The computer-readable, non-transitory medium according to claim 17, wherein the motor is controlled to rotate the feed roller at a speed lower than the first speed when feeding the first medium of the media placed on the loading tray.

19. The computer-readable, non-transitory medium according to claim 17, wherein the motor is controlled to rotate the feed roller at a speed higher than the second speed after detecting a front edge of the second or subsequent medium by the sensor.

20. The computer-readable, non-transitory medium according to claim 17, wherein, when feeding the first medium of the media placed on the loading tray, a rotation speed in the separation period of a brake roller located to face the feed roller and configured to rotate in a direction opposite to a medium feeding direction is set to a speed lower than a rotation speed in the separation period of the brake roller when feeding the second or subsequent medium.

* * * * *